US007575233B2

(12) United States Patent
Tanaami

(10) Patent No.: US 7,575,233 B2
(45) Date of Patent: Aug. 18, 2009

(54) PRINTING MEDIUM TRANSFERRING APPARATUS

(75) Inventor: Yasufumi Tanaami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 11/470,324

(22) Filed: Sep. 6, 2006

(65) Prior Publication Data

US 2007/0059052 A1 Mar. 15, 2007

(30) Foreign Application Priority Data

Sep. 9, 2005 (JP) ..... 2005-262375

(51) Int. Cl.
*B65H 5/02* (2006.01)

(52) U.S. Cl. ..... 271/273

(58) Field of Classification Search ..... 271/273
See application file for complete search history.

(56) References Cited

U.S. PATENT DOCUMENTS

| | | | | |
|---|---|---|---|---|
| 5,818,487 | A * | 10/1998 | Yoshimura et al. | 347/104 |
| 6,170,820 | B1 * | 1/2001 | Hutson | 271/274 |
| 6,619,796 | B2 * | 9/2003 | Rasmussen et al. | 347/104 |
| 6,854,843 | B2 * | 2/2005 | Anami et al. | 347/104 |
| 7,101,096 | B2 * | 9/2006 | Sasai et al. | 400/48 |
| 7,281,791 | B2 * | 10/2007 | Anami et al. | 347/104 |
| 7,309,123 | B2 * | 12/2007 | Anami et al. | 347/104 |
| 2002/0067940 | A1 | 6/2002 | Sasai et al. | 400/61 |
| 2004/0066444 | A1 * | 4/2004 | Anami et al. | 347/104 |
| 2004/0251607 | A1 * | 12/2004 | Mandel et al. | 271/220 |
| 2005/0225622 | A1 * | 10/2005 | Anami et al. | 347/104 |

FOREIGN PATENT DOCUMENTS

| | | |
|---|---|---|
| JP | 2002-192782 | 7/2002 |
| JP | 2003-211778 | 7/2003 |
| JP | 2004-42391 | 2/2004 |

* cited by examiner

*Primary Examiner*—Patrick H Mackey
*Assistant Examiner*—Howard Sanders
(74) *Attorney, Agent, or Firm*—Fitzpatrick, Cella, Harper & Scinto

(57) ABSTRACT

According to detection results obtained by a plurality of printing medium detection device, a printing medium is carried in while controlling an operation of pressing a pinch roller to be in contact with a conveying roller and of separating the pinch roller from the conveying roller and an operation of pressing a spur to be in contact with a eject roller and of separating the spur from the eject roller. Accordingly, it is made possible to carry the printing medium into the apparatus in a proper state even when the printing medium is a nonstandard-sized printing medium. Moreover, while effectively utilizing one driving source, a plurality of mechanism is independently controlled. Hence, accurately controlled flat-pass printing can be realized despite of the relatively small number of components.

5 Claims, 39 Drawing Sheets

| FIG.36A | FIG.36B |
|---|---|

PRINTING MEDIUM TRANSFERRING APPARATUS

BACKGROUND OF THE INVENTION

1. Field of the Invention

The present invention relates to a printing medium transferring mechanism for making a print on a printing medium which cannot be bent such as a thick printing medium, a printing medium not wished to be bent and a CD-R.

2. Description of the Related Art

In a printing apparatus such as an ink jet printing apparatus, while moving and scanning a printing head for applying a printing agent relative to a movement of a printing medium, an image is formed on the printing medium. In this event, in a case of a relatively flexible printing medium such as plain paper, it is common that printing medium loaded on a tilted paper feed tray are fed one by one by a paper feeding roller, and that a transferring direction is changed while slightly curving the printing medium along the paper feeding roller. Thereafter, a print is made on the printing medium, and the medium is transferred. However, in a case of printing on a thick printing medium, a printing medium not wished to be bent and a CD-R, it is necessary to perform all transfer within the same plane since the printing medium cannot be bent. Such a transferring operation within the same plane will be hereinafter called a flat-pass in the present specification.

There has been already proposed and implemented a configuration for realizing a normal transferring path and a flat-pass while using the same conveying roller in the printing apparatus (see, for example, Japanese Patent Application Laid-open Nos. 2002-192782, 2003-211778 and 2004-042391).

Japanese Patent Application Laid-open No. 2002-192782 discloses a configuration for installing a printing medium by allowing a user to separate a pair of conveying rollers for transferring the printing medium from each other, or to press the pair to be in contact with each other, while holding the medium from above and below. Specifically, in a case of printing by use of a flat-pass, the user first separates the pair of conveying rollers from each other, inserts a printing medium, such as cardboard, from a horizontal direction, and further causes the pair of conveying rollers to be in contact with each other by pressure. Thus, the printing medium is installed. That is, because a paper feeding step is performed in a horizontal position by the user, the flat-pass can be realized in a state where the printing medium is not curved due to a paper feeding operation.

Japanese Patent Application Laid-open No. 2003-211778 discloses a configuration for automatically separating the pair of conveying rollers from each other, and for automatically pressing the pair to be in contact with each other, by utilizing a driving source, such as a motor, and cams.

Moreover, Japanese Patent Application Laid-open No. 2004-042391 discloses a configuration in which a space is provided between a pair of conveying rollers by attaching a detachable guide member to the printing apparatus. Two pairs of conveying rollers are normally prepared respectively on upstream and downstream sides of a region where printing is made by the printing head. However, according to the foregoing document, the pair of conveying rollers, which is separated by inserting the guide member, is limited to the pair of conveying rollers on the downstream side relative to a printing medium transferring direction. Thus, the configuration is designed to also cause the pair of conveying rollers on the upstream side to easily nip the printing medium by attaching a different member thinner than the printing medium to a tip of the printing medium.

However, the methods described in the patent documents described above have several problems.

For example, as described in Japanese Patent Application Laid-open No. 2002-192782, the configuration in which the user manually separates and pressure-contacts the conveying rollers from each other, troubles the user, and causes a risk of malfunction. Moreover, as described in Japanese Patent Application Laid-open No. 2003-211778, even the configuration, in which separation of the pair of rollers from each other and pressing the pair to be in contact with each other are automatically performed, requires the user to insert the printing medium up to a position where the medium is held by the conveying rollers, and to check if the medium is held or not. Thus, it is still troublesome for the user to perform such an operation.

In the configuration described in Japanese Patent Application Laid-open No. 2004-042391, the user can realize a flat-pass only by attaching the guide member. However, as described above, since the different thin member has to be attached to the tip of the printing medium, new problems are brought about, such as that a limitation is placed on the printing medium which can be used, and that another operation for attaching the different thin member is required.

Furthermore, in order to realize a secure flat-pass, it is desired that the printing medium is reliably held by the pair of conveying rollers on the upstream side. For example, in a case of a configuration in which the printing medium is inserted from the downstream side, a limitation is placed on a size of the printing medium depending on a printing apparatus. This is because there is concern for a case where, if the printing medium is not one having a predetermined length or more, the printing medium cannot be inserted up to a depth where the medium is held by the pair of conveying rollers on the upstream side. In order to improve workability of the user while minimizing an installation area of the printing apparatus as much as possible, a configuration, in which the printing medium is inserted from a front face (i.e., the downstream side), is regarded as appropriate. Hence, in the printing apparatus having the configuration, a limitation is inevitably placed on the size of the printing medium which enables flat-pass printing.

SUMMARY OF THE INVENTION

The present invention has been made in consideration of the foregoing problems. It is an object of the present invention to provide a printing medium transferring apparatus, which can realize flat-pass printing on printing media other than those having a standard size, without troubling a user as much as possible.

The first aspect of the present invention is a printing medium transferring apparatus comprising: a first guide member which includes a first driven roller for holding and transferring a printing medium between a first roller and the first driven roller by being rotatably pressed to be in contact with the first roller, and which enables the first driven roller to be pressed to be in contact with, and separated from, the first roller while guiding a printing surface of the printing medium; a second guide member which can move up and down a transferring path surface of the printing medium while guiding the rear surface of the printing medium in a position facing the first guide member; detection means which enables installation in, and separation from, a position where presence of the printing medium can be detected in a printing medium transferring space formed between the first guide member and the second guide member; and a holding member which includes a second driven roller for holding and transferring the printing medium between a second roller and the second driven roller by being rotatably pressed to be in contact with the second roller, and which enables the second driven roller to be pressed to be in contact with, and separated from, the second roller, wherein pressing and separation of the first driven roller in the first guide member, and pressing and separation of the second driven roller in the holding member are performed by the same driving source.

The second aspect of the present invention is a printing apparatus printing medium transferring apparatus comprising: a first guide member which includes a first driven roller for holding and transferring a printing medium between a first roller and the first driven roller by being rotatably pressed to be in contact with the first roller, and which enables the first driven roller to be pressed to be in contact with, and separated from, the first roller while guiding a printing surface of the printing medium; a second guide member which can move up and down a transferring path surface of the printing medium while guiding the printing surface of the printing medium in a position facing the first guide member; first detection means which enables installation in, and separation from, a position where presence of the printing medium in the vicinity of the first guide member can be detected in a printing medium transferring space formed between the first guide member and the second guide member; a rotor holding member which includes a second rotor for holding and transferring the printing medium between a second roller and the second rotor by being rotatably pressed to be in contact with the second roller, and which enables the second rotor to be pressed to be in contact with, and separated from, the second roller; and second detection means which can detect presence of the printing medium in the vicinity of the rotor holding member, wherein, according to detection results obtained by the first detection means and the second detection means, an operation of pressing or separating of the first driven roller, and an operation of pressing or separating of the second rotor are controlled.

Further features of the present invention will become apparent from the following description of exemplary embodiments (with reference to the attached drawings).

DESCRIPTION OF THE EMBODIMENTS

Figure 1:
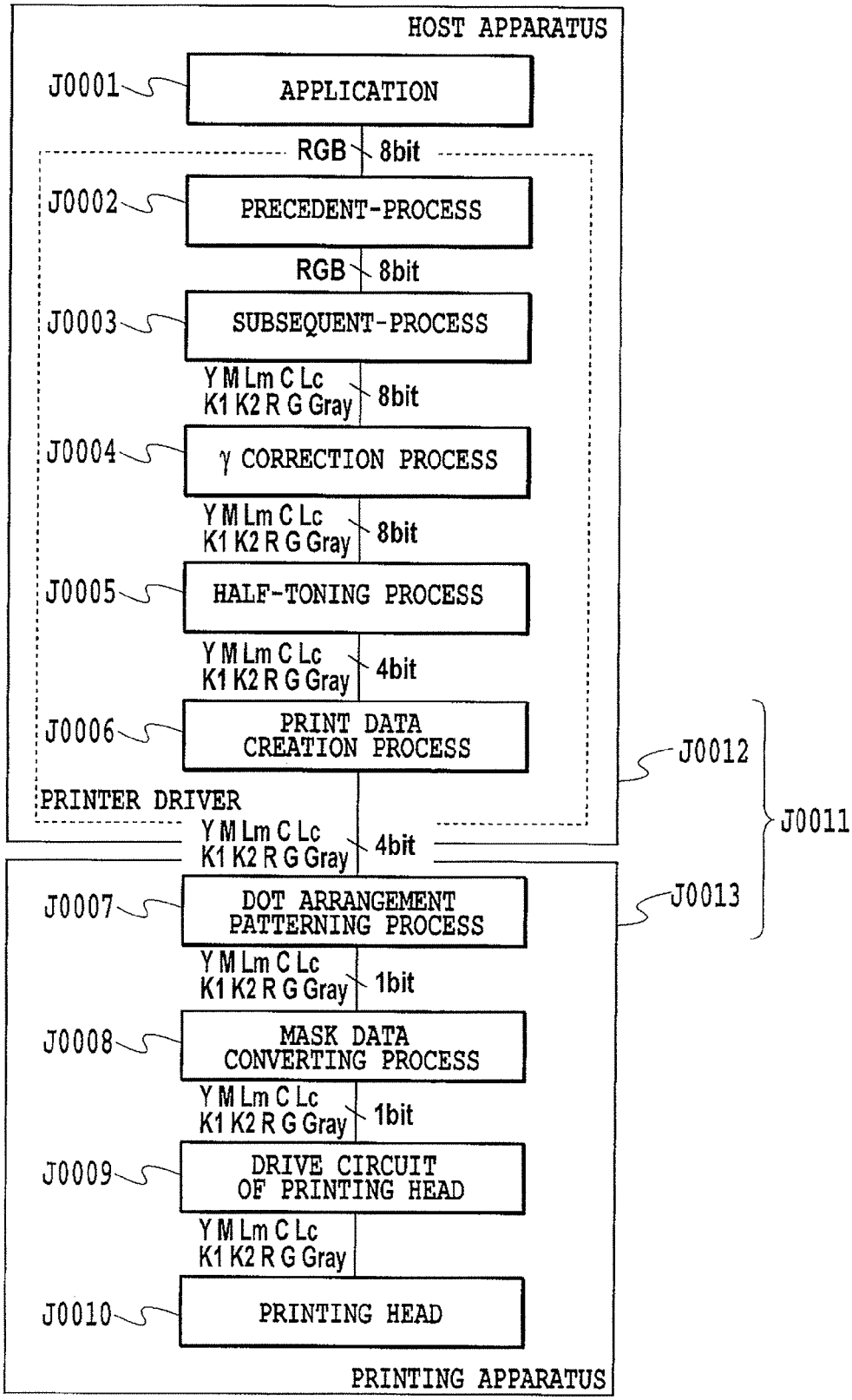
FIG. 1 is a diagram for explaining a flow in which image data are processed in a printing system to which an embodiment of the present invention is applied.

Descriptions will be provided below for embodiments of the present invention by referring to the drawings.

1. Basic Configuration

1.1 Outline of Printing System

FIG. 1 is a diagram for explaining a flow in which image data are processed in a printing system to which an embodiment of the present invention is applied. This printing system J0011 includes a host apparatus J0012 which generates image data indicating an image to be printed, and which sets up a user interface (UI) for generating the data and so on. In addition, the printing system J0011 includes a printing apparatus J0013 which prints an image on a printing medium on the basis of the image data generated by the host apparatus J0012. The printing apparatus J0013 performs a printing operation by use of 10 color inks of cyan (C), light cyan (Lc), magenta (M), light magenta (Lm), yellow (Y), red (R), green (G), black 1 (K1), black 2 (K2) and gray (Gray). To this end, a printing head H1001 for ejecting these 10 color inks is used for the printing apparatus J0013. These 10 color inks are pigmented inks respectively including ten color pigments as the color materials thereof.

Programs operated with an operating system of the host apparatus J0012 include an application and a printer driver. An application J0001 executes a process of generating image data with which the printing apparatus makes a print. Personal computers (PC) are capable of receiving these image data or pre-edited data which is yet to process by use of various media. By means of a CF card, the host apparatus according to this embodiment is capable of populating, for example, JPEG-formatted image data associated with a photo taken with a digital camera. In addition, the host apparatus according to this embodiment is capable of populating, for example, TIFF-formatted image data read with a scanner and image data stored in a CD-ROM. Moreover, the host apparatus according to this embodiment is capable of capturing data from the Web through the Internet. These captured data are displayed on a monitor of the host apparatus. Thus, an edit, a process or the like is applied to these captured data by means of the application J0001. Thereby, image data R, G and B are generated, for example, in accordance with the sRGB specification. A user sets up a type of printing medium to be used for making a print, a printing quality and the like through a UI screen displayed on the monitor of the host apparatus. The user also issues a print instruction through the UI screen. Depending on this print instruction, the image data R, G and B are transferred to the printer driver.

The printer driver includes a precedent process J0002, a subsequent process J0003, a γ correction process J0004, a half-toning process J0005 and a print data creation process J0006 as processes performed by itself. Brief descriptions will be provided below for these processes J0002 to J0006.

(A) Precedent Process

The precedent process J0002 performs mapping of a gamut. In this embodiment, data are converted for the purpose of mapping the gamut reproduced by image data R, G and B in accordance with the sRGB specification onto a gamut to be produced by the printing apparatus. Specifically, a respective one of image data R, G and B deal with 256 gradations of the respective one of colors which are represented by 8 bits. These image data R, G and B are respectively converted to 8-bit data R, G and B in the gamut of the printing apparatus J0013 by use of a three-dimensional LUT.

(B) Subsequent Process

On the basis of the 8-bit data R, G and B obtained by mapping the gamut, the subsequent process J0003 obtains 8-bit color separation data on each of the 10 colors. The 8-bit color separation data correspond to a combination of inks which are used for reproducing a color represented by the 8-bit data R, G and B. In other words, the subsequent process J0003 obtains color separation data on each of Y, M, Lm, C, Lc, K1, K2, R, G, and Gray. In this embodiment, like the precedent process, the subsequent process is carried out by using the three dimensional LUT, simultaneously using an interpolating operation.

(C) γ Correction Process

The γ correction J0004 converts the color separation data on each of the 10 colors which have been obtained by the subsequent process J0003 to a tone value (gradation value) representing the color. Specifically, a one-dimensional LUT corresponding to the gradation characteristic of each of the color inks in the printing apparatus J0013 is used, and thereby a conversion is carried so that the color separation data on the 10 colors can be linearly associated with the gradation characteristics of the printer.

(D) Half-Toning Process

The half-toning process J0005 quantizes the 8-bit color separation data on each of Y, M, Lm, C, Lc, K1, K2, R, G and Gray to which the γ correction process has been applied so as to convert the 8-bit separation data to 4-bit data. In this embodiment, the 8-bit data dealing with the 256 gradations of each of the 10 colors are converted to 4-bit data dealing with 9 gradations by use of the error diffusion method. The 4-bit data are data which serve as indices each for indicating a dot arrangement pattern in a dot arrangement patterning process in the printing apparatus.

(E) Print Data Creation Process

The last process performed by the printer driver is the print data creation process J0006. This process adds information on print control to data on an image to be printed whose contents are the 4-bit index data, and thus creates print data.

Figure 2:
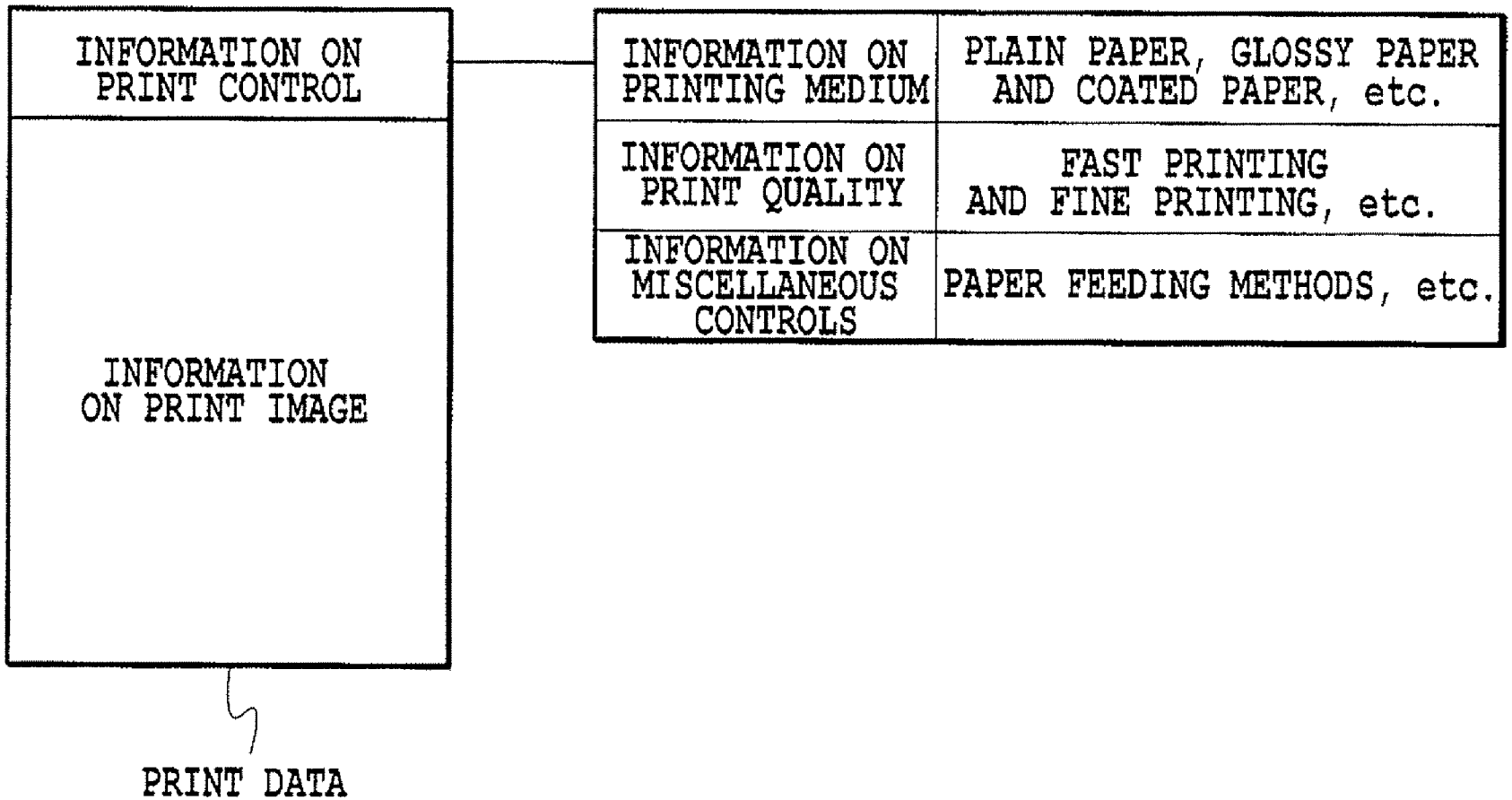
FIG. 2 is an explanatory diagram showing an example of a configuration of print data transferred from a printer driver of a host apparatus to a printing apparatus in the printing system shown in FIG. 1.

FIG. 2 is a diagram showing an example of a configuration of the print data. The print data are configured of the information on print control and the data on an image to be printed. The information on print control is in charge of controlling a printing operation. The data on an image to be printed indicates an image to be printed (the data are the foregoing 4-bit index data). The information on print control is configured of "information on printing media," "information on print qualities," and "information on miscellaneous controls" including information on paper feeding methods or the like. Types of printing media on which to make a print are described in the information on printing media. One type of printing medium selected out of a group of plain paper, glossy paper, a post card, a printable disc and the like is specified in the information on printing media. Print qualities to be sought are described in the information on print qualities. One type of print quality selected out of a group of "fine (high-quality print)," "normal," "fast (high-speed print)" and the like is specified in the information on print qualities. Note that these pieces of information on print control are formed on the basis of contents which a user designates through the UI screen in the monitor of the host apparatus J0012. In addition, image data originated in the half-toning process J0005 are described in the data on an image to be printed. The print data thus generated are supplied to the printing apparatus J0013.

The printing apparatus J0013 performs a dot arrangement patterning process J0007 and a mask data converting process J0008 on the print data which have been supplied from the host apparatus J0012. Descriptions will be provided next for the dot arrangement patterning process J0007 and the mask data converting process J0008.

(F) Dot Arrangement Patterning Process

In the above-described half-toning process J0005, the number of gradation levels is reduced from the 256 tone values dealt with by multi-valued tone information (8-bit data) to the 9 tone values dealt with by information (4-bit data). However, data with which the printing apparatus J0013 is actually capable of making a print are binary data (1-bit) data on whether or not an ink dot should be printed. Taken this into consideration, the dot arrangement patterning process J0007 assigns a dot arrangement pattern to each pixel represented by 4-bit data dealing with gradation levels 0 to 8 which are an outputted value from the half-toning process J0005. The dot arrangement pattern corresponds to the tone value (one of the levels 0 to 8) of the pixel. Thereby, whether or not an ink dot should be printed (whether a dot should be on or off) is defined for each of a plurality of areas in each pixel. Thus, 1-bit binary data indicating "1 (one)" or "0 (zero)" are assigned to each of the areas of the pixel. In this respect, "1 (one)" is binary data indicating that a dot should be printed. "0 (zero)" is binary data indicating that a dot should not be printed.

Figure 3:
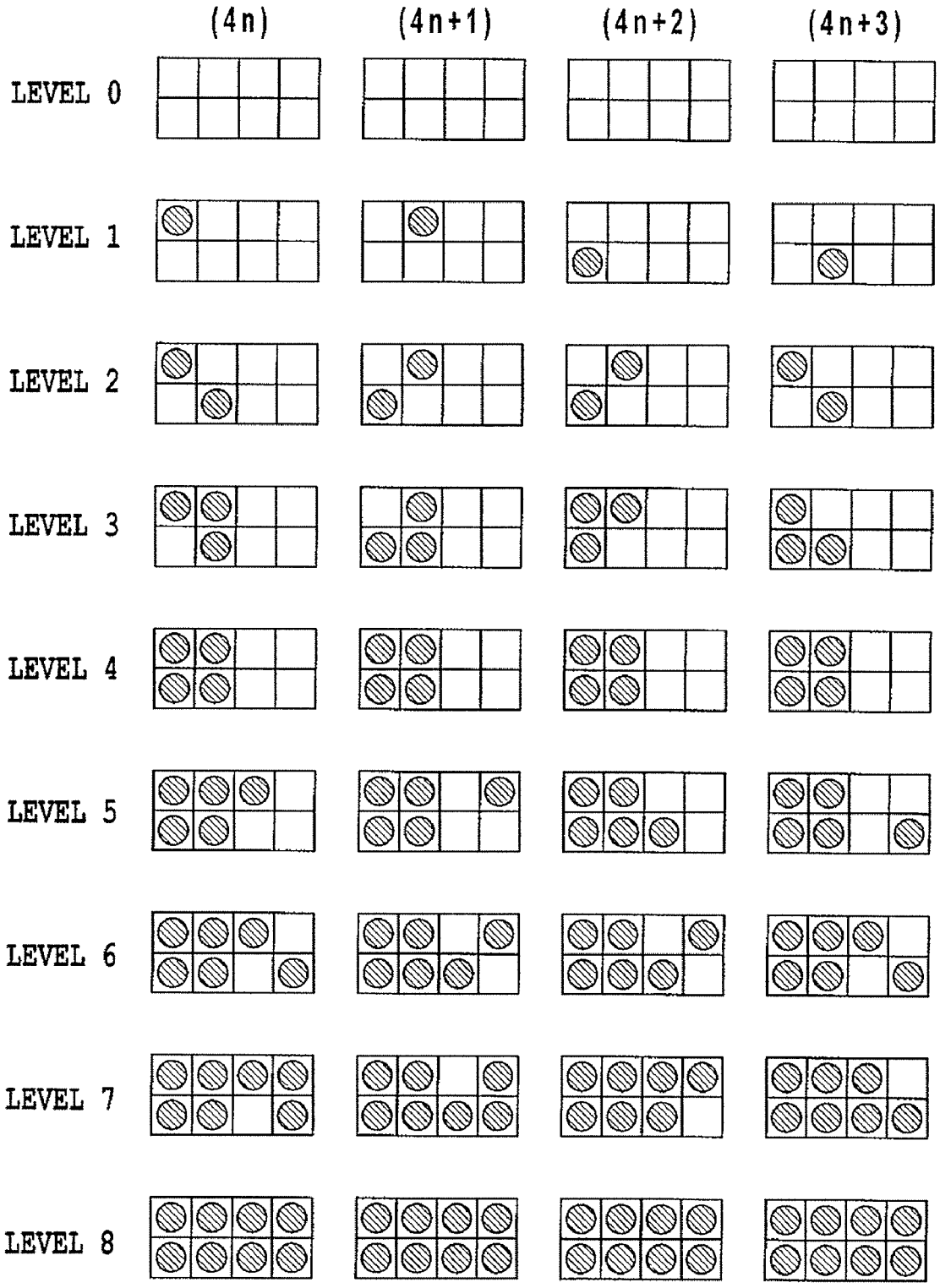
FIG. 3 is a diagram showing output patterns which correspond to input levels, and which are obtained by conversion in a dot arrangement patterning process in the printing apparatus used in the embodiment.

FIG. 3 shows output patterns corresponding to input levels 0 to 8. These output patterns are obtained through the conversion performed in the dot arrangement patterning process of the embodiment. Level numbers in the left column in the diagram correspond respectively to the levels 0 to 8 which are the outputted values from the half-toning process in the host apparatus. Regions each configured of 2 vertical areas ×4 horizontal areas are shown to the right of this column. Each of the regions corresponds to a region occupied by one pixel receiving an output from the half-toning process. In addition, each of the areas in one pixel corresponds to a minimum unit for which it is specified whether the dot thereof should be on or off. Note that, in this description, a "pixel" means a minimum unit which is capable of representing a gradation, and also means a minimum unit to which the image processes (the precedent process, the subsequent process, the γ correction process, the half-toning process and the like) are applied using multi-valued data represented by the plurality of bits.

In this figure, an area in which a circle is drawn denotes an area where a dot is printed. As the level number increases, the number of dots to be printed increases one-by-one. In this embodiment, information on density of an original image is finally reflected in this manner.

From the left to the right, (4*n*) to (4*n*+3) denotes horizontal positions of pixels, each of which receives data on an image to be printed. An integer not smaller than 1 (one) is substituted for n in the expression (4*n*) to (4*n*+3). The patterns listed under the expression indicate that a plurality of mutually-different patterns are available depending on a position where a pixel is located even though the pixel receives an input at the same level. In other words, the configuration is that, even in a case where a pixel receives an input at one level, the four types of dot arrangement patterns under the expression (4*n*) to (4*n*+3) at the same level are assigned to the pixel in an alternating manner.

In FIG. 3, the vertical direction is a direction in which the ejection openings of the printing head are arrayed, and the horizontal direction is a direction in which the printing head moves. The configuration enabling a print to be made using the plurality of different dot arrangement patterns for one level brings about the following two effects. First, the number of times that ejection is performed can be equalized between two nozzles in which one nozzle is in charge of the patterns located in the upper row of the dot arrangement patterns at one level, and the other nozzle is in charge of the patterns located in the lower row of the dot arrangement patterns at the same level. Secondly, various noises unique to the printing apparatus can be disgregated.

When the above-described dot arrangement patterning process is completed, the assignment of dot arrangement patterns to the entire printing medium is completed.

(G) Mask Data Converting Process

In the foregoing dot arrangement patterning process J0007, whether or not a dot should be printed is determined for each of the areas on the printing medium. As a result, if binary data indicating the dot arrangement are inputted to a drive circuit J0009 of the printing head H1001, a desired image can be printed. In this case, what is termed as a one-pass print can be made. The one-pass print means that a print to be made for a single scan region on a printing medium is completed by the printing head H1001 moving once. Alternatively, what is termed as a multi-pass print can be made. The multi-pass print means that a print to be made for a single scan region on the printing medium is completed by the printing head moving a plurality of times. Here, descriptions will be provided for a mask data converting process, taking an example of the multi-pass print.

Figure 4:
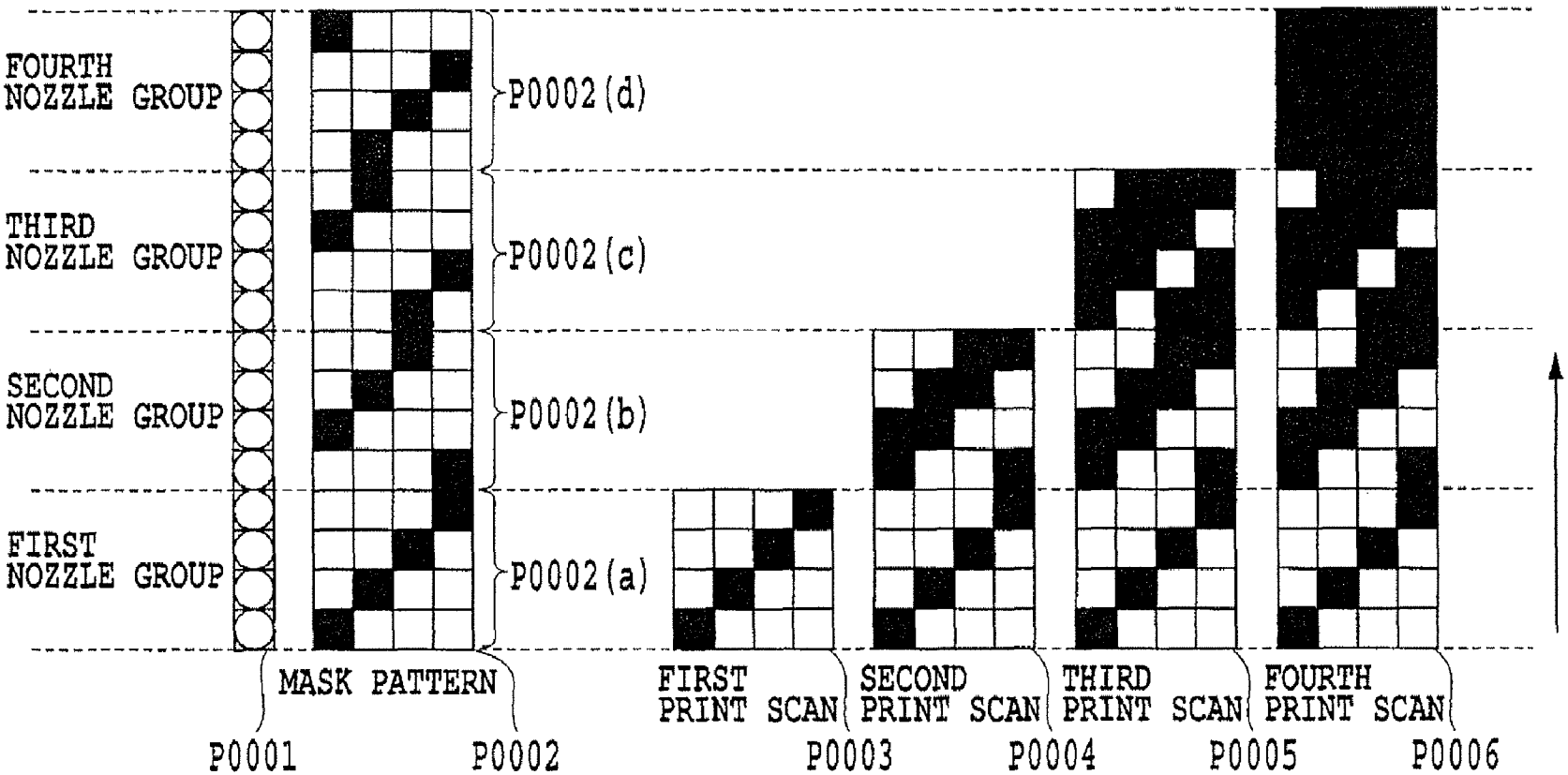
FIG. 4 is a schematic diagram for explaining a multi-pass printing method which is performed by the printing apparatus used in the embodiment.

FIG. 4 is a schematic diagram showing the printing head and print patterns for the purpose of describing the multi-pass printing method. The print head H1001 applied to this embodiment actually has 768 nozzles. For the sake of convenience, however, descriptions will be provided for the printing head and the print patterns, supposing that the printing head H1001 has 16 nozzles. The nozzles are divided into a first to a fourth nozzle groups. Each of the four nozzle groups includes four nozzles. Mask P0002 are configured of a first to a fourth mask patterns P0002(*a*) to P0002(*d*). The first to the fourth mask patterns P0002(*a*) to P0002(*d*) define the respective areas in which the first to the fourth nozzle groups are capable of making a print. Blackened areas in the mask patterns indicate printable areas, whereas whitened areas in the mask patterns indicate unprinted areas. The first to the fourth mask patterns are complementary to one another. The configuration is that, when these four mask patterns are superposed over one another, a print to be made in a region corresponding to a 4×4 area is completed.

Patterns denoted by reference numerals P0003 to P0006 show how an image is going to be completed by repeating a print scan. Each time a print scan is completed, the printing medium is transferred by a width of the nozzle group (a width of four nozzles in this figure) in a direction indicated by an arrow in the figure. In other words, the configuration is that an image in any same region (a region corresponding to the width of each nozzle region) on the printing medium is completed by repeating the print scan four times. Formation of an image in any same region on the printing medium by use of multiple nozzle groups by repeating the scan the plurality of times in the afore-mentioned manner makes it possible to bring about an effect of reducing variations characteristic of the nozzles, and an effect of reducing variations in accuracy in transferring the printing medium.

Figure 5:
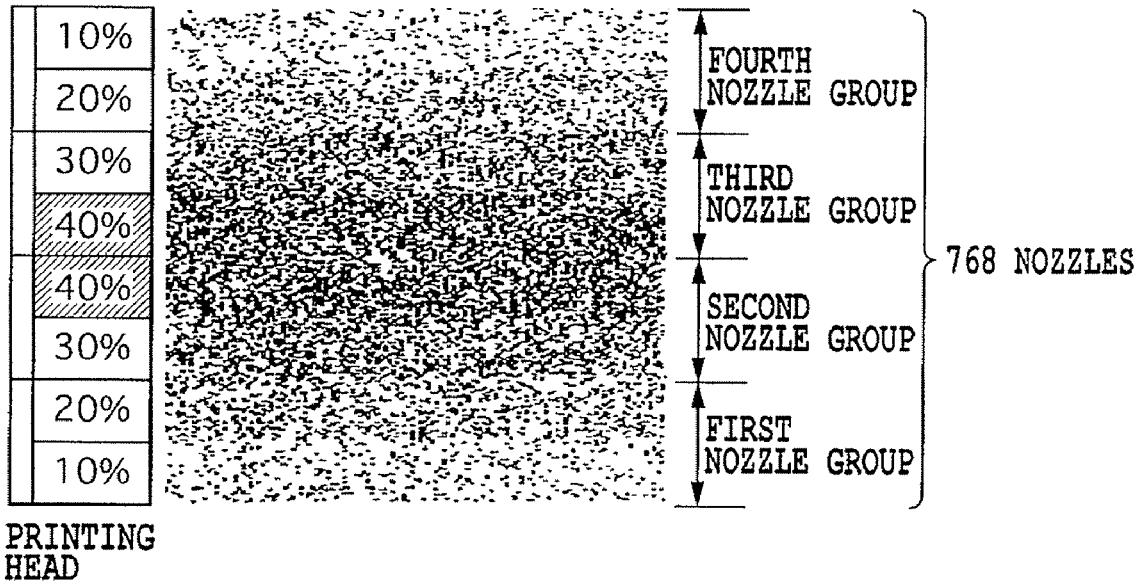
FIG. 5 is an explanatory diagram showing an example of mask patterns which are applied to the multi-pass printing method which is performed by the printing apparatus used in the embodiment.

FIG. 5 shows an example of mask which is capable of being actually applied to this embodiment. The printing head H1001 to which this embodiment is applied has 768 nozzles, and 192 nozzles belong to each of the four nozzle groups. As for the size of the mask, the mask has 768 areas in the vertical direction, and this number is equal to the number of nozzles. The mask has 256 areas in the horizontal direction. The mask has a configuration that the four mask patterns respectively corresponding to the four nozzle groups maintain a complementary relationship among themselves.

In the case of the ink jet printing head applied to this embodiment, which ejects a large number of fine ink droplets by means of a high frequency, it has been known that an air flow occurs in a neighborhood of the printing part during printing operation. In addition, it has been proven that this air flow particularly affects a direction in which ink droplets are ejected from nozzles located in the end portions of the printing head. For this reason, in the case of the mask patterns of this embodiment, a distribution of printable ratios is biased depending on which nozzle group a region belongs to, and on where a region is located in each of the nozzle groups, as seen from FIG. 5. As shown in FIG. 5, by employing the mask patterns having a configuration which makes the printable ratios of the nozzles in the end portions of the printing head smaller than those of nozzles in a central portion thereof, it is possible to make inconspicuous an adverse effect stemming from variations in positions where ink droplets ejected from the nozzles in the end portions of the printing head are landed.

Note that a printable ratio specified by a mask pattern is as follows. A printable ratio of a mask pattern is a percentage denomination of a ratio of the number of printable areas constituting the mask pattern (blackened areas in the mask pattern P0002(*a*) to P0002(*d*) of FIG. 4) to the sum of the number of printable areas and the number of unprintable areas constituting the mask pattern (the whitened areas in the mask patterns P0002(*a*) to P0002(*d*) of FIG. 4). In other words, a printable ratio (%) of a mask pattern is expressed by $$M \div (M+N) \times 100$$

where M denotes the number of printable areas constituting the mask pattern and N denotes the number of unprintable areas constituting the mask pattern.

In this embodiment, data for the mask as shown in FIG. 5 are stored in memory in the main body of the printing apparatus. The mask data converting process J0008 performs the AND process on the mask data with the binary data obtained in the foregoing dot arrangement patterning process. Thereby, binary data to be a print object in each print scan are determined. Subsequently, the binary data are transferred to the driving circuit J0009. Thus, the printing head H1001 is driven, and hence inks are ejected in accordance with the binary data.

FIG. 1 shows that the host apparatus J0012 is configured to perform the precedent process J0002, the subsequent process J0003, the y correction process J0004, the half-toning process J0005 and the print data creation process J0006. In addition, FIG. 1 shows that the printing apparatus J0013 is designed to perform the dot arrangement patterning process J0007 and the mask data converting process J0008. However, the present invention is not limited to this embodiment. For example, the present invention may be carried out as an embodiment in which parts of the processes J0002 to J0005 are designed to be performed by the printing apparatus J0013 instead of by the host apparatus J0012. Otherwise, the present invention may be carried out as an embodiment in which all of these processes are designed to be performed by the host apparatus J0012. Alternately, the present invention may be carried out as an embodiment in which the processes J0002 to J0008 are designed to be performed by the printing apparatus J0013.

1.2 Configuration of Mechanisms

Descriptions will be provided for a configuration of the mechanisms in the printing apparatus to which this embodiment is applied. The main body of the printing apparatus of this embodiment is divided into a paper feeding section, a paper conveying section, a paper discharging section, a carriage section, a flat-pass printing section and a cleaning section from a viewpoint of functions performed by the mechanisms. These mechanisms are contained in an outer case.

Figure 6:
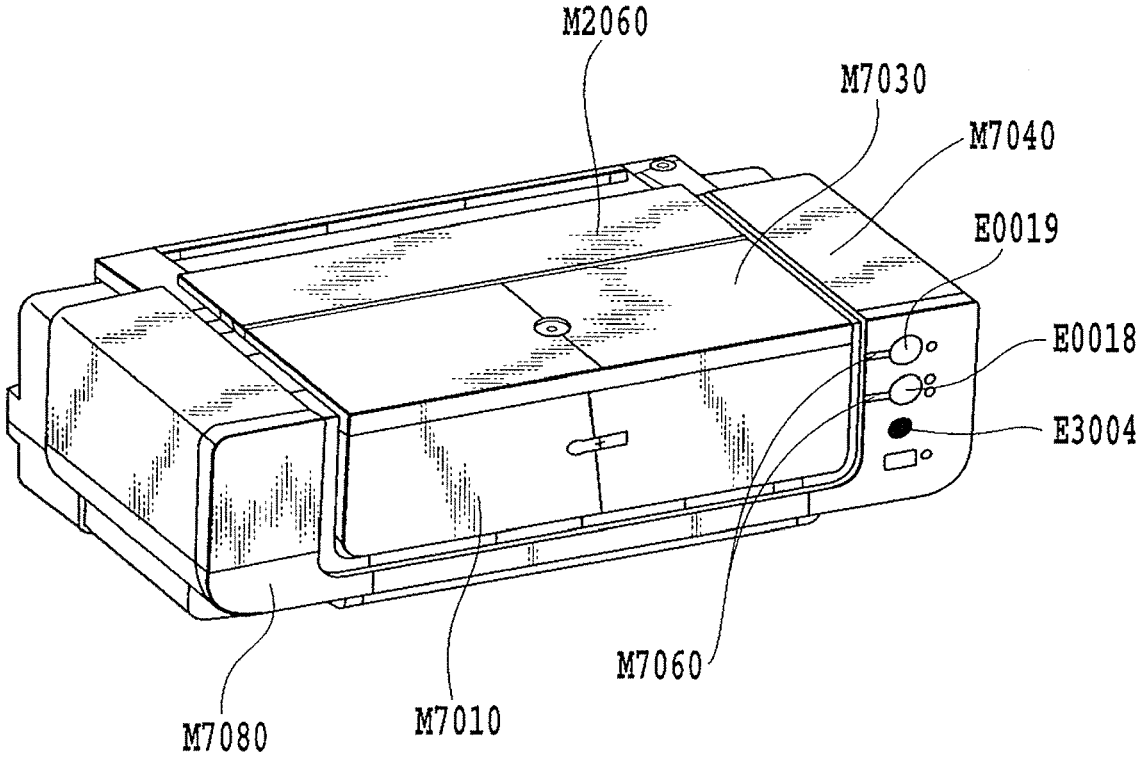
FIG. 6 is a perspective view of the printing apparatus used in the embodiment, and shows the printing apparatus in an unused condition when viewed from the front.
Figure 7:
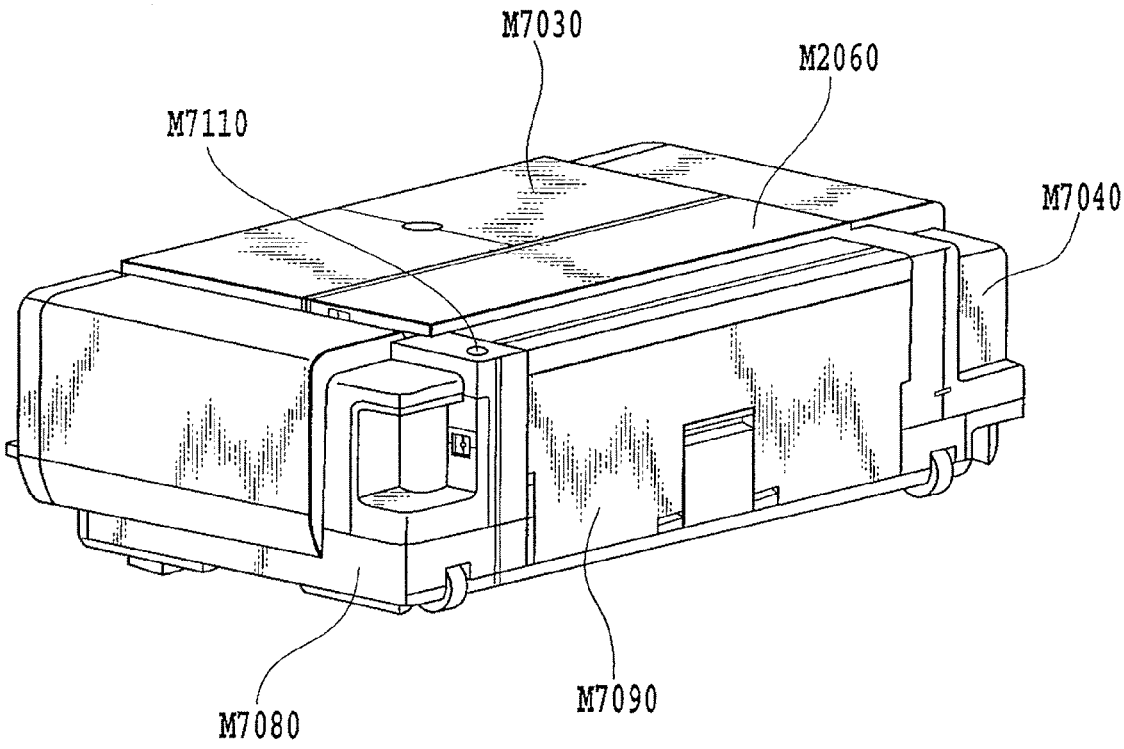
FIG. 7 is another perspective view of the printing apparatus used in the embodiment, and shows the printing apparatus in the unused condition when viewed from the back.
Figure 8:
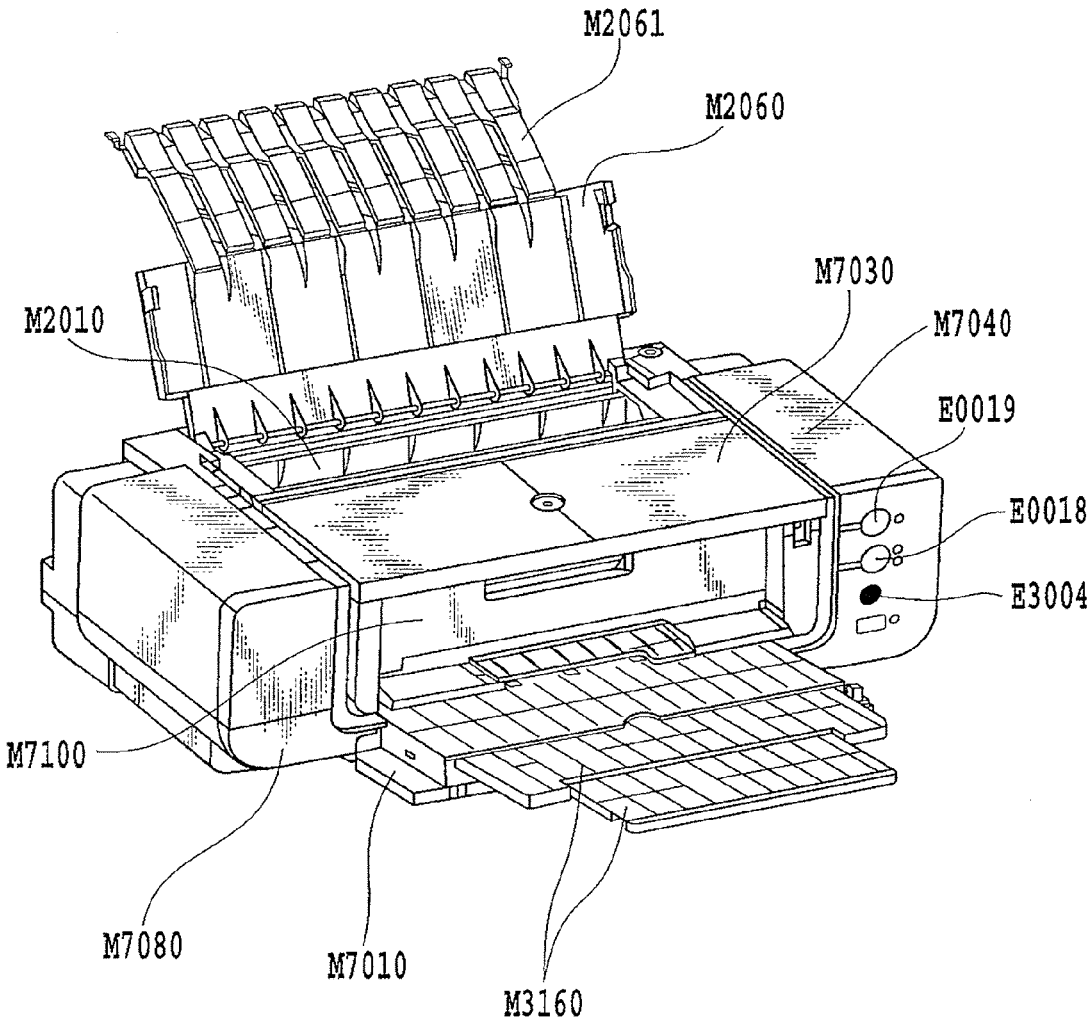
FIG. 8 is yet another perspective view of the printing apparatus used in the embodiment, and shows the printing apparatus in a used condition when viewed from the front.
Figure 9:
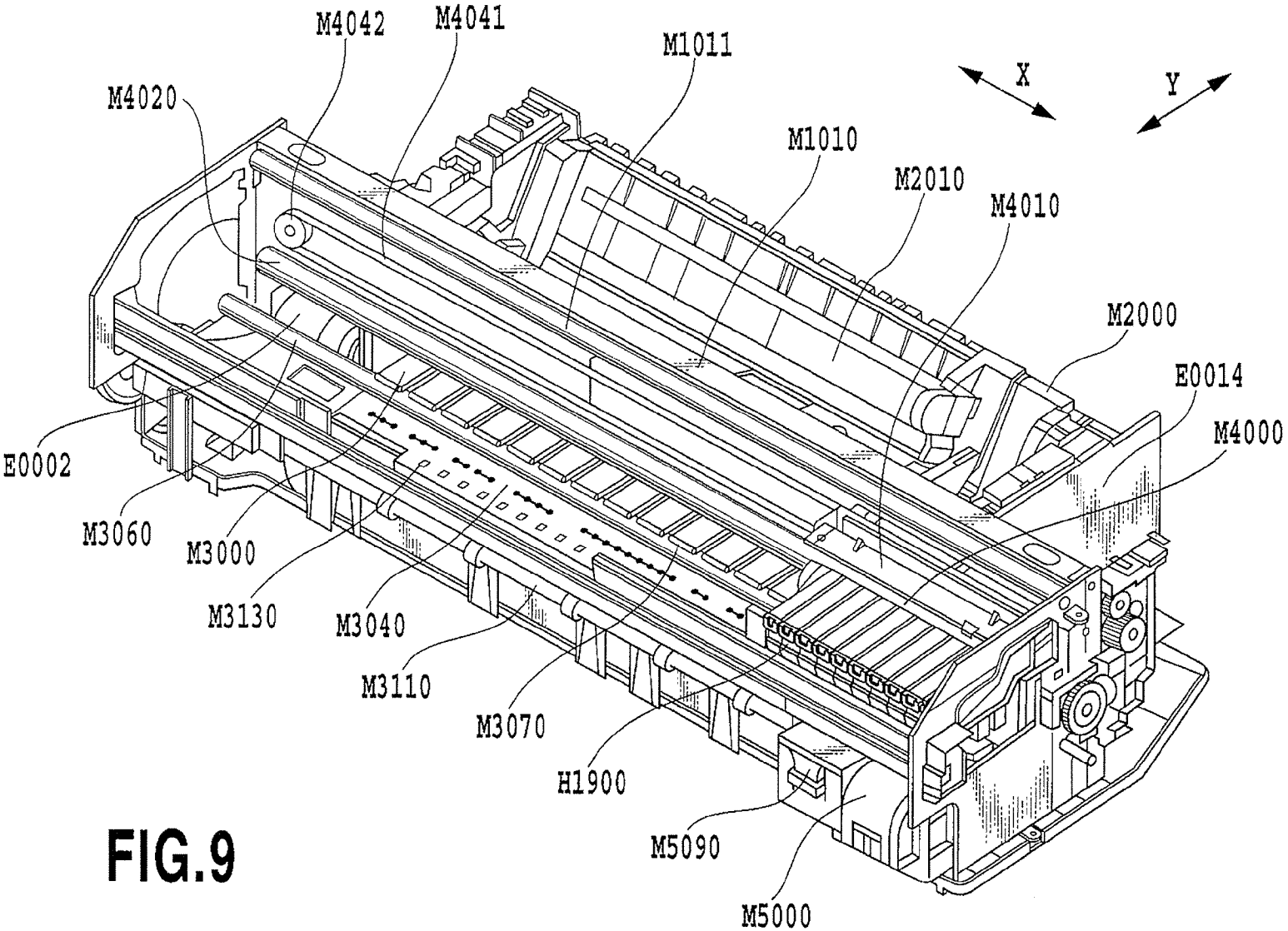
FIG. 9 is a diagram for explaining an internal mechanism of the main body of the printing apparatus used in the embodiment, and is a perspective view showing the printing apparatus when viewed from the right above.
Figure 10:
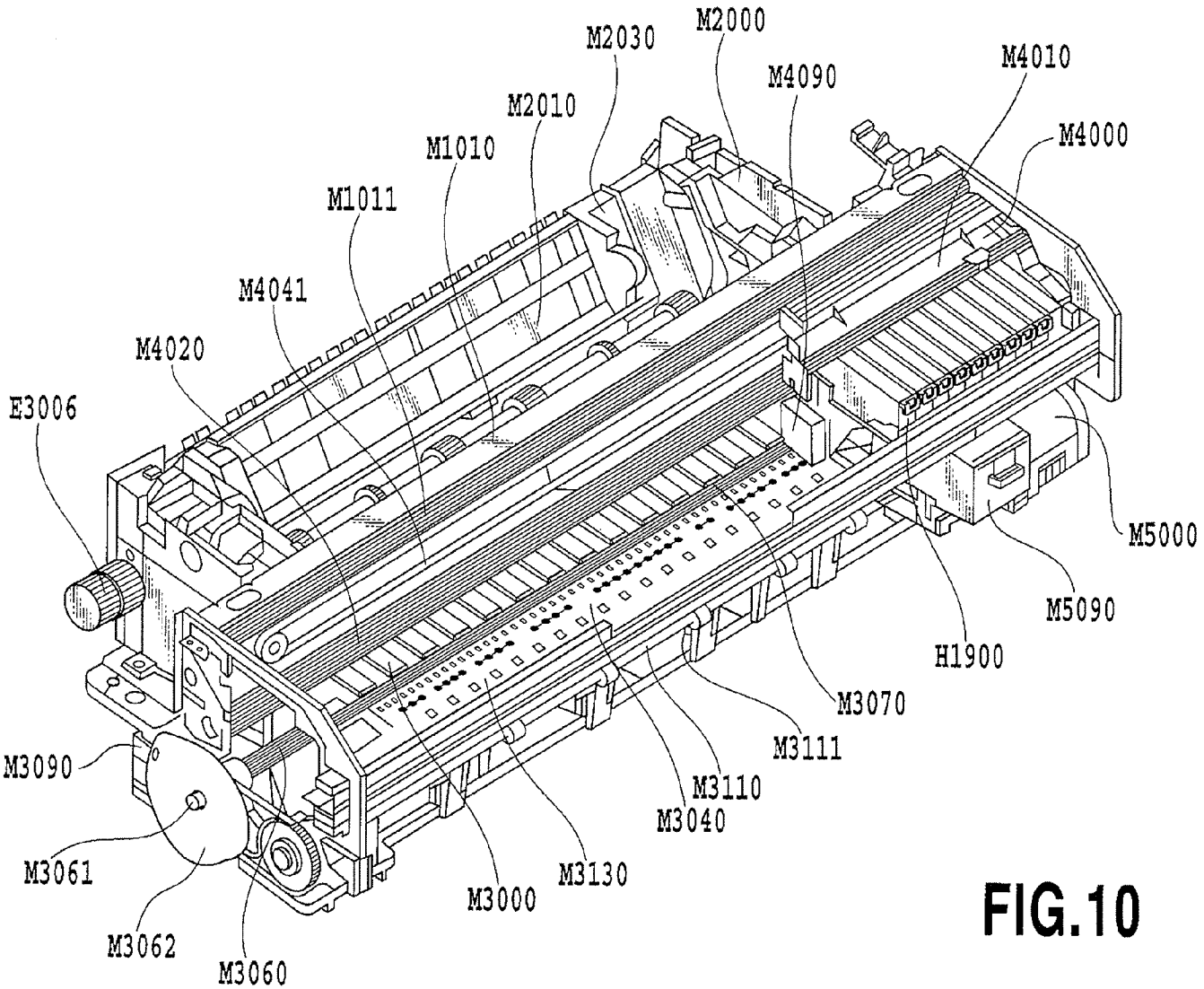
FIG. 10 is another diagram for explaining the internal mechanism of the main body of the printing apparatus used in the embodiment, and is another perspective view showing the printing apparatus when viewed from the left above.
Figure 11:
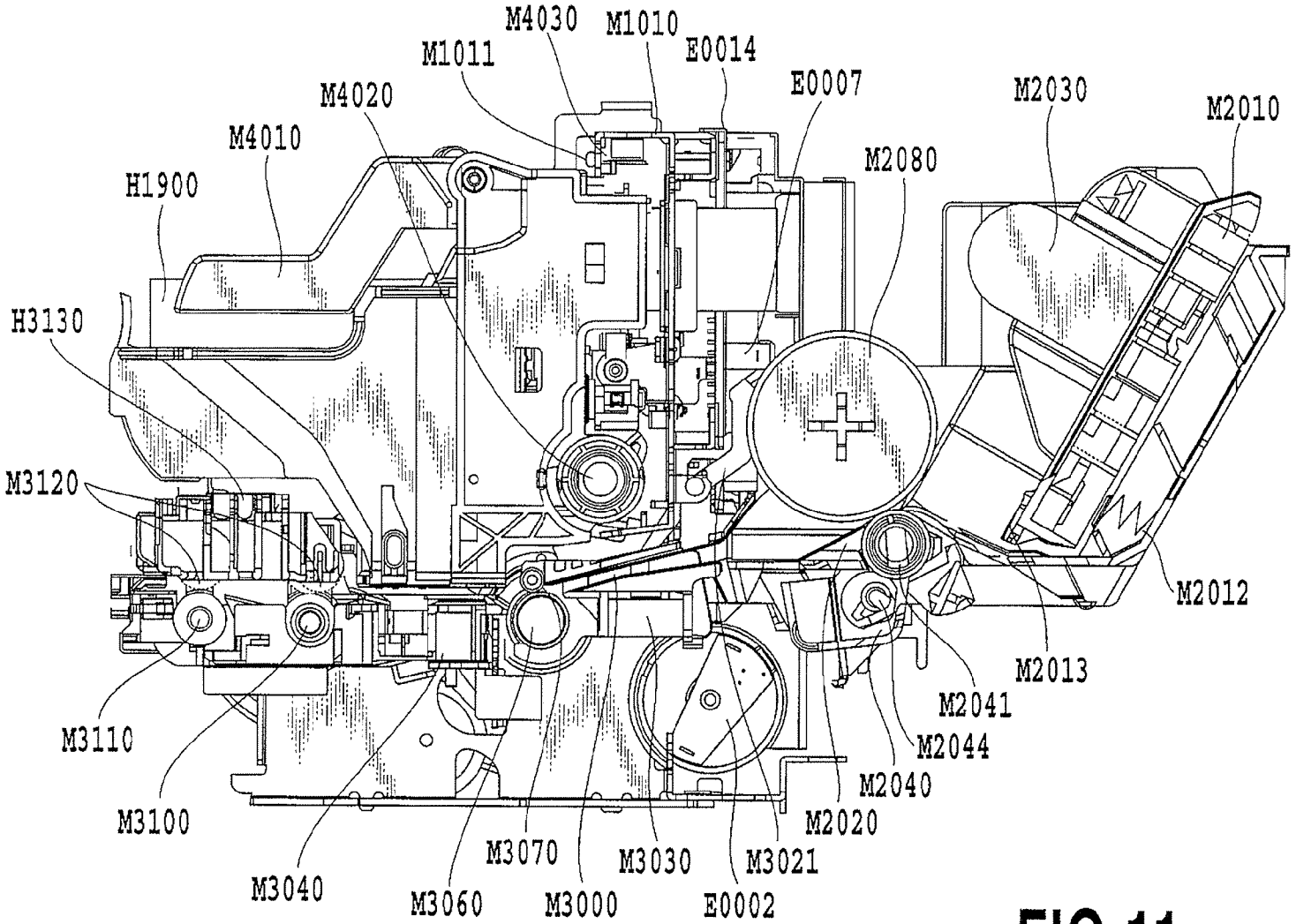
FIG. 11 is a side, cross-sectional view of the main body of the printing apparatus used in the embodiment for the purpose of explaining the internal mechanism of the main body of the printing apparatus.
Figure 12:
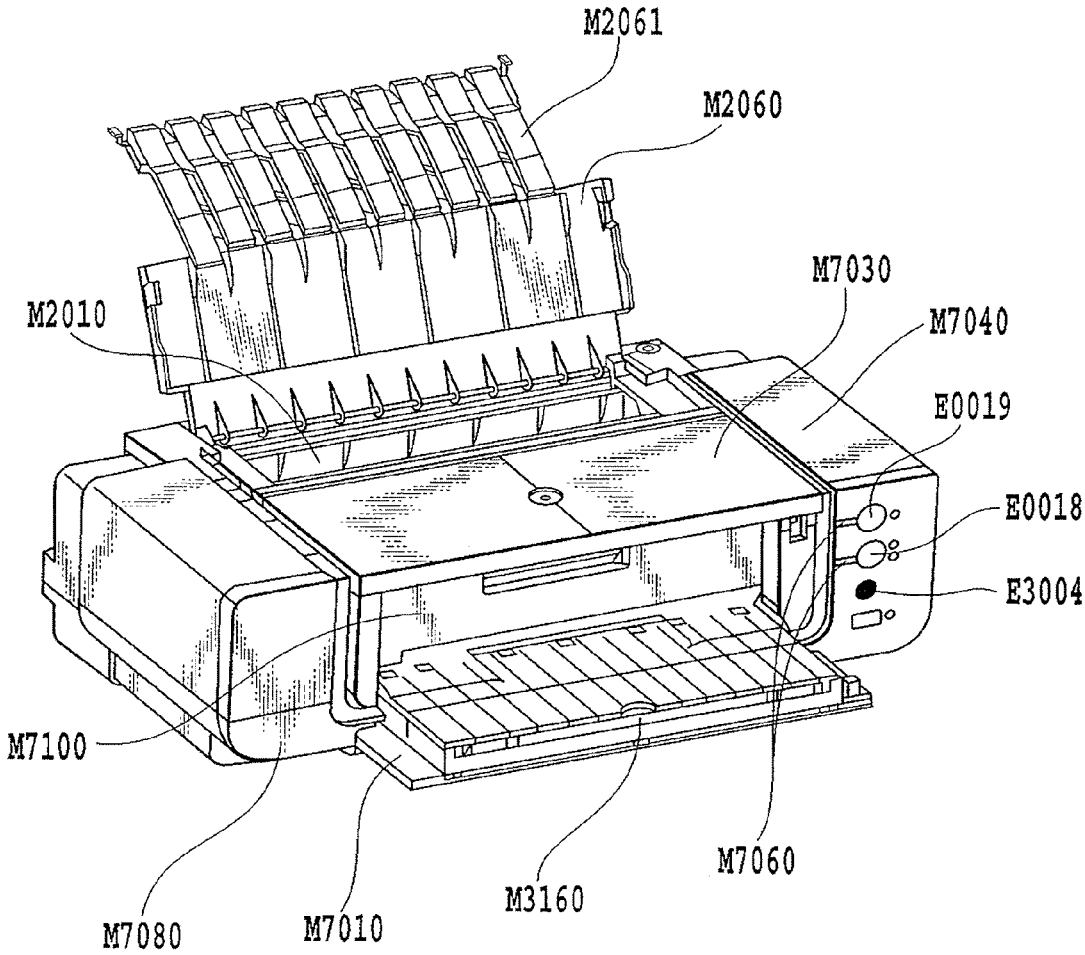
FIG. 12 is yet another perspective view of the printing apparatus used in the embodiment, and shows the printing apparatus in the process of performing a flat-pass printing operation when viewed from the front.
Figure 13:
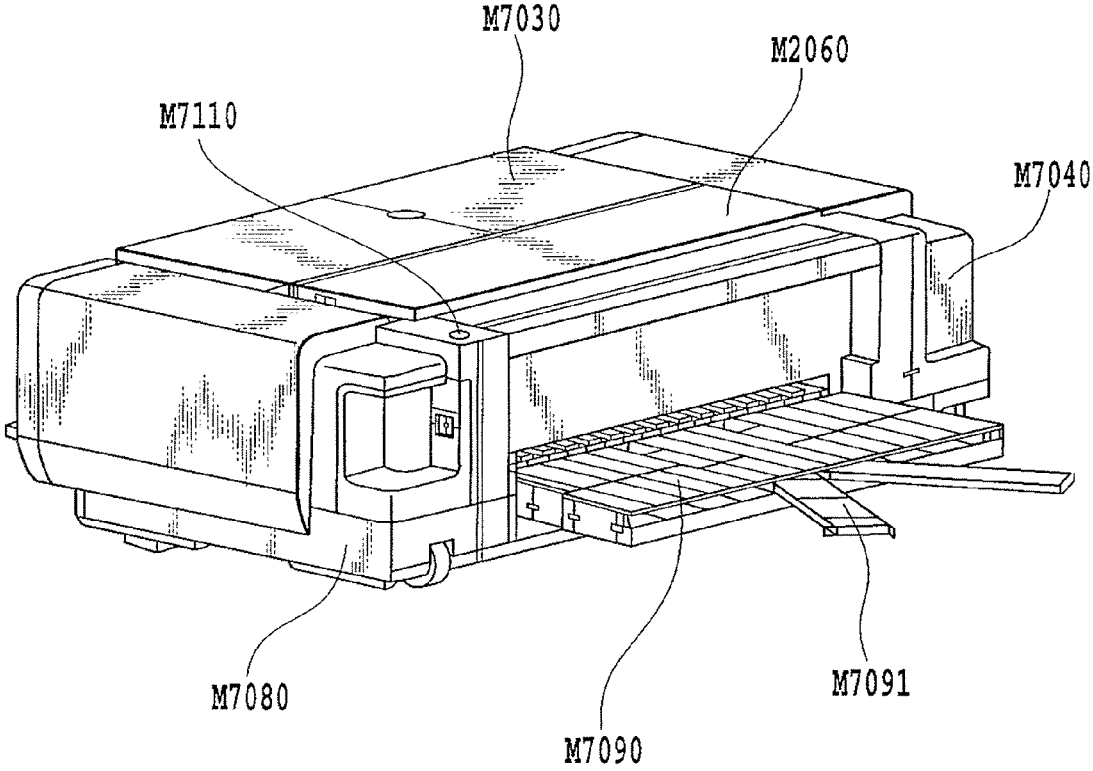
FIG. 13 is still another perspective view of the printing apparatus used in the embodiment, and shows the printing apparatus in the process of performing the flat-pass printing operation when viewed from the back.
Figure 14:
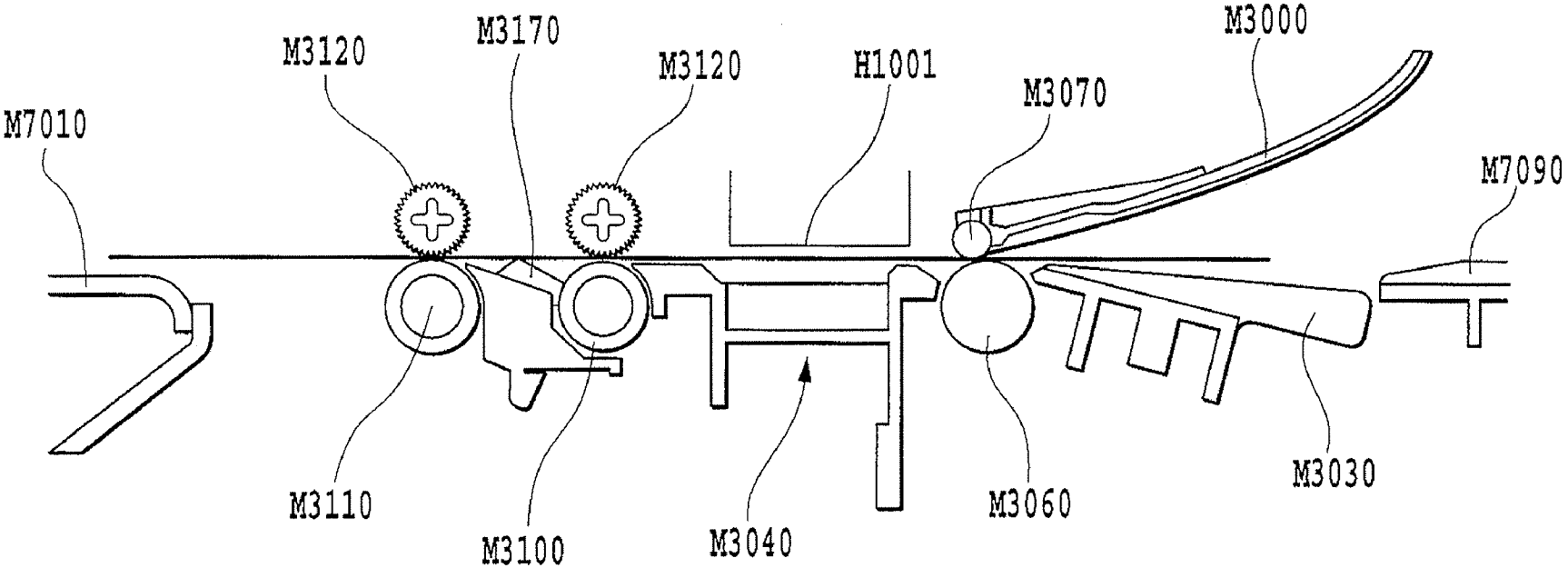
FIG. 14 is a schematic, side, cross-sectional view of the internal mechanism for explaining the flat-pass printing operation performed in the embodiment.
Figure 15:
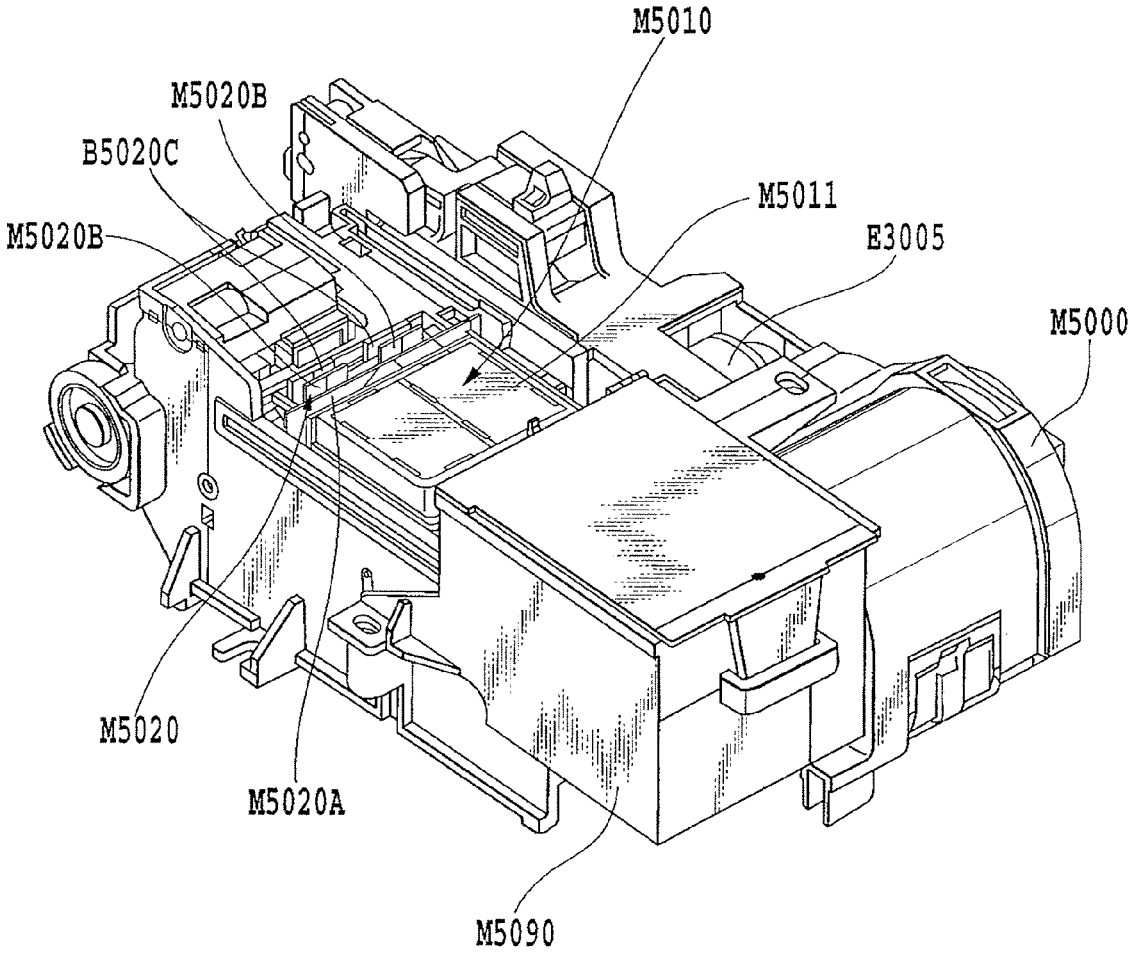
FIG. 15 is a perspective view showing a cleaning section in the main body of the printing apparatus used in the embodiment.
Figure 16:
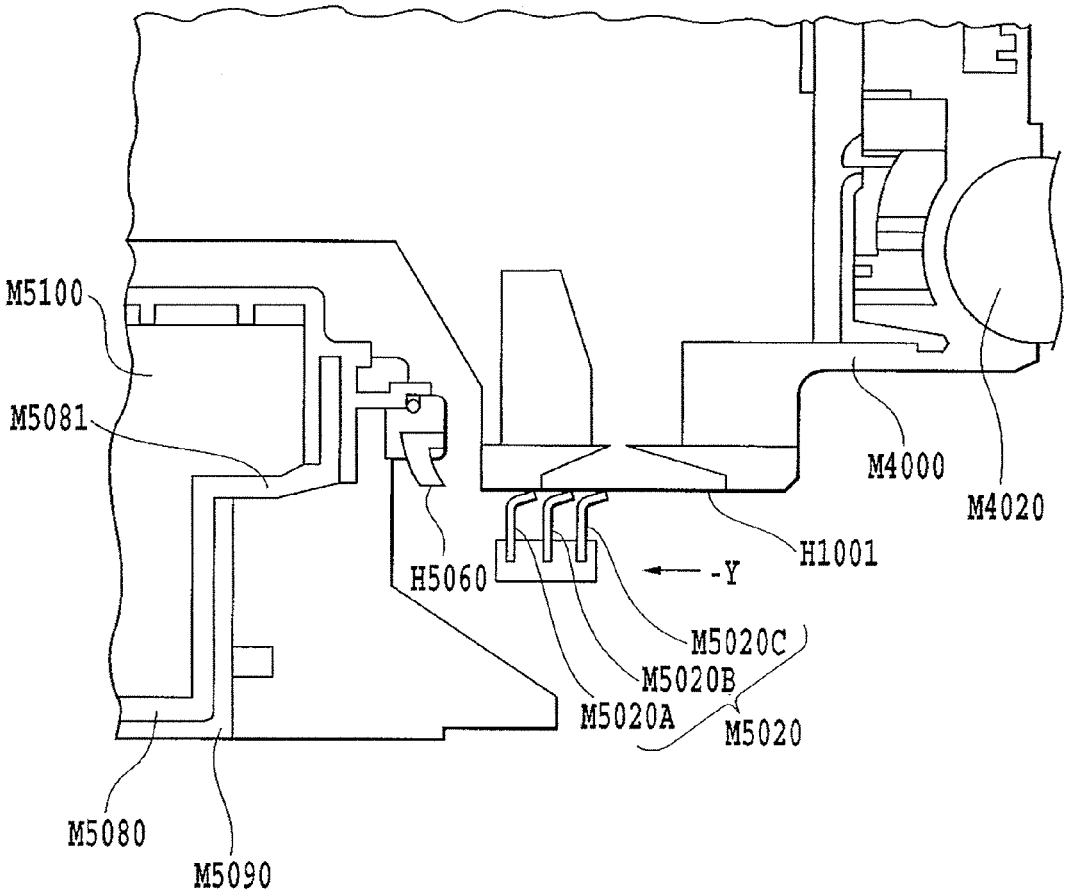
FIG. 16 is a cross-sectional view of a wiper portion in the cleaning section shown in FIG. 15 for explaining a configuration and an operation of the wiper portion.
Figure 17:
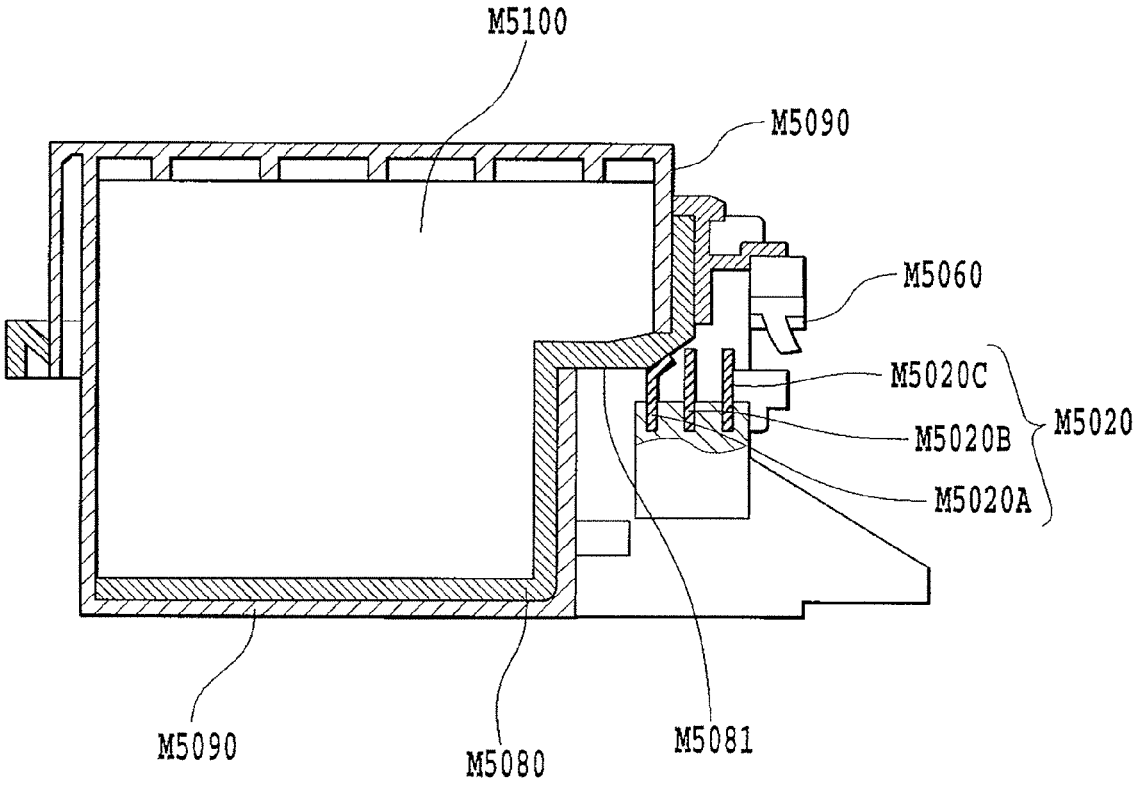
FIG. 17 is a cross-sectional view of a wetting liquid transferring unit in the cleaning section for explaining a configuration and an operation of the wetting liquid transferring unit.

FIGS. 6, 7, 8, 12 and 13 are perspective views respectively showing appearances of the printing apparatus to which this embodiment is applied. FIG. 6 shows the printing apparatus in an unused condition when viewed from the front. FIG. 7 shows the printing apparatus in an unused condition when viewed from the back. FIG. 8 shows the printing apparatus in a used condition when viewed from the front. FIG. 12 shows the printing apparatus during flat-pass printing when viewed from the front. FIG. 13 shows the printing apparatus during flat-pass printing when viewed from the back. In addition, FIGS. 9 to 11 and 14 to 16 are diagrams for describing internal mechanisms in the main body of the printing apparatus. In this respect, FIG. 9 is a perspective view showing the printing apparatus when viewed from the right above. FIG. 10 is a perspective view showing the printing apparatus when viewed from the left above. FIG. 11 is a side, cross-sectional view of the main body of the printing apparatus. FIG. 14 is a cross-sectional view of the printing apparatus during flat-pass printing. FIG. 15 is a perspective view of the cleaning section. FIG. 16 is a cross-sectional view for describing a configuration and an operation of a wiping mechanism in the cleaning section. FIG. 17 is a cross-sectional view of a wetting liquid transferring unit in the cleaning section.

Descriptions will be provided for each of the sections by referring to these figures whenever deemed necessary.

(A) Outer Case (Refer to FIGS. 6 and 7)

The outer case is attached to the main body of the printing apparatus in order to cover the paper feeding section, the paper conveying section, the paper discharging section, the carriage section, the cleaning section, the flat-pass section and the wetting liquid transferring unit. The outer case is configured chiefly of a lower case M7080, an upper case M7040, an access cover M7030, a connector cover, and a front cover M7010.

Paper discharging tray rails (not illustrated) are provided under the lower case M7080, and thus the lower case M7080 has a configuration in which a divided paper discharging tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (refer to FIG. 21) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multi-stage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

(B) Paper Feeding Section (Refer to FIGS. 8 and 11)

As shown in FIGS. 8 and 11, the paper feeding section is configured as follows. A pressure plate M2010, a paper feeding roller M2080, a separation roller M2041, a return lever M2020 and the like are attached to a base M2000. The pressure plate M2010 is that on which printing media are stacked. The paper feeding roller M2080 feeds the printing media sheet by sheet. The separation roller M2041 separates a printing medium. The return lever M2020 is used for returning the printing medium to a stacking position.

(C) Paper Conveying Section (Refer to FIGS. 8 to 11)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch roller M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 21) is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(D) Paper Discharging Section (Refer to FIGS. 8 to 11)

The paper discharging section is configured of a first eject roller M3100, a second eject roller M3110, a plurality of spurs M3120 and a gear train.

The first eject roller M3100 is configured of a plurality of rubber portions provided around the metal shaft thereof. The first eject roller M3100 is driven by transmitting the driving force of the conveying roller M3060 to the first eject roller M3100 through an idler gear.

The second eject roller M3110 is configured of a plurality of elastic elements M3111, which are made of elastomer, attached to the resin-made shaft thereof. The second eject roller M3110 is driven by transmitting the driving force of the first eject roller M3100 to the second eject roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the eject rollers M3100 and M3110 at predetermined pressures. This configuration enables the spurs 3120 to rotate to follow the two eject rollers M3100 and M3110. Some of the spurs M3120 are provided at the same positions as corresponding ones of the rubber portions of the first eject roller M3110 are disposed, or at the same positions as corresponding ones of the elastic elements M3111 are disposed. These spurs chiefly generates a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the eject rollers M3100 and M3110.

With the foregoing configuration, a printing medium on which an image is formed is pinched with nips between the first eject roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing media, and prevents the printing surface of each of the printing media from being rubbed.

(E) Carriage Section (Refer to FIGS. 9 to 11)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 18). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 18). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 18). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium.

(F) Flat-Pass Printing Section (Refer to FIGS. 12 to 14)

A printing medium is fed from the paper feed section in a state where the printing medium is bent, because the passage through which the printing medium passes continues curving up to the pinch rollers as shown in FIG. 11. For this reason, if a thicker printing medium with a thickness of approximately 0.5 mm or more, for example, is attempted to be fed from the paper feeding section, a reaction force of the bent printing medium occurs, and thus resistance to the paper feeding increases. As a result, it is likely that the printing medium cannot be fed. Otherwise, even if the printing medium can be fed, the delivered printing medium remains bent, or is folded.

A flat-pass print is made on printing media, such as thicker printing media, which a user does not wish to fold, and on printing media, such as CD-Rs, which cannot be bent.

Types of flat-pass prints include a type of print made by manually supplying a printing medium from a slit-shaped opening portion (under a paper feeding unit) in the back of the main body of a printing apparatus, and by thus causing pinch rollers of the main body to nip the printing medium. However, the flat-pass print of this embodiment employs the following mode. A printing medium is fed from the paper discharging port located in the front side of the main body of the printing apparatus to a position where a print is going to be made, and the print is made on the printing medium by switching back the printing medium.

The front cover M7010 is usually located below the paper discharging section, because the front cover M7010 is also used as a tray in which several tens of printing media on which prints have been made are stacked (refer to FIG. 8). When a flat-pass print is going to be made, the front tray M7010 is elevated up to a position where the paper discharging port is located (refer to FIG. 12) for the purpose of supplying a printing medium from the paper discharging port horizontally in a direction reverse to the direction in which a printing medium is usually conveyed. Hooks and the like (not illustrated) are provided to the front cover M7010. Thus, the front cover M7010 is capable of being fixed to a position where the printing medium is supplied for the purpose of the flat-pass print. It can be detected by a sensor whether or not the front cover M7010 is located at the position where the printing medium is supplied for the purpose of the flat-pass print. Depending on this detection, it can be determined whether the printing apparatus is in a flat-pass printing mode.

In the case of the flat-pass printing mode, first of all, a flat-pass key E3004 is operated for the purpose of placing a printing medium on the front tray M7010 and inserting the printing medium from the paper discharging port. Thereby, a mechanism (not illustrated) lifts the spur holder M3130 and the pinch roller holder M3000 respectively up to positions higher than a presumed thickness of the printing medium. In addition, in a case where the carriage M4000 exists in an area through which the printing medium is going to pass, a lifting mechanism (not illustrated) lifts the carriage M4000 up. This makes it easy to insert the printing medium therein. Moreover, by pressing a rear tray button M7110, a rear tray M7090 can be opened. Furthermore, a rear sub-tray M7091 can be opened in the form of the letter V (refer to FIG. 13). The rear tray M7090 and the rear sub-tray M7091 are trays with which a long printing medium is supported in the back of the main body of the printing apparatus. This is because, if the long printing medium is inserted from the front of the main body of the printing apparatus, the long printing medium juts out of the back of the main body of the printing apparatus. If a thicker printing medium is not kept flat while a print is being made on the thicker printing medium, the thicker printing medium may be rubbed against the head ejection face, or the conveyance load may change. This is likely to adversely affect the print quality. For this reason, the disposition of these trays is effective. However, if a printing medium is not long enough to jut out of the back of the main body of the printing apparatus, the rear tray M7090 and the like need not be opened.

In the foregoing manner, a printing medium can be inserted from the paper discharging port to the inside of the main body of the printing apparatus. A printing medium is positioned on the front tray M7010 by aligning the rear edge (an edge at the side located closest to a user) and the right edge of the printing medium to a position in the front tray M7010 where a marker is formed.

At this time, if the flat-pass key E3004 is operated once again, the spur holder M3130 comes down, and thus the eject rollers M3100, M3110 and the spurs M3120 jointly nip the printing medium. Thereafter, the eject rollers M3100 and M3110 draw the printing medium into the main body of the printing apparatus by a predetermined amount thereof (in a direction reverse to the direction in which the printing medium is conveyed during normal printing). Because the edge at the side closest to the user(the rear edge) of a printing medium is aligned to the marker when the printing medium is set up at the beginning, it is likely that the front edge (the edge located farthest from a user) of the printing medium may not reach the conveying roller M3060, if the printing medium is shorter. With this taken into consideration, the predetermined amount is defined as a distance between the rear edge of a printing medium with the presumably shortest length and the conveying roller M3060. Once a printing medium is transferred by the predetermined amount, the rear edge of the printing medium reaches the conveying roller M3060. Thus, the pinch roller holder M3000 is lowered at the position, and the conveying roller M3060 and the pinch rollers M3070 are caused to nip the printing medium. Subsequently, the printing medium is further transferred so that the rear edge of the printing medium is nipped by the conveying roller M3060 and the pinch rollers M3070. Thereby, the supplying of the printing medium for the purpose of the flat-pass print is completed (at a position where the printing medium waits for a print to be made thereon).

A nip force with which the eject roller M3100 and M3110 as well as the spurs M3120 nip a printing medium is set relatively weak lest the force should adversely affect image formation while the printing medium is being delivered during a normal print. For this reason, in the case where a flat-pass print is going to be made, it is likely that the position of the printing medium shifts before the print starts. In this embodiment, however, a printing medium is nipped by the conveying roller M3060 and the pinch rollers M307O which have a relatively stronger nip force. This secures a position where a printing medium should be set. In addition, while a printing medium is being conveyed into the inside of the main body by the predetermined amount, a flat-pass paper detection sensor lever (hereinafter referred to as an "FPPE sensor lever") M3170 blocks or forms a light path of an FPPE sensor E9001 which is an infrared-ray sensor, and which is not illustrated here. Thereby, the position of the rear edge (the position of the front edge during the print) of the printing medium can be detected. Incidentally, the FPPE sensor lever may be rotatably provided between the platen M3040 and the spur holder M3130.

Once a printing medium is set at the position where the printing medium waits for a print to be made thereon, a print command is executed. Specifically, the conveying roller M3060 conveys the printing medium to a position where the printing head H1001 is going to make a print on the printing medium. Thereafter, the print is made in the same manner as a normal printing operation is performed. After the print, the printing medium is discharged to the front tray M7010.

In a case where the flat-pass print is intended to be made successively, the printing medium on which the print has been made is removed from the front tray M7010, and the next printing medium is set thereon. After that, it is sufficient that the foregoing processes are repeated. Specifically, the subsequent print starts with the setting of a printing medium after the spur holder M3130 and the pinch roller holder M3000 are lifted up by pressing the flat-pass key E3004.

Meanwhile, in a case where the flat-pass printing is finished, it is made possible to return to a normal printing mode by bringing the front tray M7010 back to the normal printing position. Since the flat-pass mechanism has features of the present invention, details thereof will be described later in the section on feature configurations.

(G) Cleaning Section (Refer to FIGS. 15 and 16)

The cleaning section is a mechanism for cleaning the printing head H1001. The cleaning section is configured of a pump M5000, caps M5010, a wiper portion M5020 and the like. The caps M5010 are those which prevent the printing head H1001 from being dried out. The wiper portion M5020 is used for cleaning the surface of the printing head H1001 on which the ejection openings are formed.

Figure 18:
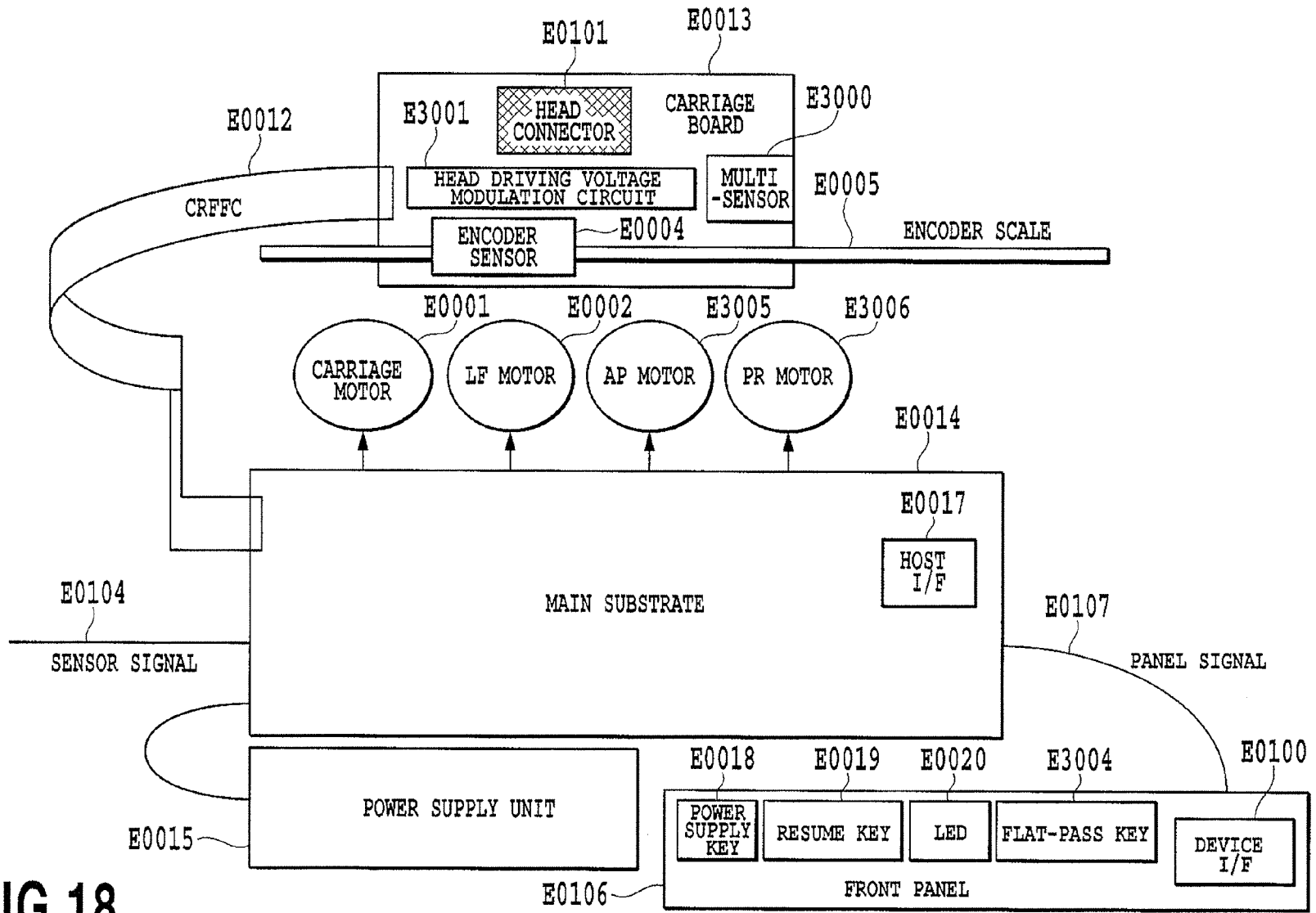
FIG. 18 is a block diagram schematically showing the entire configuration of an electrical circuit in the embodiment of the present invention.

In the case of this embodiment, a chief driving force of the cleaning section is transmitted from an AP motor E3005 (see FIG. 18). The pump M5000 is designed to be operated by rotation in one direction which is generated by means of a one-way clutch (not illustrated). The wiper portion M5020 and the caps M5010 are designed to ascend and descend by rotation in the other direction which is generated by the one-way clutch Incidentally, the AP motor E3005 is also used as a driving power supply for an operation of feeding printing medium, but a motor specialized for operating the cleaning section may be provided to the cleaning section instead.

The motor E0003 drives the caps M5010 so as for the caps M5010 to be capable of ascending and descending by means of an ascending/descending mechanism (not illustrated). When the caps M5010 go up to an ascending position, the caps M5010 cap each of the ejection faces of several ejecting portions provided to the printing head H1001. While no print operation is being performed, the caps M5010 can protect the printing head H1001. Otherwise, the caps M5010 can recover the printing head H1001 by suction. While a print operation is being performed, the caps M5010 can be placed in a descending position which prevents the caps M5010 from interfering with the printing head H1001. In addition, by opposing the caps M5010 to the ejection face, the caps M5010 are capable of receiving preliminary ejections. In a case where, for instance, the printing head H1001 is provided with ten ejecting portions, two caps M5010 are provided to the cleaning section in the illustrated example so that the ejection face corresponding to each five ejecting portions can be capped collectively by corresponding one of the two caps M5010.

A wiper portion M5020 made of an elastic member such as rubber is fixed to a wiper holder (not illustrated). The wiper holder is capable of moving in directions indicated by −Y and +Y in FIG. 16 (−Y and +Y are directions in which the ejection openings in the ejecting portions are arranged). When the printing head H1001 gets to the home position, the wiper holder moves in the direction indicated by an arrow −Y. Thereby, a surface of the printing head H1001 can be wiped. Once the wiping operation is completed, the carriage is caused to escape out of the range where the wiping operation is designed to be performed, and thus the wiper is returned to a position which prevents the wiper from interfering with the ejection face and the like. Incidentally, the wiper portion M5020 of this example is provided with a wiper blade M5020A for wiping the entire surface of the printing head H1001 including all of the ejection faces of the ejecting portions. In addition, the wiper portion M5020 is provided with the other two wiper blades M5020B and M5020C. The wiper blade M5020B wipes vicinities of nozzles for ejection faces of five of the ten ejecting portions, whereas the wiper blade M5020C wipes vicinities of nozzles for ejection faces of the other five of the ten ejecting portions.

After wiping, the wiper portion M5020 abuts on a blade cleaner M5060. Thereby, the wiper blades M5020A to M5020C are configured to be cleaned of inks and the like which have been adhered to themselves. In addition, the wiper portion M5020 has the following configuration (a wetting liquid transferring unit). A wetting liquid is transferred onto the wiper blades M5020A to M5020C before wiping. This enhances cleaning performance of the wiping operation. Descriptions will be provided later for a configuration of this wetting liquid transferring unit and the wiping operation.

The suction pump M5000 is capable of generating negative pressure in a state where an airtight space is formed inside the cap M5010 by connecting the cap M5010 to the ejection faces. Thereby, inks can be filled in the ejecting portions from the ink tanks H1900. In addition, dust, adhering matter, bubbles and the like which exist in the ejection openings and the internal ink passage leading to the ejection openings can be removed by suction.

What is used for the suction pump M5000 is, for example, a tube pump. This includes a member having a curved surface which is formed by squeezing and holding at least part of a flexible tube; a roller being capable of pressing the flexible tube towards the member; and a roller supporting part which supports the roller, and which is capable of rotating. Specifically, the roller supporting part is rotated in a predetermined direction, and thereby the roller is rolled on the member in which the curved surface has been formed, while pressing the flexible tube. In response to this, the negative pressure is generated in the airtight space formed by the cap M5010. This negative pressure sucks inks from the ejection openings, and subsequently sucks up the inks into the tube or the suction pump from the cap M5010. Thereafter, the sucked inks are further transferred to a suitable member (a waste ink absorbing member) provided inside the lower case M7080.

Note that an absorbing member M5011 is provided to the inside portion of the cap M5010 for the purpose of reducing the amount of inks remaining on the ejection faces of the printing head H1001 after the suction. In addition, consideration is made for sucking inks, which remain in the cap M5010 and the absorbing member M5011, in a state where the cap M5010 is opened, and for thus precluding the ink residue from coagulating and for accordingly preventing an adverse affect from occurring subsequently by sucking. It is desirable that no abrupt negative pressure should work on the ejection faces by providing an open-to-atmosphere valve (not illustrated) in a middle of the ink suction passage, and by thus beforehand opening the valve when the cap M5010 is intended to be detached from the ejection faces.

Furthermore, the suction pump M5000 can be operated not only for the purpose of the recovery by suction, but also for the purpose of discharging inks which have been received by the cap M5010 by the preliminary ejection operation performed in the state where the cap M5010 is opposite to the ejection faces. Specifically, when an amount of inks held in the cap M5010 after preliminary ejection reaches a predetermined amount, the inks held in the cap M5010 can be transferred to the waste ink absorbing member through the tube by operating the suction pump M5000.

The series of operations performed successively, such as the operations of the wiper portion M5020, the ascent/descent of the cap M5010 and the opening/closing of the valve, can be controlled by means of a main cam (not illustrated) provided on the output axle of the motor E0003, and a plurality of cams and arms and like which move so as to follow the main cam. Specifically, rotation of the main cam in response to a direction in which the motor E0003 rotates operates cams, arms and the like in each of the units and parts. Thereby, the predetermined operations can be performed. The position of the main cam can be detected with a position detection sensor such as a photo-interrupter.

(H) Wetting Liquid Transferring Unit (Refer to FIGS. 16 and 17)

Recently, inks containing pigment components as coloring agents (pigmented inks) are increasingly used for the purpose of enhancing the printing density, water resistance, light resistance of printed materials. Pigmented inks are produced through dispersing coloring agents themselves, which are originally solids, into water by adding dispersants thereto, or by introducing functional groups to pigment surfaces. Consequently, dried matter of pigmented inks resulting from drying the inks through evaporating moisture from the inks on the ejection faces damages the ejection faces more than dried coagulated matter of dyed inks in which the coloring agents are dissolved at molecular level. In addition, polymer compounds used for dispersing the pigments into the solvent are apt to be adsorbed to the ejection faces. This type of problem occurs in matter other than pigmented inks in a case where polymer compounds exist in the inks as a result of adding reactive liquids to the inks for the purpose of administering the viscosities of the inks, for the purpose of enhancing the light resistance of the inks, or for other purposes.

In this embodiment, a liquid is transferred onto, and adhered to, the blades of the wiper portion M5020, and thus the wiping operation is performed with the wetted blades M5020, in order to solve the foregoing problem. Thereby, the present embodiment attempts at preventing the ejection faces from deteriorating due to the pigmented inks, at reducing the abrasion of the wiper, and at removing the accumulated matter by dissolving the ink residue accumulated on the ejection faces. Such a liquid is termed as the wetting liquid from the viewpoint of its function in the description. The wiping by use of this liquid is termed as the wet wiping.

This embedment adopts a configuration in which the wetting liquid is stored inside the main body of the printing apparatus. Reference numeral M5090 denotes a wetting liquid tank. As the wetting liquid, a glycerin solution or the like is contained in the wetting liquid tank M5090. Reference numeral M5100 denotes a wetting liquid holding member, which is fibrous member or the like. The wetting liquid holding member M5100 has an adequate surface tension for the purpose of preventing the wetting liquid from leaking from the wetting liquid tank M5090. The wetting liquid holding member M5100 is impregnated with, and holds, the wetting liquid. Reference numeral M5080 denotes a wetting liquid transferring member, which is made, for example, of a porous material having an adequate capillary force. The wetting liquid transferring member M5080 includes a wetting liquid transferring part M5081 which is in contact with the wiper blade. The wetting liquid transferring member M5080 is also in contact with the wetting liquid holding member M5100 infiltrated with the wetting liquid. As a result, the wetting liquid transferring member M5080 is also infiltrated with the wetting liquid. The wetting liquid transferring member M5080 is made of the material having the capillary force which enables the wetting liquid to be supplied to the wetting liquid transferring part M5081 even if a smaller amount of wetting liquid remains Descriptions will be provided for operations of the wetting liquid transferring unit and the wiper portion.

First of all, the cap M5010 is set at the descending position, and thus is escaped to a position where the carriage M4000 does not contact the blades M5020A to M5020C, In this state, the wiper portion M5020 is moved in the −Y direction, and is caused to pass through the part of the blade cleaner M5060. Accordingly, the wiper portion M5020 is caused to abut on the wetting liquid transferring part M5081 (refer to FIG. 17). By keeping the wiper portion M5020 in contact with the wetting liquid transferring part M5081 for an adequate length of time, an adequate amount of wetting liquid is transferred onto the wiper portion M5020.

Subsequently, the wiper portion M5020 is moved in the +Y direction. The blade contacts the blade cleaner M5060 only in a part of the surface of the blade cleaner M5060, and no wetting liquid is adhered to the part. For this reason, the wetting liquid remains to be held on the blade.

The blade is returned to the position where the wiping operation has been started. Thereafter, the carriage M4000 is moved to the position where the wiping operation is designed to be performed. Subsequently, the wiper portion M5020 is moved in the −Y direction. Thereby, the ejection faces of the printing head H1001 can be wiped with the surface to which the wetting liquid is adhered.

1.3 Configuration of Electrical Circuit

Descriptions will be provided next for a configuration of an electrical circuit of this embodiment.

FIG. 18 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

Figure 20:
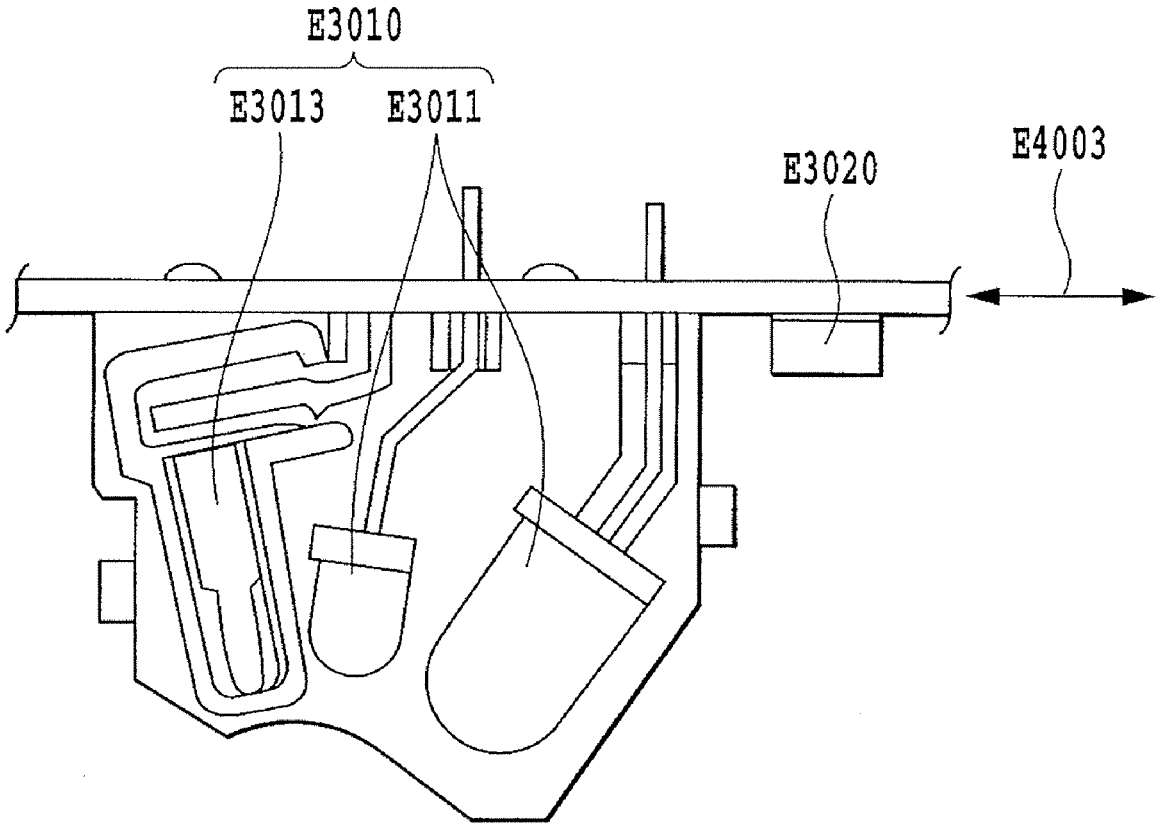
FIG. 20 is a diagram showing an example of a configuration of a multi-sensor system mounted on a carriage board shown in FIG. 18.

An optical sensor E3010 and a thermistor E3020 are connected to the carriage board E0013, as shown in FIG. 20. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus J0012 (FIG. 1). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 6). The front panel E0106 further includes a device I/F E0100 which is used for connecting peripheral devices, such as a digital camera, to the printing apparatus.

Figure 19:
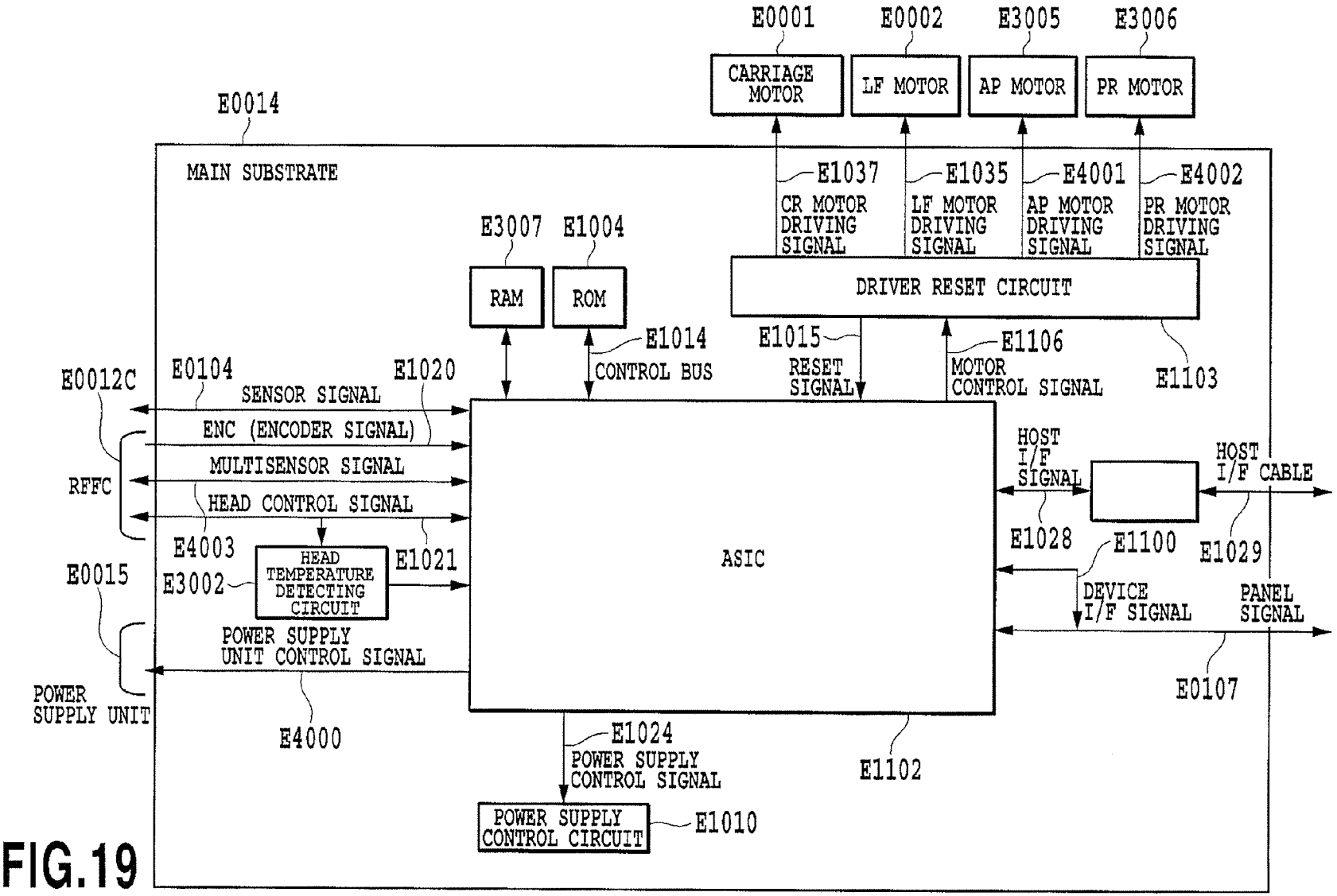
FIG. 19 is a block diagram showing an example of an internal configuration of a main substrate shown in FIG. 18.

FIG. 19 is a block diagram showing an internal configuration of the main substrate E1004.

In FIG. 19, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

1.4 Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 21:
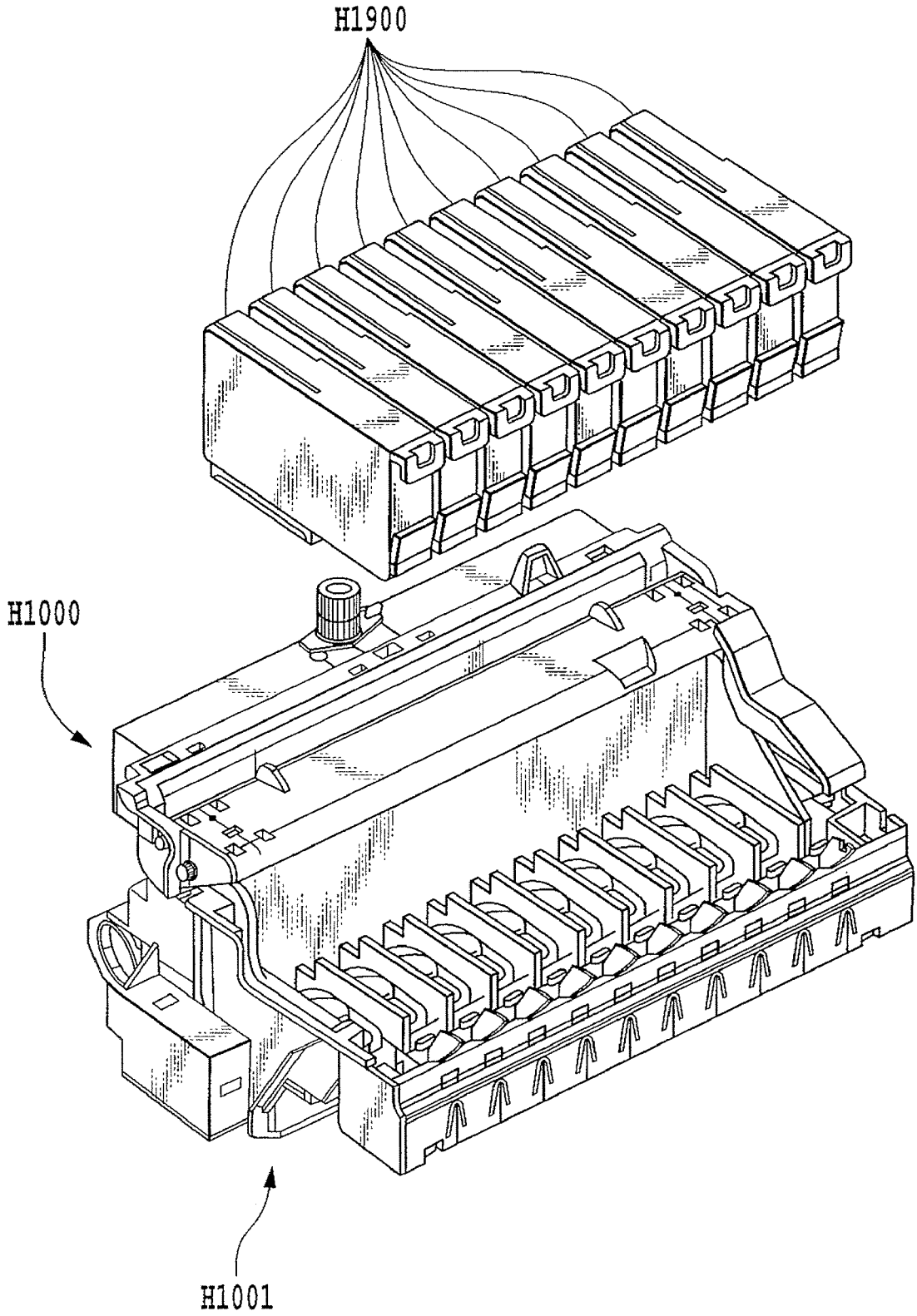
FIG. 21 is a perspective view of a head cartridge and ink tanks applied in the embodiment, which shows how the ink tanks are attached to the head cartridge.

FIG. 21 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 21, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

1.5 Configuration of Inks

Descriptions will be provided below for the ten color inks used in the present invention.

The ten colors used in the present invention are cyan (C), light cyan (Lc), magenta (M), light magenta (Lm), yellow (Y), black 1 (K1), black 2 (K2), gray (Gray), red (R) and green (G). It is desirable that all of the coloring agents used respectively for the ten colors should be pigments. In this respect, for the purpose of dispersing the pigments, publicly known dispersants may be used. Otherwise, for the purpose, it is sufficient that pigments surfaces are modified by use of a publicly known method, and that self-dispersants are added thereto. In addition, coloring agents used for at least some of the colors may be dyes as long as the use agrees with the spirit and scope of the present invention. Furthermore, coloring agents used for at least some of the colors may be what are obtained by harmonizing pigments and dyes in color, and a plurality of kinds of pigments may be included therein. Moreover, as for the ten colors of the present invention at least one kind of substance selected from the group consisting of an aqueous organic solvent, an additive, a surfactant, a binder and an antiseptic may be included in therein as long as the inclusion is within the spirit and the scope of the present invention.

2. Feature Configuration 2.1 Flat-Pass Printing Section Driving Mechanism

Here, descriptions will be given for more specific mechanisms, which characterize the present invention, with respect to the flat-pass printing already described.

Figure 22:
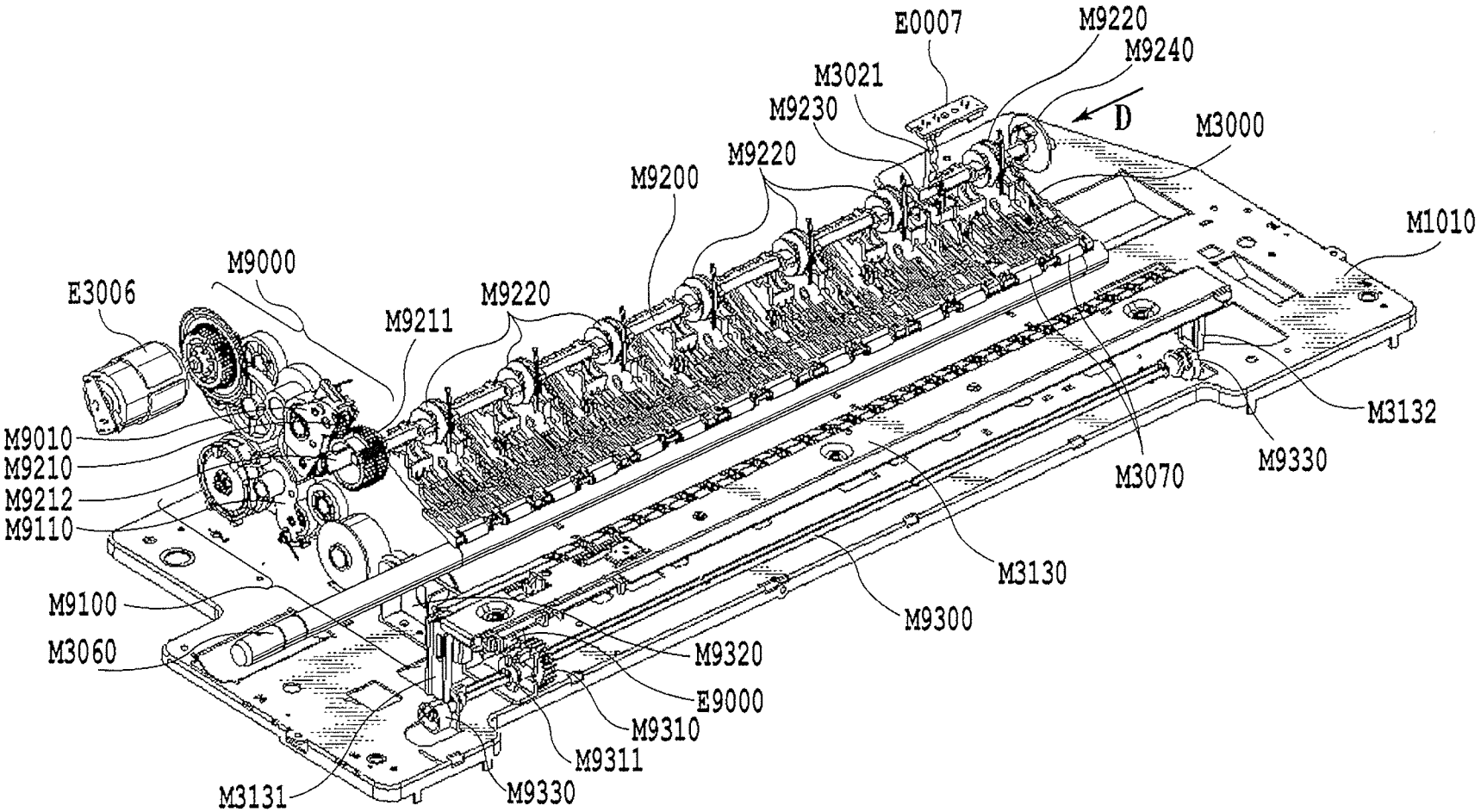
FIG. 22 is a perspective view showing a schematic configuration of a transferring mechanism section at the time of flat-pass printing.

FIG. 22 is a perspective view showing a schematic configuration of a transferring mechanism section at the time of the flat-pass printing. A decelerated force from a PR motor E3006, which is a driving source of a flat-pass operation, is branched off to a gear array M9000 for moving up and down a pinch roller holder M3000 and to a gear array M9100 for moving up and down a spur holder M3130. Specifically, one motor controls two mechanisms.

Figure 23:
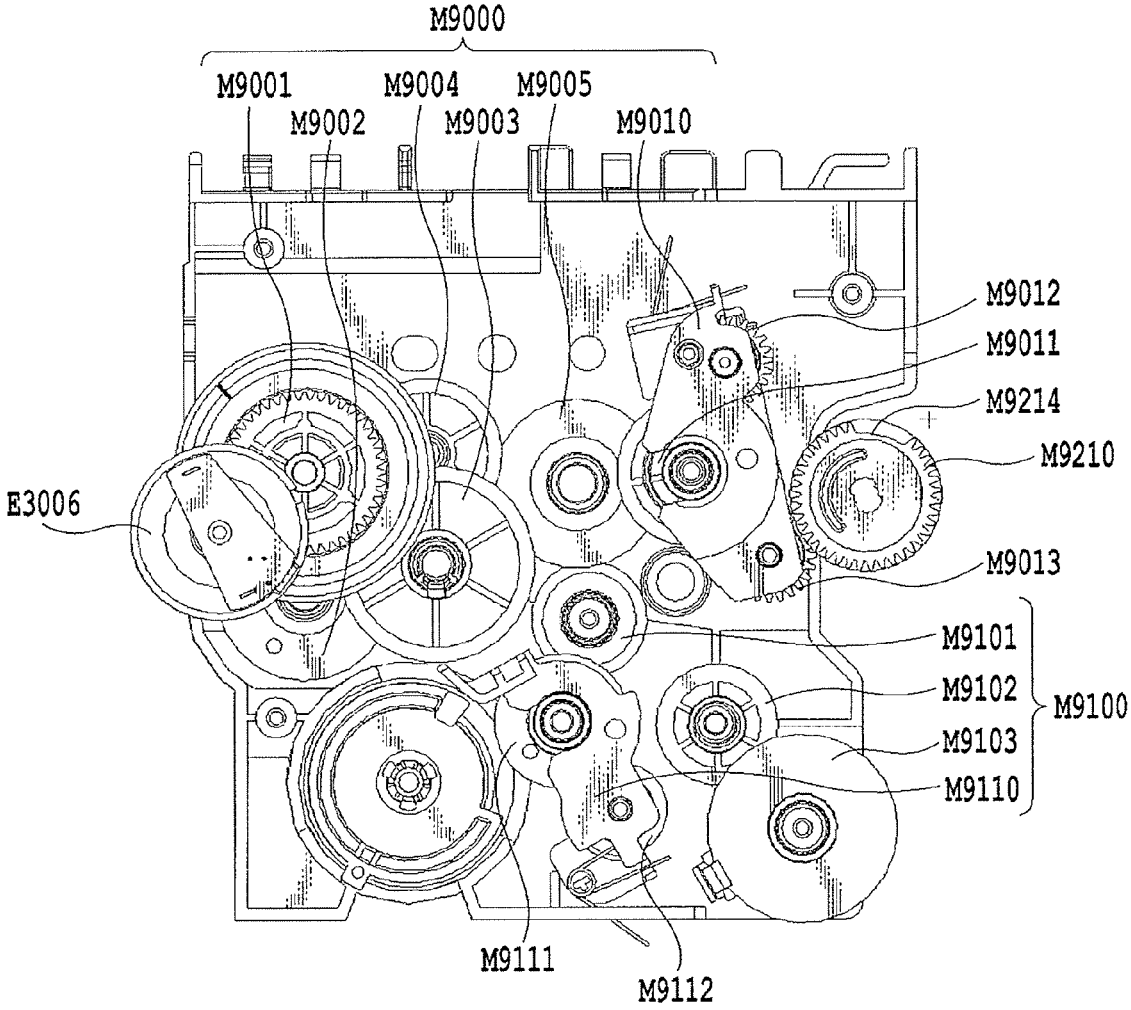
FIG. 23 is a side view for explaining configurations of gear arrays M9000 and M9100.

FIG. 23 is a side view for explaining configurations of the two gear arrays M9000 and M9100 described above. The gear array M9000 includes M9001 to M9005 and M9010, and controls raising and lowering of the pinch roller holder M3000. Meanwhile, the gear array M9100 includes M9101, which is branched off from M9005 in the gear array M9000 described above, M9110, M9102 and M9103, and is involved in moving up and down the spur holder M3130.

A PR pendulum gear mechanism M9010 provided at an end of the gear array M9000 can be connected to a pinch roller lift input gear (hereinafter referred to as a PR lift input gear) M9210. The PR lift input gear M9210 is rotatably supported by a pinch roller lift shaft M9200 on a chassis M1010, and transmits bidirectional drive of the PR motor E3006. Transmission of the bidirectional drive will be described in detail later. Note that, in a part of the PR lift input gear M9210, a notch part 9214 is provided.

As apparent from referring to FIG. 22 again, a plurality of pinch roller release cams (hereinafter referred to as PR release cams) M9220 for dividing the pinch roller holder M3000 are disposed on the pinch roller lift shaft M9200. The PR release cams M9220 are formed so as to act on an end portion opposite to an end portion on the side where pinch rollers M3070 are arranged in the pinch roller holder M3000. Specifically, the pinch roller holder M3000 is rotated by pressing down the opposite end portion, and the pinch rollers M3070 arranged on the other end portion are separated from conveying roller M3060. Moreover, a PE release cam M9230 for releasing a PE sensor lever M3021 according to the need is also provided on the pinch roller lift shaft M9200.

Furthermore, a cam shape M9211 for pressing down one end portion of a paper guide flapper M3030 is integrally formed on the PR lift input gear M9210 positioned at one end portion of the pinch roller lift shaft M9200. Moreover, also at the other shaft end portion of the pinch roller lift shaft M9200, a paper guide flapper release cam (hereinafter referred to as a PGF release cam) M9240 for pressing down the other end portion of the paper guide flapper M3030 is provided. These two cams have symmetrical shapes. In addition, by pressing down the paper guide flapper M3030 on both end portions thereof at the same timing, a paper passing face of the paper guide flapper M3030 is set in an approximately horizontal position. Hence, a flat-pass is realized.

A cylindrical rib M9212 is further provided in the PR lift input gear M9210. Along with rotation of the pinch roller lift shaft M9200, the rib M9212 releases and blocks an unillustrated PR lift sensor which is an infrared sensor. Thus, a rotation angle of the pinch roller lift shaft M9200 can be detected.

Next, the gear array M9100 will be described with reference to FIG. 23 again. A SB pendulum gear mechanism M9110 is provided in the middle of the gear array M9100. In the SB pendulum gear mechanism M9110, one planet gear M9112 is connected to a sun gear M9111. Thereby, the drive of the PR motor E3006 is transmitted only in one direction to the gear array above the SB pendulum gear mechanism M9110.

Figure 30:
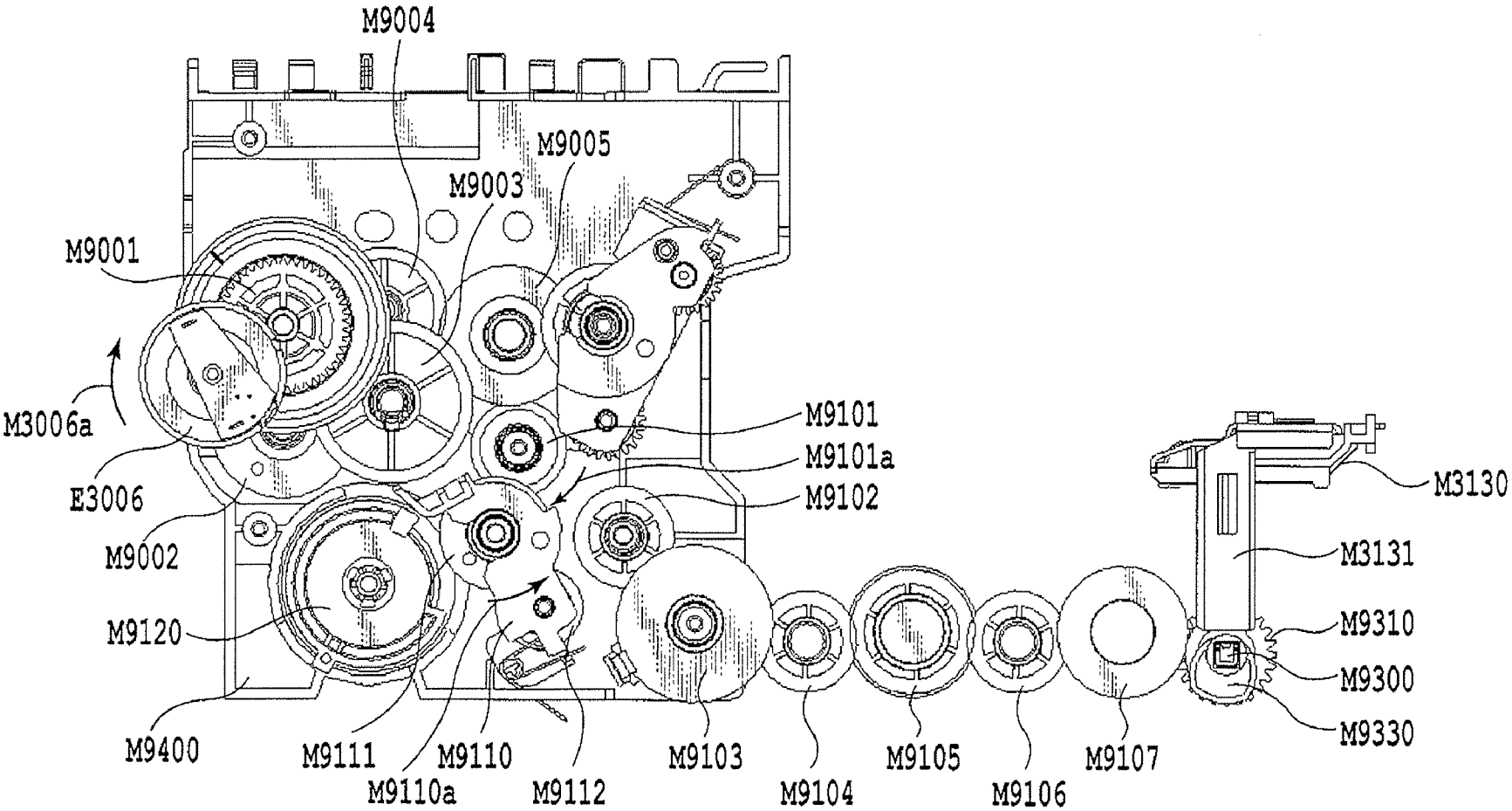
FIG. 30 is a side view showing a gear array for moving up and down a spur holder.

At the end of further connection from the gear M9103 in the gear array M9100, a spur holder lift input gear (hereinafter referred to as a SB lift input gear) M9310 is connected (FIG. 22 and FIG. 30). The SB lift input gear M9310 is fixed to a spur holder lift shaft M9300, and moves up and down the spur holder M3130 by use of rotation of the shaft. Note that the spur holder lift shaft M9300 is rotatably supported by the chassis M1010 and a spur holder gear base M9320 in which a part of the gear array M9100 is disposed.

Spur holder lift cams M9330 are respectively provided at both end portions of the spur holder lift shaft M9300. The spur holder lift cams M9330 act on arm parts M3131 and M3132 of the spur holder M3130.

A cylindrical rib M9311 is further provided in the SB lift input gear M9310. Along with rotation of the spur holder lift shaft M9300, the rib M9311 releases and blocks a spur holder lift sensor E9000 which is an infrared sensor. Accordingly, a rotation angle of the spur holder lift shaft M9300 can be detected.

(A) Pinch Roller Holder Lift Mechanism Section

Next, descriptions will be given for a detailed mechanism for moving up and down the pinch roller holder M3000.

Figure 24:
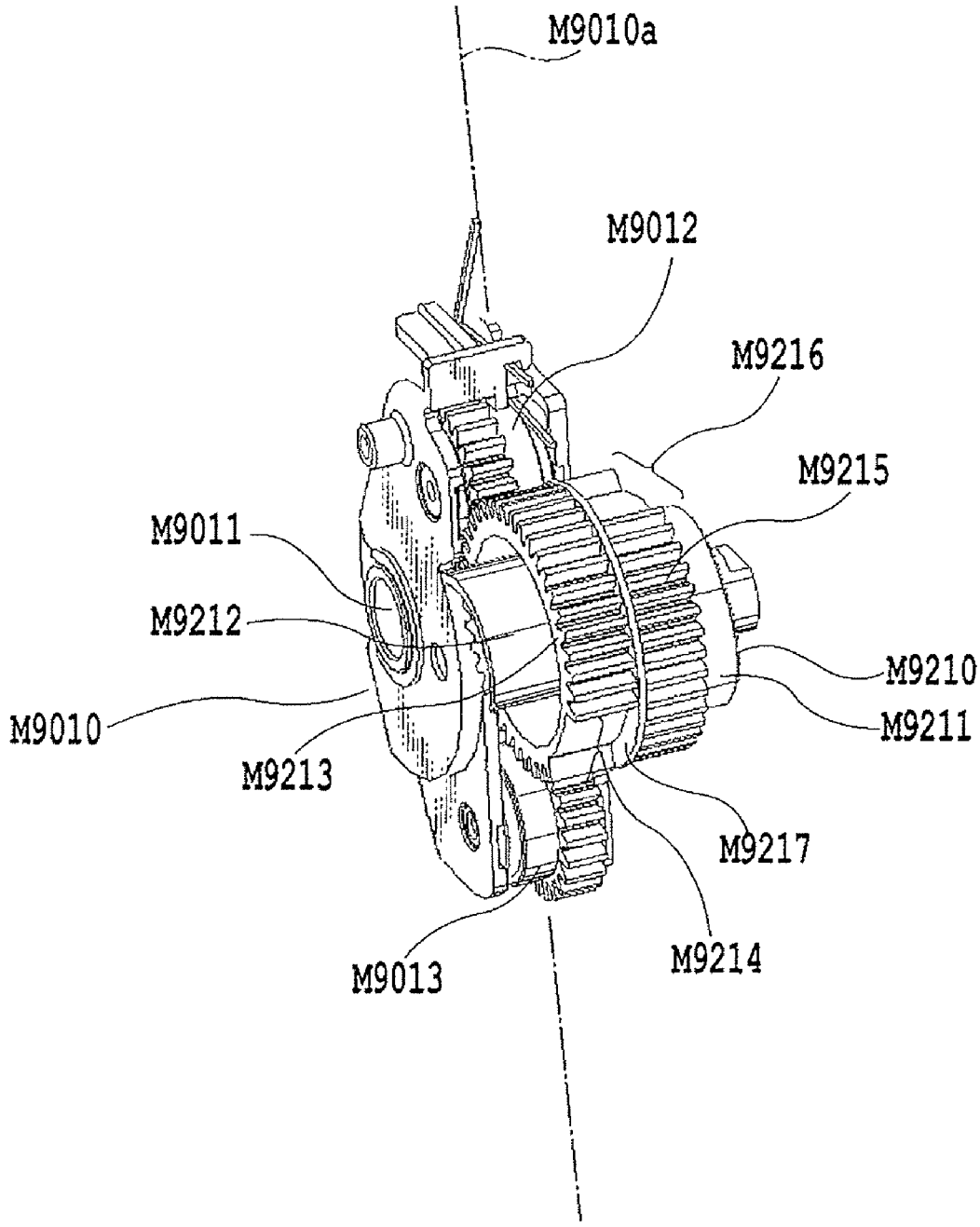
FIG. 24 is a perspective view for explaining in detail a state where a PR pendulum gear mechanism is connected to a PR lift input gear.

FIG. 24 is a perspective view for explaining in detail a connection state of the PR pendulum gear mechanism M9010 and the PR lift input gear M9210, which are described with reference to FIG. 23. The PR pendulum gear mechanism M9010 includes a sun gear M9011 and two planet gears M9012 and M9013. The two planet gears M9012 and M9013 are disposed on both sides of a center M9010*a* in a width direction of the PR pendulum gear mechanism M9010. Moreover, in the PR lift input gear M9210, two gears M9213 and M9215 to be connected to the respective planet gears M9012 and M9013 are formed with a flange M9217 interposed therebetween. In the two gears M9213 and M9215, notch parts M9214 and M9216, in which no teeth are formed, are provided.

Figure 25A:
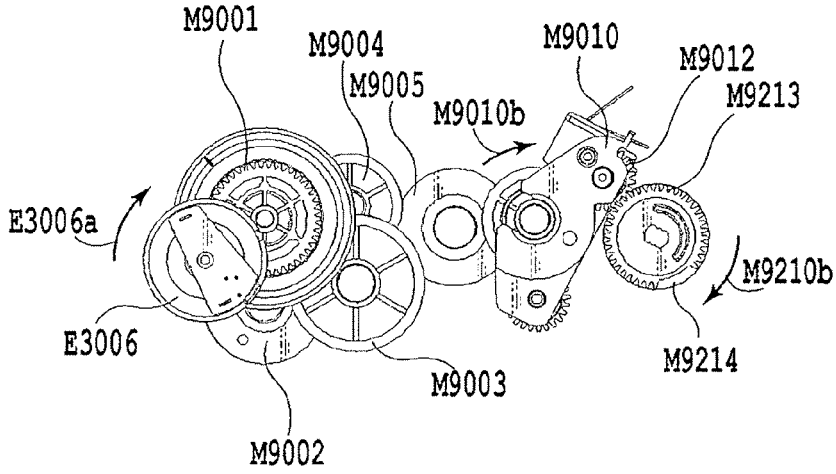
FIGS. 25A to 25C are side views for explaining an operation of connecting the gear arrays for operating a pinch roller lift shaft.
Figure 25B:
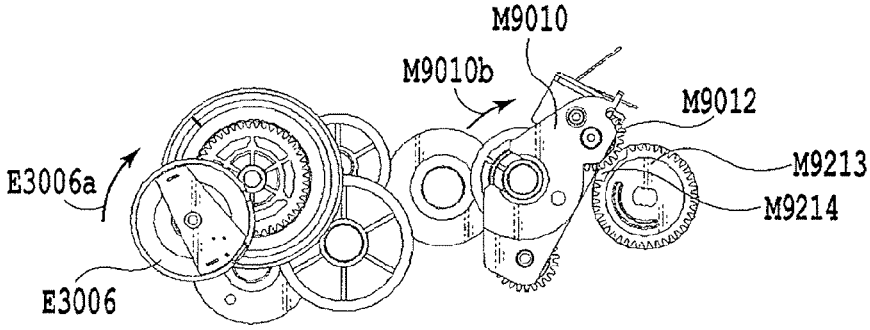
Figure 25C:
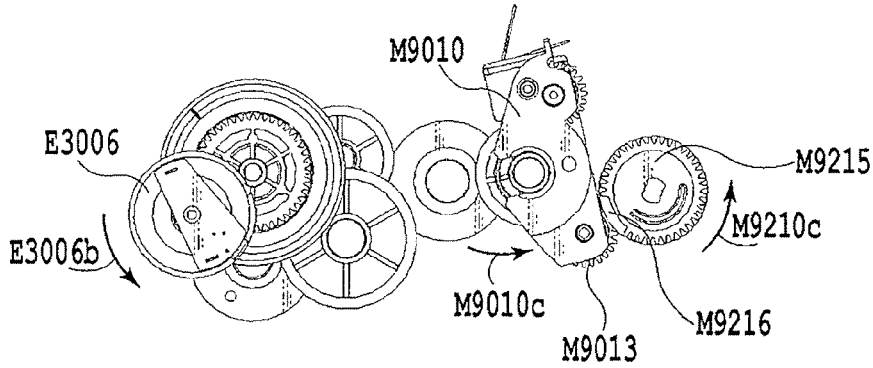

FIGS. 25A to 25C are side views for explaining an operation of connecting a series of gears in the gear array M9000 for operating the pinch roller lift shaft M9200. In this event, FIG. 25A shows a state where the PR motor E3006 is rotated in a clockwise direction E3006*a*. In this case, the PR pendulum gear mechanism M9010 is rotated in a direction of an arrow M9010*b* via the gears M9001 to M9005. Along with the rotation, the PR lift input gear M9213, which is connected to one planet gear M9012 in the PR pendulum gear mechanism M9010, is rotated in a direction of an arrow M9210*b*. Thereby, the pinch roller lift shaft M9200, to which the PR lift input gear M9210 is fixed, is also rotated in the direction of the arrow M9210*b*.

FIG. 25B shows a state where the respective rotations are further advanced from the state shown in FIG. 25A. Here, the planet gear M9012 falls into the notch part M9214 of the PR lift input gear M9213, and transmission of the drive of the PR motor E3006 is blocked.

FIG. 25C shows a state where the PR motor E3006 is rotated in a counterclockwise direction E3006*b* from the state shown in FIG. 25B. In this case, the PR pendulum gear mechanism M9010 is rotated in a direction of an arrow M9010*c* via the gears M9001 to M9005. Along with the rotation, the PR pendulum gear mechanism M9010 is connected to the PR lift input gear M9215 by the other planet gear M9013, and the PR lift input gear M9215 is rotated in a direction of an arrow M9210*c*. Thus, the pinch roller lift shaft M9200, to which the PR lift input gear M9210 is fixed, is also rotated in the direction of the arrow M9210*c*.

When the rotations in the counterclockwise direction are further continued, the planet gear M9013 also falls into the notch part M9216 of the PR lift input gear M9215 as in the case of the other planet gear described above. Thus, the drive transmission is blocked.

According to the configuration described above, by repeating the drive while inverting the rotation direction of the PR motor E3006, the PR lift input gear M9210 can be alternately connected to the planet gears M9012 and M9013. Specifically, as to the pinch roller lift shaft M9200 fixed to the PR lift input gear M9210, the rotations thereof in the direction of M9210*b* and of M9210*c* are controlled by a predetermined angle.

Figure 26A:
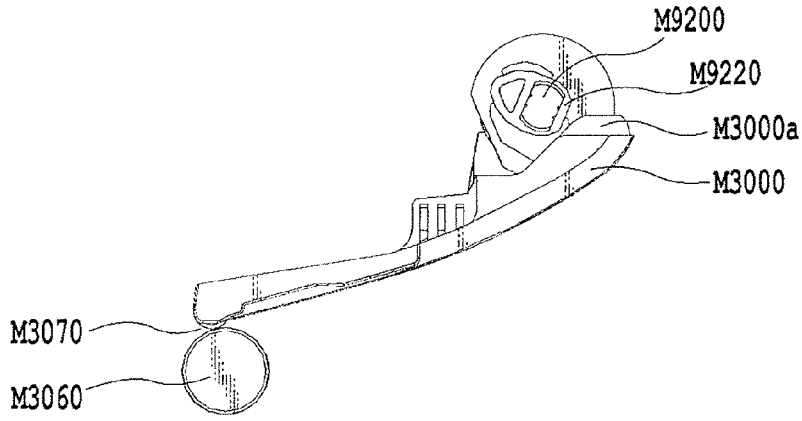
FIGS. 26A and 26B are side views for explaining an operation of a PR release cam.
Figure 26B:
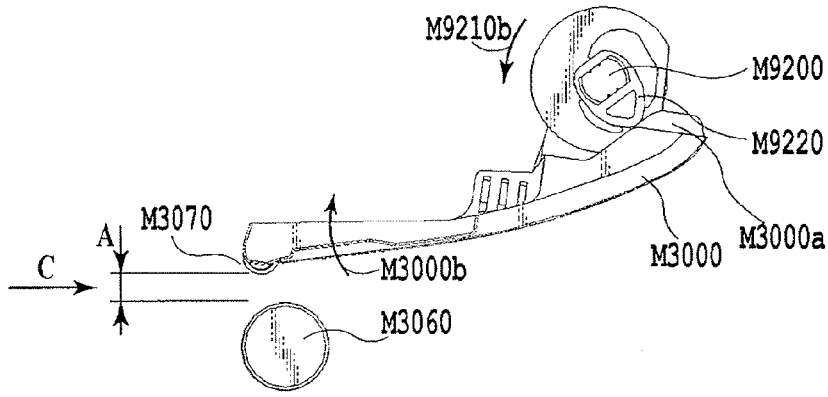

FIGS. 26A and 26B are side views for explaining an operation of the PR release cam M9220 attached to the pinch roller lift shaft M9200. Incidentally, FIGS. 26A and 26B are side views in a state where the configuration shown in FIG. 22 is observed from a direction of an arrow D, and arrangement of the respective members and rotation directions are inverted in a lateral direction from those in FIGS. 23 and 25.

FIG. 26A shows a state where the PR release cam M9220 is in an initial position. In the initial state, the pinch roller M3070 is pressed to the conveying roller M3060 to be in contact with each other.

Meanwhile, FIG. 26B shows a state where the PR motor E3006 is driven from the initial state, and the pinch roller lift shaft M9200 is rotated for a predetermined amount in a direction of the arrow M9210*b* by the already described interlocking of the gear array M9000. When the pinch roller lift shaft M9200 is rotated, the PR release cam M9220 is similarly rotated, and acts on an end portion M3000*a* of the pinch roller holder M3000 to press down the pinch roller holder M3000. Accordingly, the pinch roller holder M3000 is rotated in a direction of an arrow M3000*b*, and the pinch roller M3070, which is positioned at an end portion opposite to the end portion M3000*a*, is separated from the conveying roller M3060. FIG. 26B shows a state where the pinch roller M3070 is lifted up to a highest position. In this event, a space of a predetermined distance A is formed between the conveying roller M3060 and the pinch roller M3070. The distance A is set to be a distance through which a thick printing medium, which requires a flat-pass, can sufficiently pass. Incidentally, although not shown in the drawings here, an operation load of separation may be reduced by further providing a pinch roller spring.

Figures 27A, 27B:
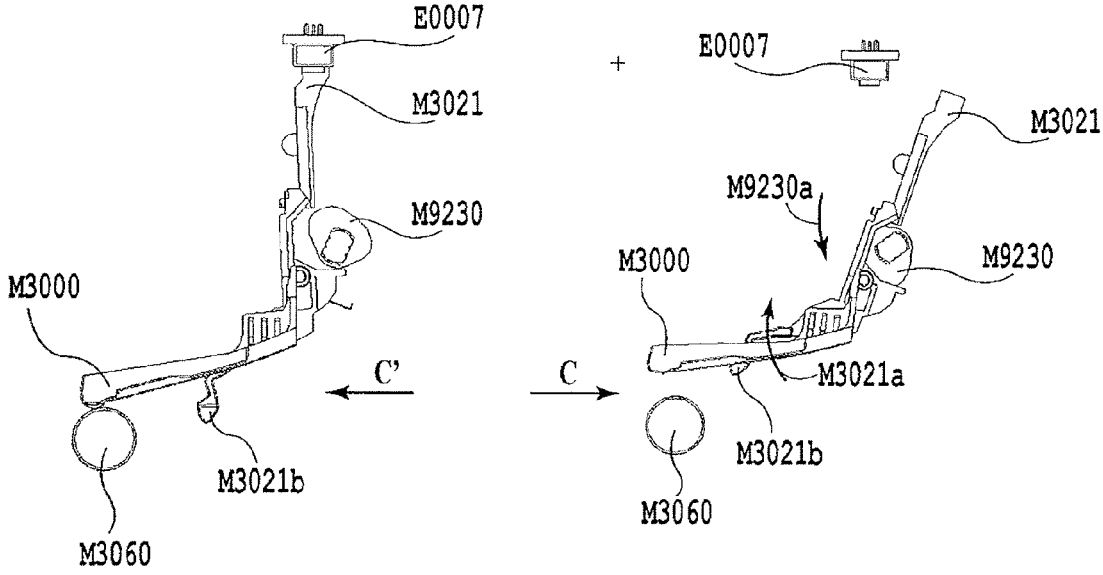
FIGS. 27A and 27B are side views for explaining an operation of a PE release cam.

FIGS. 27A and 27B are side views for explaining an operation of the PE release cam M9230 similarly attached to the pinch roller lift shaft M9200. As in the case of FIGS. 26A and 26B, FIGS. 27A and 27B are also side views in a state where the configuration shown in FIG. 22 is observed from a direction of the arrow D.

FIG. 27A shows a state where the PE release cam M9230 is in an initial position. In the initial state, the PE sensor lever M3021 is energized at the position shown in FIG. 27A by action of an unillustrated PE sensor lever spring. Hence, a light shielding plate part of the PE sensor lever M3021 shields a PE sensor E0007.

In a printing operation, when some kind of a printing medium is transferred from a direction of an arrow C' in the initial state described above, a tip of the printing medium pushes the PE sensor lever M3021 in the direction C' to rotate the PE sensor lever M3021 clockwise in FIG. 27A. By this rotation, the shielding plate of the PE sensor lever M3021 is shifted from the position of the PE sensor E0007. Accordingly, the PE sensor E0007, which is set in a transmission state, detects the end portion of the printing medium at the moment. By use of the configuration as described above, the tip or a rear end portion of the printing medium can be detected.

FIG. 27B is a partial cross-sectional view showing a state where the PE sensor lever M3021 as a paper detecting lever is released by the PE release cam M9230. When the PE release cam M9230 is rotated in a direction of an arrow M9230*a*, a cam follower part of the PE sensor lever M3021 is pressed down, and the PE sensor lever M3021 is rotated in a direction of an arrow M3021*a*. By this rotation, a paper detecting part M3021*b* attached to the PE sensor lever M3021 is hidden inside the pinch roller holder M3000. Even if a sheet of paper is carried into a paper passing route in the above state, the paper does not come into contact with the PE sensor lever M3021.

As described in FIGS. 26A to 27B, the PR release cam M9220 and the PE release cam M9230 are operated by the same rotation of the pinch roller lift shaft M9200. However, by adjusting attachment angles of the two cams and the like, operation timings thereof can be shifted from each other. For example, it is also made possible to set a state where only the PE sensor lever M3021 is released, and where the pinch roller holder M3000 is in contact with the conveying roller M3060. If such a state is realized, even when a sheet of paper is automatically transferred in a direction C opposite to the normal transferring direction C', a surface of the paper can be prevented from being damaged by the PE sensor lever M3021, while the paper is held by the conveying roller M3060 and the pinch roller M3070.

Figure 28A:
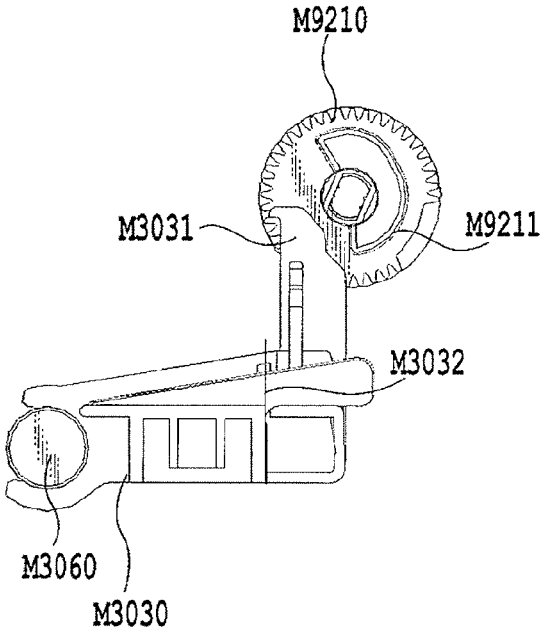
FIGS. 28A to 28C are partial cross-sectional views schematically showing avoidance operations of a paper guide flapper.
Figure 28B:
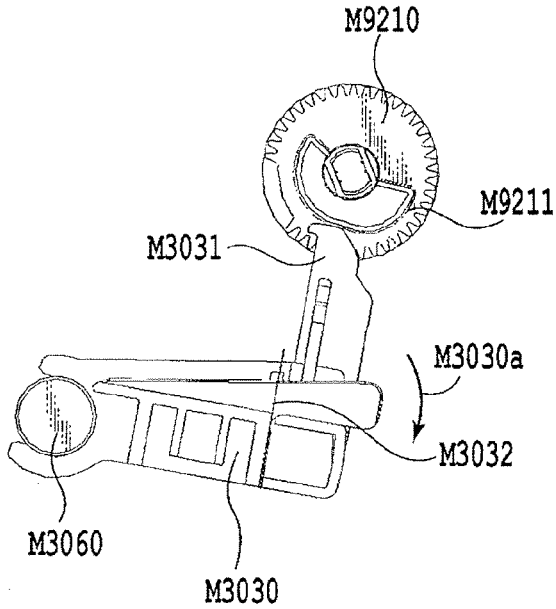
Figure 28C:
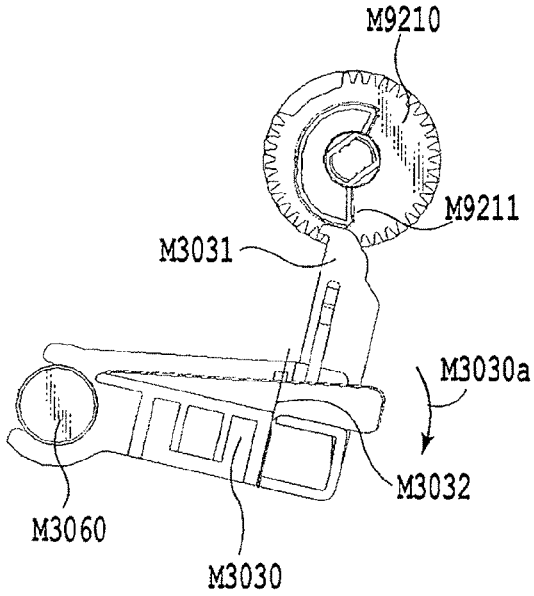

FIGS. 28A to 28C are partial cross-sectional views schematically showing avoidance operations of the paper guide flapper M3030. FIG. 28A shows a state where the paper guide flapper M3030 is positioned up for guiding paper to pass. As already described above, the paper guide flapper M3030 is energized in a lifting direction by an unillustrated spring member. Moreover, the paper guide flapper M3030 can be rotated around an unillustrated bearing, and is positioned by being in contact with the chassis M1010.

FIG. 28B is a partial cross-sectional view showing a state where the paper guide flapper M3030 is tilted downward. At both ends of the pinch roller lift shaft M9200, the cam shape M9211, which is formed in the PR lift input gear M9210, and the PGF release cam M9240 (see FIG. 22) are symmetrically formed, and are in contact with an arm part M3031 of the paper guide flapper M3030. Rotation of the two cam shapes described above causes the arm part M3031 to be pressed down in a direction of an arrow M3030*a*, and a side where the paper guide flapper M3030 is positioned upward is also lowered. Accordingly, a paper passing surface of the paper guide flapper M3030 is set in an approximately horizontal position. During flat-pass printing, the printing medium is inserted or transferred from a side of a paper delivery port in the horizontal state as described above.

FIG. 28C is a partial cross-sectional view showing a state where the paper guide flapper M3030 is pressed further downward from the state shown in FIG. 28B. Normally, in the paper guide flapper M3030, an antistatic brush M3032 is provided for removing static electricity on a printing medium transferred from an automatic paper feeder. However, when the printing medium is too flexible, there arises a risk that a force of transferring the printing medium inserted from the paper delivery port loses to a resistance force of the antistatic brush M3032, and that the printing medium is directed upward. Hence, in this embodiment, in order to avoid such a situation, the paper guide flapper M3030, which is provided with the antistatic brush, is pressed further down from the horizontal state described in FIG. 28B so as not to cause the antistatic brush to protrude into the paper passing route.

By use of the mechanism described above, the paper guide flapper M3030 in this embodiment can be changed to any one of three states, including a normal state shown in FIG. 28A, a small avoidance state shown in FIG. 28B and a large avoidance state shown in FIG. 28C.

Figure 29:
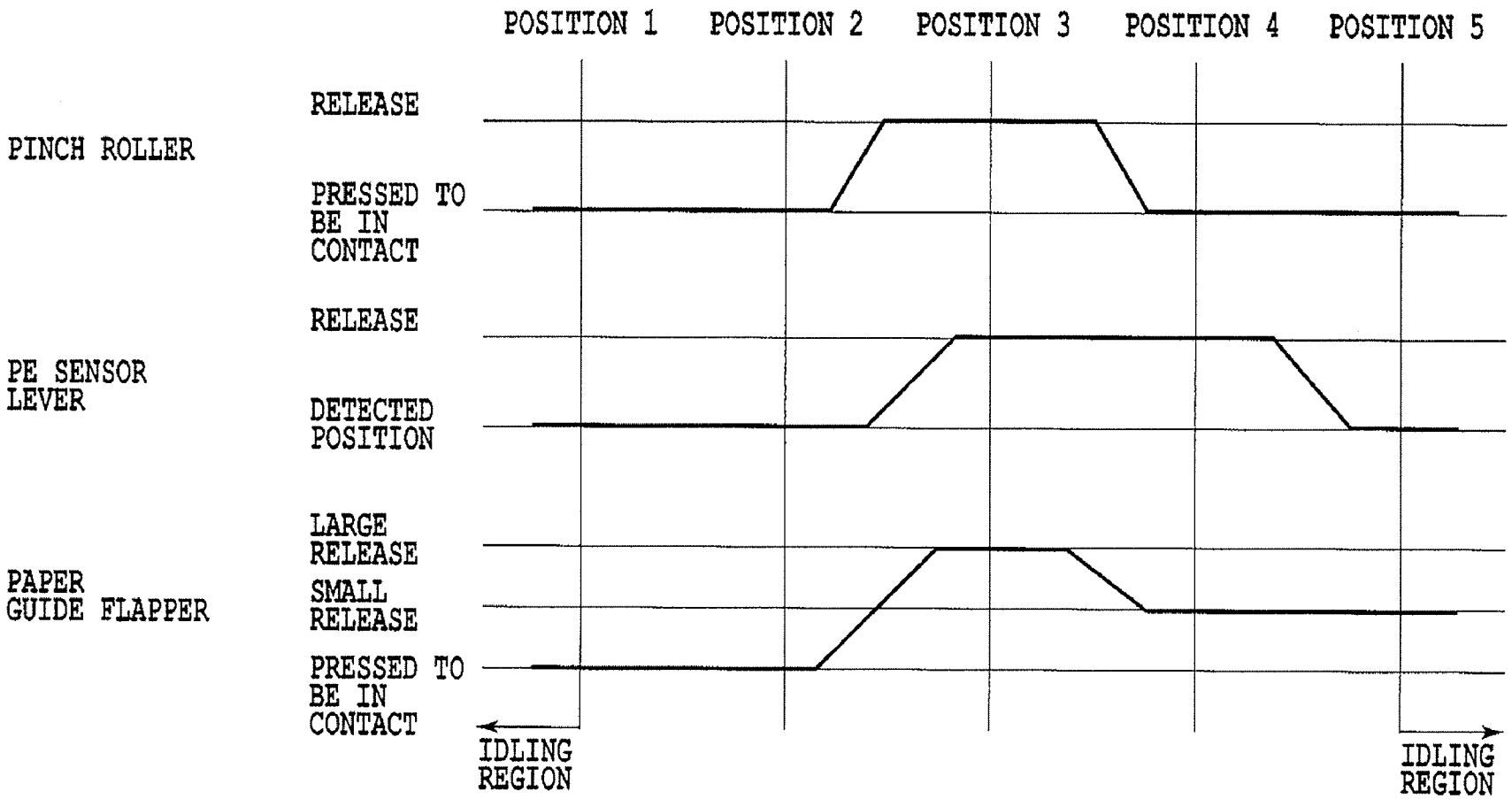
FIG. 29 is a timing chart for explaining operation timings of the three mechanisms described in FIGS. 26A to 28C.

FIG. 29 is a timing chart for explaining operation timings of the three mechanisms described in FIGS. 26A to 28C. The three mechanisms described above are disposed on the same pinch roller lift shaft M9200 in a state where angles of the respective cams are different from one another so as to be operated at different timings. In FIG. 29, the horizontal axis indicates a rotation angle of the pinch roller lift shaft M9200, and the vertical axis indicates the three mechanisms and positions thereof, i.e., whether the mechanisms are released (in an avoidance state) or operated.

As already described above, the pinch roller lift shaft M9200 of this embodiment is only rotated to a certain angle with respect to bidirectional rotation of the PR motor E3006. Positions 1 to 5 indicate a rotatable range of the pinch roller lift shaft M9200. Specifically, a region to the left of the position 1 and a region to the right of the position 5 denote idling regions where the drive of the PR motor E3006 is not transmitted. Here, the clockwise rotation E3006*a* of the PR motor E3006 shown in FIG. 25A is defined as a direction toward the position 5 from the position 1.

In a case of performing the flat-pass printing, the paper guide flapper M3030 is required to form an approximately horizontal plane. Thus, regions of the positions 3 to 5, in which the paper guide flapper M3030 is in a large release (large avoidance) or small release (small avoidance) state, are adopted. Particularly, when the printing medium is automatically fed, the printing medium is required to be held and transferred by the pinch rollers M3070 and the conveying rollers M3060. At the same time, the printing medium has to be prevented from getting stuck with, or from being damaged by, a paper detecting part M3216*b* attached to the PE sensor lever M3021. Hence, the position 4, in which the pinch rollers M3070 are in a state of being pressed to be in contact with conveying rollers M3060, and in which the PE sensor lever M3021 is in the release (avoidance) state. Meanwhile, during a printing operation, since a rear end of the printing medium needs to be detected by the PE sensor lever M3021, the position 5 is adopted.

As described above, by use of the force transmitted by the gear array M9000, moving up and down of the pinch roller holder M3000, shielding and releasing of the PE sensor lever M3021 from the PE sensor E0007, and changing of the tilt of the paper guide flapper M3030 are performed at the same time.

(B) Spur Holder Lift Mechanism Section

Next, descriptions will be given for a spur holder lift mechanism using a force transmitted by the gear array M9100.

FIG. 30 is a side view showing the gear array M9100 for moving up and down the spur holder M3130. When the PR motor E3006 is rotated in the clockwise direction E3006*a*, the gear M9101, which is the first stage of the gear array M9100, is rotated in a direction of an arrow M9101*a* via the gears M9001 to M9005. By this rotation, the sun gear M9111 of the SB pendulum gear mechanism M9110 at the next stage is rotated in a direction of an arrow M9110*a*. Thus, the planet gear M9112, which is connected to the sun gear M9111, is connected to the gear M9102. When the gear M9102 is rotated, this torque is transmitted to the SB lift input gear M9310 via gears M9103 to M9107. The cams M9330 for moving up and down the spur holder lift shaft M9300 are attached to the SB lift input gear M9310. The cams M9330 are operated along with rotation of the SB lift input gear M9310. Hence, the spur holder M3130 can be moved up and down.

On the other hand, in a case where the PR motor E3006 is rotated in the direction opposite to the direction of the arrow E3006*a*, the SB pendulum gear mechanism M9110 is rotated in the direction opposite to the direction of the arrow M911*a*, and the planet gear M9112 is separated from the gear M9102. As a result, the spur holder is no longer moved up and down.

Specifically, the spur holder M3130 can be moved up and down only in one direction which is the clockwise direction E3006*a* of the PR motor E3006.

By use of the spur holder lift mechanism section described above, when the PR motor E3006 is continuously rotated in the clockwise direction E3006*a*, the upward and downward movements of the spur holder M3130 is uninterruptedly continued. However, driving force of the PR motor E3006 also contributes to the upward and downward movements of the pinch roller holder M3000. For this reason, unless some kind of control is performed between the two holders, the pinch roller holder M3000 and the spur holder M3130 are moved up and down at the same time. During the flat-pass printing, there also arises a need to individually perform the upward and downward movements of the pinch roller holder M3000 and that of the spur holder M3130. In this case, this configuration leads to inconvenience.

Accordingly, in this embodiment, an operation control unit M9120 is connected to the SB pendulum gear mechanism M9110. Thereby, it is made possible to selectively perform drive connection to the spur holder M3130. The operation control unit M9120 has a function of controlling the rotation of the SB pendulum gear mechanism M9110 and of stopping the rotation of the SB pendulum gear mechanism M9110 before the SB pendulum gear mechanism M9110 connects to the gear M9102.

Figure 31A:
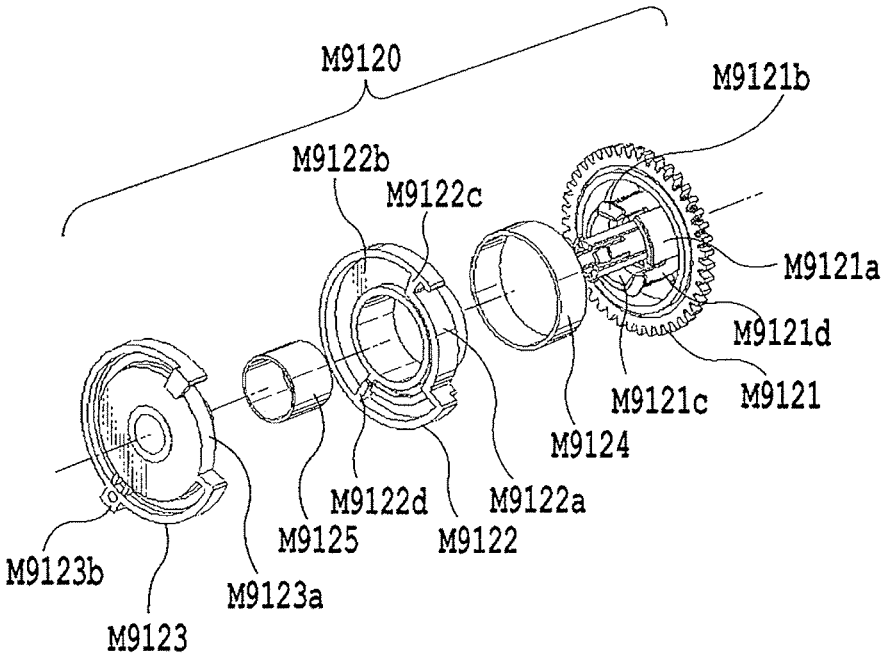
FIGS. 31A and 31B are exploded perspective views in a case where an operation control unit is observed from both sides.
Figure 31B:
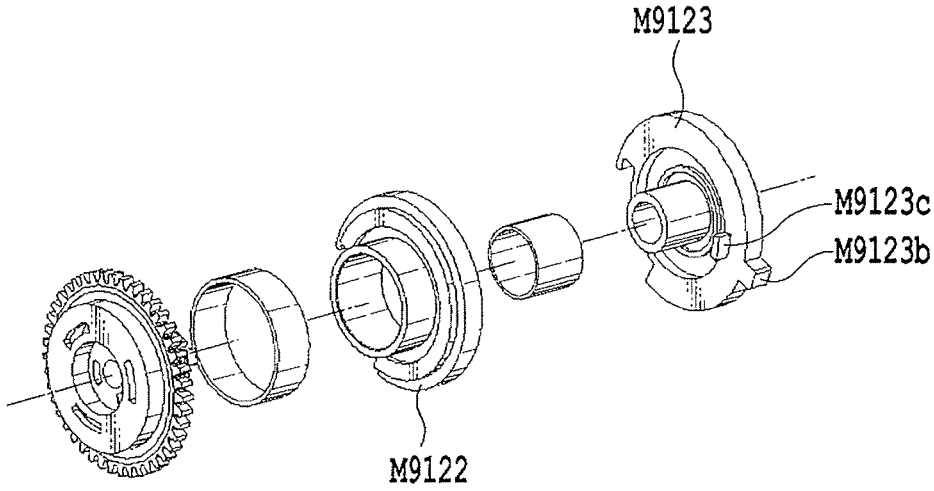

FIGS. 31A and 31B are exploded perspective views in a case where the operation control unit M9120 is observed from both sides. The operation control unit M9120 includes a gear part M9121, ring members M9122 and M9123, and springs M9124 and M9125 which presses the gear part M9121 to the respective ring members to be in contact with each other. A shaft shape M9121*a* and a shaft shape M9121*c* are formed in the gear part M9121. The shaft shape M9121*a* has a claw shape M9121*b* at a tip thereof, and the shaft shape M9121*c* similarly has a claw shape M9121*d* at a tip thereof. The respective claw shapes are designed to fit into the ring members M9122 and M9123. Thereby, the gear part M9121 and the ring members M9122 and M9123 are respectively pressed to be in contact with one another by use of the springs M9124 and M9125. Moreover, the two ring members are rotated along with the gear part M9121.

Concave parts M9122*a* and M9123*a*, which drop from outermost surfaces, are respectively provided in peripheral parts of the ring members M9122 and M9123. Moreover, a concave shape M9122*b* defined by ribs M9122*c* and M9122*d* is provided on a face of the ring member M9122, which comes into contact with the ring member M9123. On a face of the ring member M9123, which faces the ring member M9122, a rib M9123*c* is provided so as to fit into the concave shape M9122*b* (see FIG. 32A). Moreover, a convex shape M9123*b* is formed on a peripheral face of the ring member M9123.

Subsequently, operations of the ring members M9122 and M9123 will be described on the supposition that the ring member M9123 is fixed.

Figure 32A:
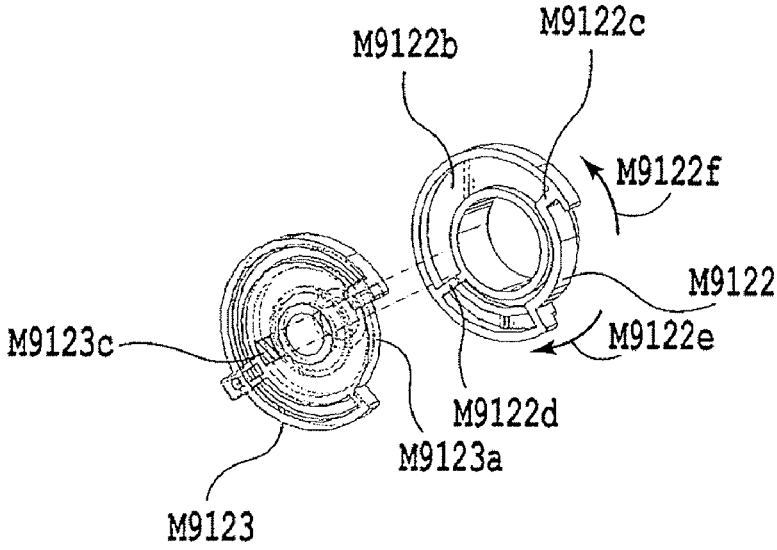
FIGS. 32A and 32B are views showing arrangement of a ring member and a rib.
Figure 32B:
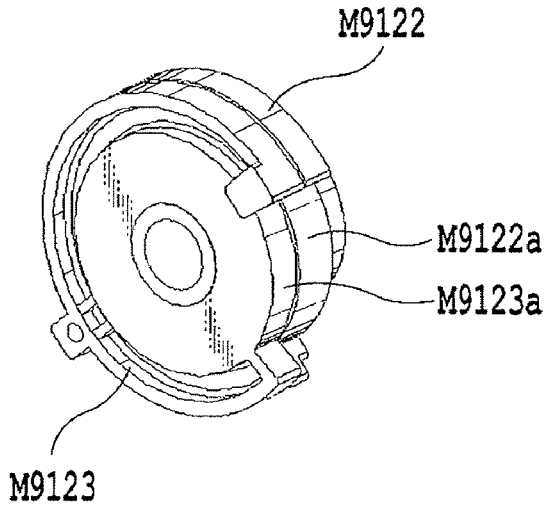

FIGS. 32A and 32B are views showing a state where the rib M9123*c* of the ring member M9123 is in contact with the rib M9122*d*, which is one of the ribs defining the concave shape M9122*b* of the ring member M9122. FIG. 32A is an exploded view, and FIG. 32B shows the peripheral parts. The concave parts M9122*a* and M9123*a*, which are provided in the peripheral parts of the two ring members, are set up so as to have the same phase as shown in FIG. 32B. In this state, since the ribs are in contact with each other, the ring member cannot be rotated in a direction of an arrow M9122*e*, but can be rotated in a direction of an arrow M9122*f*.

Figure 33A:
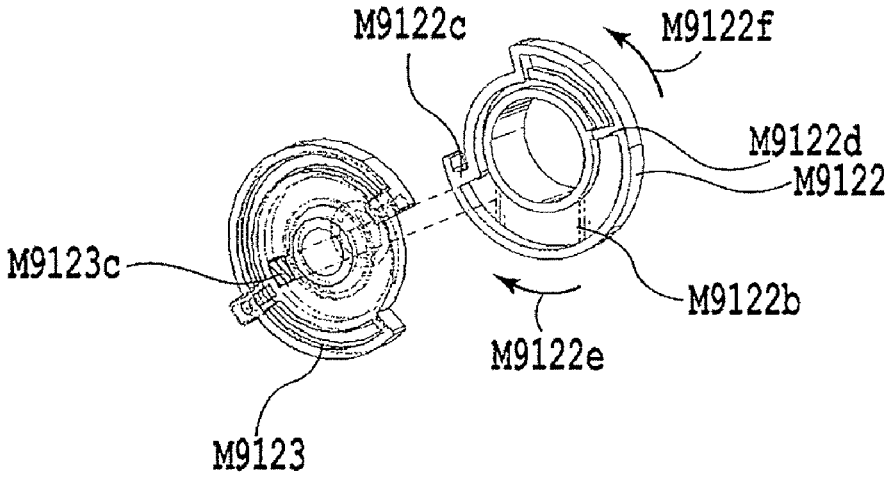
FIGS. 33A and 33B are views showing arrangement of the ring member and the rib.
Figure 33B:
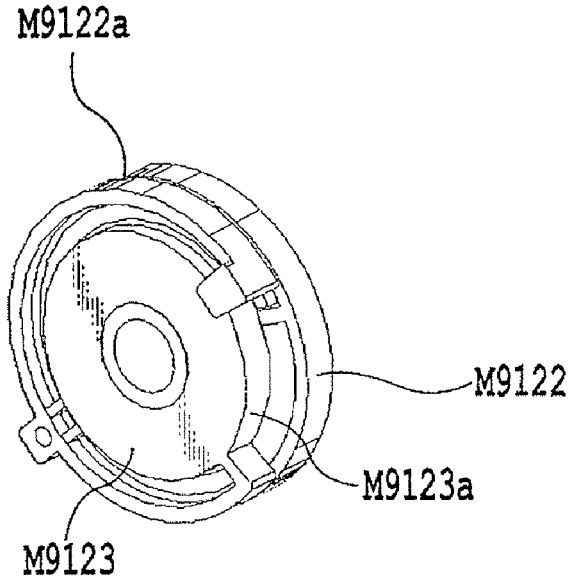

FIGS. 33A and 33B are views showing a state where the ring member M9122 is rotated in a direction of the arrow M9122*f* from the state shown in FIGS. 32A and 32B, and where the other rib M9122*c* of the ring member M9122 is in contact with the rib M9123*c* of the ring member M9123. The concave parts M9122*a* and M9123*a*, which are provided on the peripheral parts of the two ring members, are set in positions shifted from each other as shown in FIG. 33B.

Figure 34A:
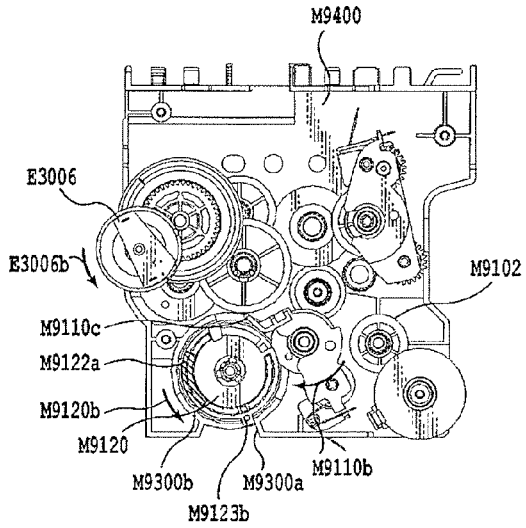
FIGS. 34A to 34E are schematic views for explaining action of the operation control unit with respect to drive transmission.

FIGS. 34A to 34E are schematic views for explaining action of the operation control unit M9120 described above with respect to drive transmission. FIG. 34A shows a state where the PR motor E3006 is largely rotated in the counterclockwise direction E3006*b*. This state corresponds to the position 1 in FIG. 29. In this state, since the SB pendulum gear mechanism M9110 is rotated in a direction of an arrow M9110*b*, the SB pendulum gear mechanism M9110 is not connected to the gear M9102. In the operation control unit M9120, the convex shape M9123*b*, which is provided on the peripheral face of the ring member M9123, is in contact with a rib M9300*a* of the base member M9400 supporting the gear arrays. Thus, the ring member M9123 is not rotated any further. The other ring member M9122 is also rotated all the way as shown in FIG. 33B, and the ribs are set in a state of being in contact with each other.

Figure 34B:
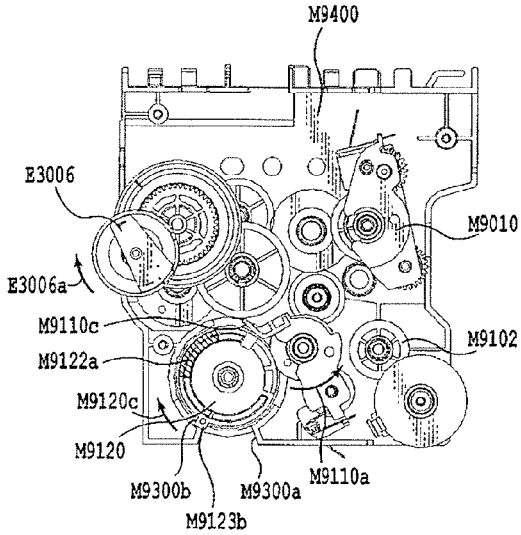

FIG. 34B shows a state where the PR motor E3006 is rotated in the clockwise direction E3006*a* from the state shown in FIG. 34A. When the PR motor E3006 is rotated in the clockwise direction E3006*a*, the SB pendulum gear mechanism M9110 is rotated in a direction to connect to the gear M9102, that is, in a direction of the arrow M9110*a*. Meanwhile, the operation control unit M9120 is rotated in a direction of an arrow M9120*c*. Here, in the SB pendulum gear mechanism M9110, an arm part M9110*c* is provided for controlling rotation of the ring member M9122 in the operation control unit M9120 by being in contact with the peripheral face thereof. Moreover, even if the rotation is further advanced, the arm part M9110*c* comes into contact with the peripheral face of the ring member M9123. Accordingly, the rotation is continuously controlled. Thus, the SB pendulum gear mechanism M9110 cannot transmit the drive by connecting to the gear M9102. Specifically, in this state, the drive of the PR motor E3006 is transmitted only to the gear array for moving up and down the pinch roller holder M3000.

Figure 34C:
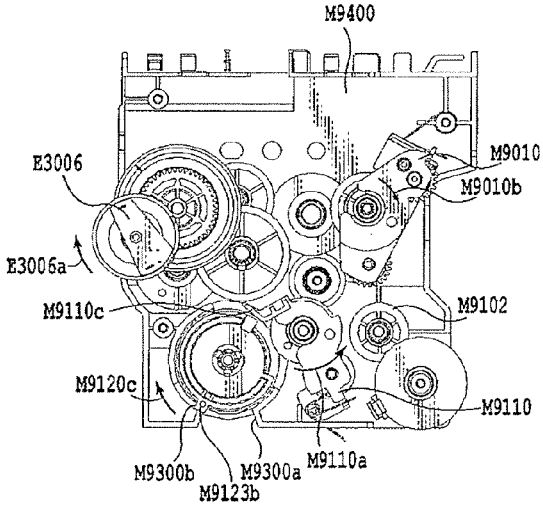

FIG. 34C shows a state where the PR motor E3006 is further rotated from the state shown in FIG. 34B. This state corresponds to the position 5 in FIG. 29. The PR pendulum gear mechanism M9010 for moving up and down the pinch roller holder M3000 falls into the notch described in FIG. 25B, and drive thereof idles. Moreover, the arm part M9110*c* of the SB pendulum gear mechanism M9110 is in contact with the ring member M9123 in the operation control unit M9120 continuously from the state shown in FIG. 34B. Thereby, the drive is not transmitted to the gear M9102. As a result, even if the PR motor E3006 is continuously rotated in the clockwise direction E3006*a* in this state, the drive is not transmitted either to the mechanism for moving up and down the pinch roller holder M3000 or to the mechanism for moving up and down the spur holder M3130. Incidentally, in this state, phases of the concave shapes M9122*a* and M9123*a*, which are provided respectively on the peripheral faces of the ring members M9122 and M9123 in the operation control unit M9120, coincide with each other.

Figure 34D:
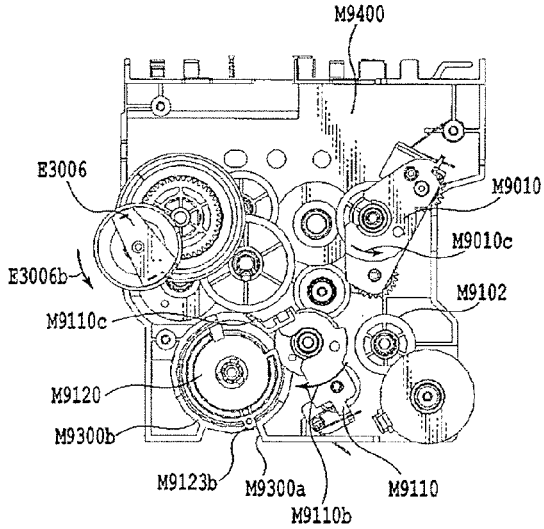

FIG. 34D shows a state where the PR motor E3006 is rotated for a predetermined amount in a direction of the arrow E3006*b* from the state shown in FIG. 34C. The predetermined amount is equivalent to a rotation amount of the convex shape M9123*b*, which is provided on the peripheral face of the ring member M9123 in the operation control unit M9120, up to the point when the convex shape comes into contact with the rib M9300*a* of the base member M9300 supporting the gear arrays. Furthermore, the predetermined amount is set smaller than a rotation amount needed for the PR pendulum gear mechanism M9010 for driving the pinch roller holder M3000 to be rotated in a direction of the arrow M9010*c* from the state shown in FIG. 34D, and to be connected to the PR lift input gear M9210. Hence, in the state shown in FIG. 34D, driving force is not transmitted to the mechanism for moving up and down the pinch roller. Meanwhile, the concave shapes M9122*a* and M9123*a* provided respectively on the peripheral faces of the ring members M9122 and M9123 in the operation control unit M9120 exist at a position facing the arm part M9110*c* of the SB pendulum gear mechanism M9110.

Figure 34E:
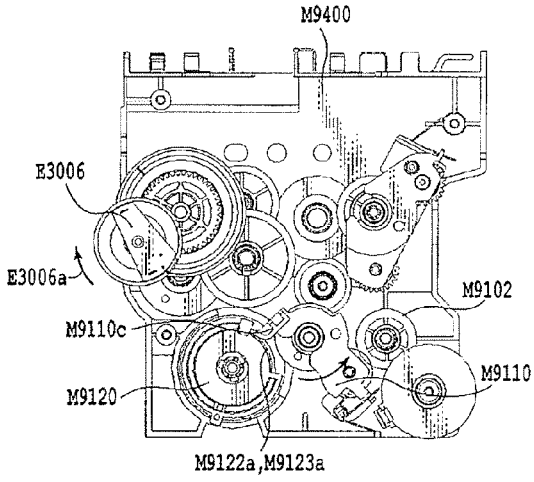

FIG. 34E shows a state where the PR motor E3006 is rotated in the clockwise direction E3006*a* from the state shown in FIG. 34D. In this case, the arm part M9110*c* of the SB pendulum gear mechanism M9110 initially falls into the concave shapes M9122*a* and M9123*a* provided respectively on the peripheral faces of the ring members M9122 and M9123 in the operation control unit M9120. For this reason, a rotation amount, which is sufficient for connecting to the gear M9102, is secured in the SB pendulum gear mechanism M9110. Thereafter, the arm part M9110*c* is locked with the concave shapes M9122*a* and M9123*a* of the ring members M9122 and M9123, and the driving force is continuously transmitted to the gear M9102. As a result, the spur holder M3130 can be moved up and down. Incidentally, at this moment, the PR pendulum gear mechanism M9010 and the PR lift input gear M9210 in the gear array M9000 for moving up and down the pinch roller holder M3000 are in a toothless state, and thus run idle. Accordingly, driving force is not transmitted to the mechanism for moving up and down the pinch roller holder.

In this event, consideration is made for a case where the PR motor E3006 is rotated in the counterclockwise direction E3006*b* for more than a rotation amount necessary for setting the state shown in FIG. 34D from the state shown in FIG. 34C. In this case, it is also conceivable that the concave part M9122*a* provided on the peripheral face of the ring member M9122 does not at all overlap with the concave part M9123*a* of the other ring member M9123. In this case, even if the PR motor E3006 is rotated in the clockwise direction E3006*a* from such a state, the arm part M9110*c* of the SB pendulum gear mechanism M9110 is first controlled by the peripheral face of the ring member M9122, and thereafter, controlled by the peripheral face of the ring member M9123. Hence, falling into the concave parts of the ring members, which is necessary for transmitting the drive to the gear M9102, is not achieved. As a result, driving force is not transmitted to the mechanism for moving up and down the spur holder.

Specifically, by setting a rotation amount needed for movement between the respective positions shown in FIG. 29 to be larger than the rotation amount described above, reverse movement between the positions can be controlled. For example, after moving from the position 5 to the position 4, even if an attempt is made to move again to the position 5, drive transmission to the mechanism for moving up and down the spur holder is blocked.

Figure 35:
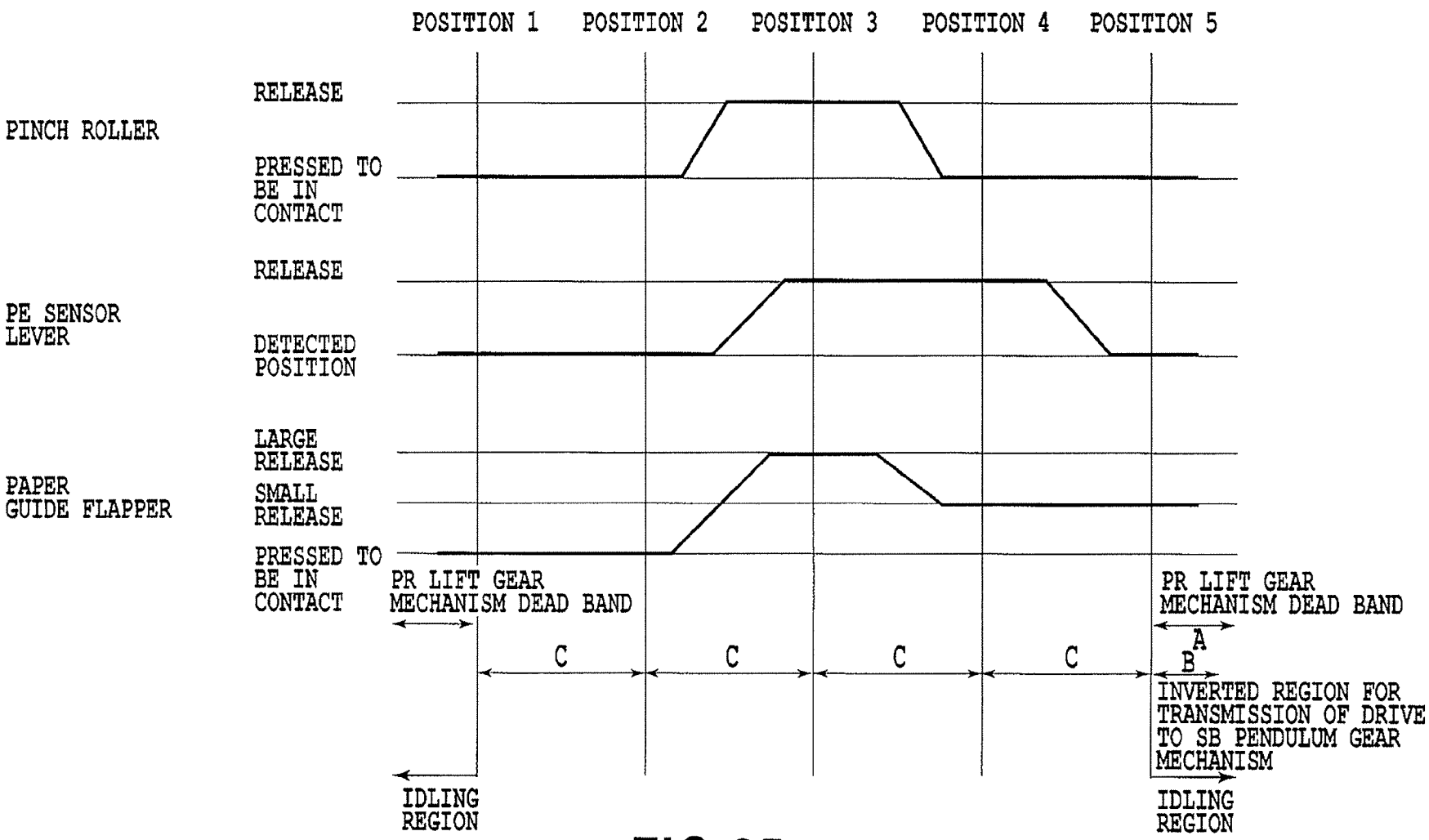
FIG. 35 is a timing chart obtained by adding an operation timing of a spur holder lifting mechanism to the timing chart shown in FIG. 29.

FIG. 35 is a timing chart obtained by adding an operation timing of the mechanism for moving up and down the spur holder to the timing chart shown in FIG. 29 already described. As already described above, outside the position 5, there is a dead band region A of the PR pendulum gear mechanism M9010 due to switching at the time of inversion of the PR motor E3006. Accordingly, a rotation amount B necessary for the arm part M9110*c* of the SB pendulum gear mechanism M9110 to fall into the concave shapes M9122*a* and M9123*a* respectively provided on the peripheral faces of the ring members M9122 and M9123 in the operation control unit M9120 is set smaller than the dead band region A. Furthermore, a rotation amount C for moving between the respective positions 1 to 5 is set larger than the rotation amount B.

As described above, in order to transmit the drive to the mechanism for moving up and down the spur holder, the rotation of the PR motor E3006 in the clockwise direction E3006*a* and the rotation thereof in the counterclockwise direction E3006*b* need to be alternately repeated. Specifically, the PR motor E3006 is rotated first in the clockwise direction E3006*a*, and thereafter, is rotated in the counterclockwise direction E3006*b* for a predetermined amount. Thereby, the operation control unit is set in the state shown in FIG. 32B. Furthermore, after the PR motor E3006 is rotated in the counterclockwise direction for the predetermined amount, the PR motor E3006 is rotated again in the clockwise direction. By the rotation operations in four stages described above, the driving force is transmitted to the mechanism for moving up and down the spur holder.

Moreover, by use of the configuration of this embodiment, drive is not transmitted to the mechanism for moving up and down the pinch roller when the spur holder is moved up and down. Specifically, by rotational drive of one motor E3006, the operations of the mechanisms for moving up and down the pinch roller and the spur holder can be performed independently of each other.

2.2 Flat-Pass Printing Section Control

Figures 36, 36A:
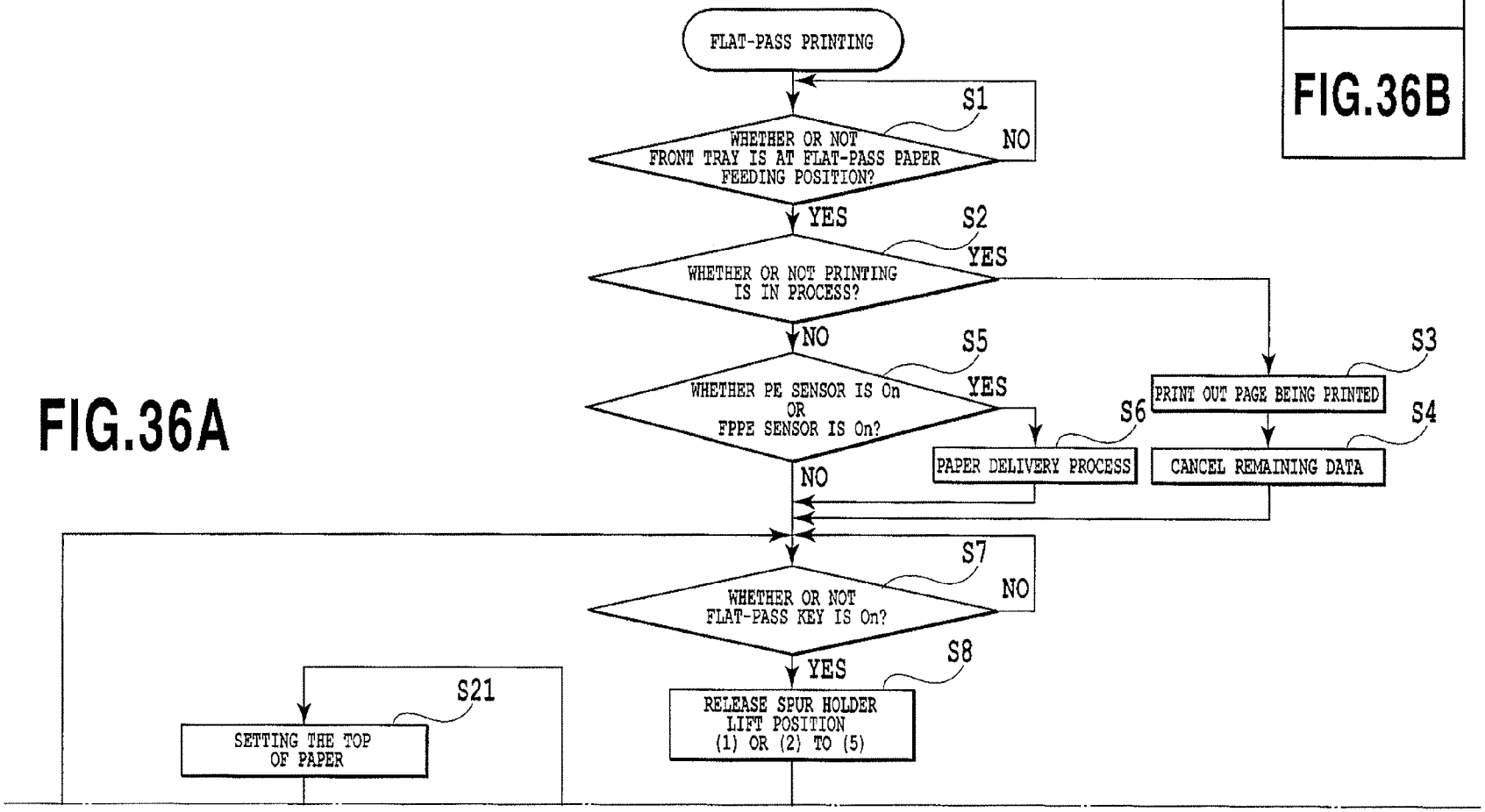
FIG. 36 is a diagram showing the relationship of FIGS. 36A and 36B.
FIG. 36A is a flowchart for explaining an operation sequence at the time of the flat-pass printing.
Figure 36B:
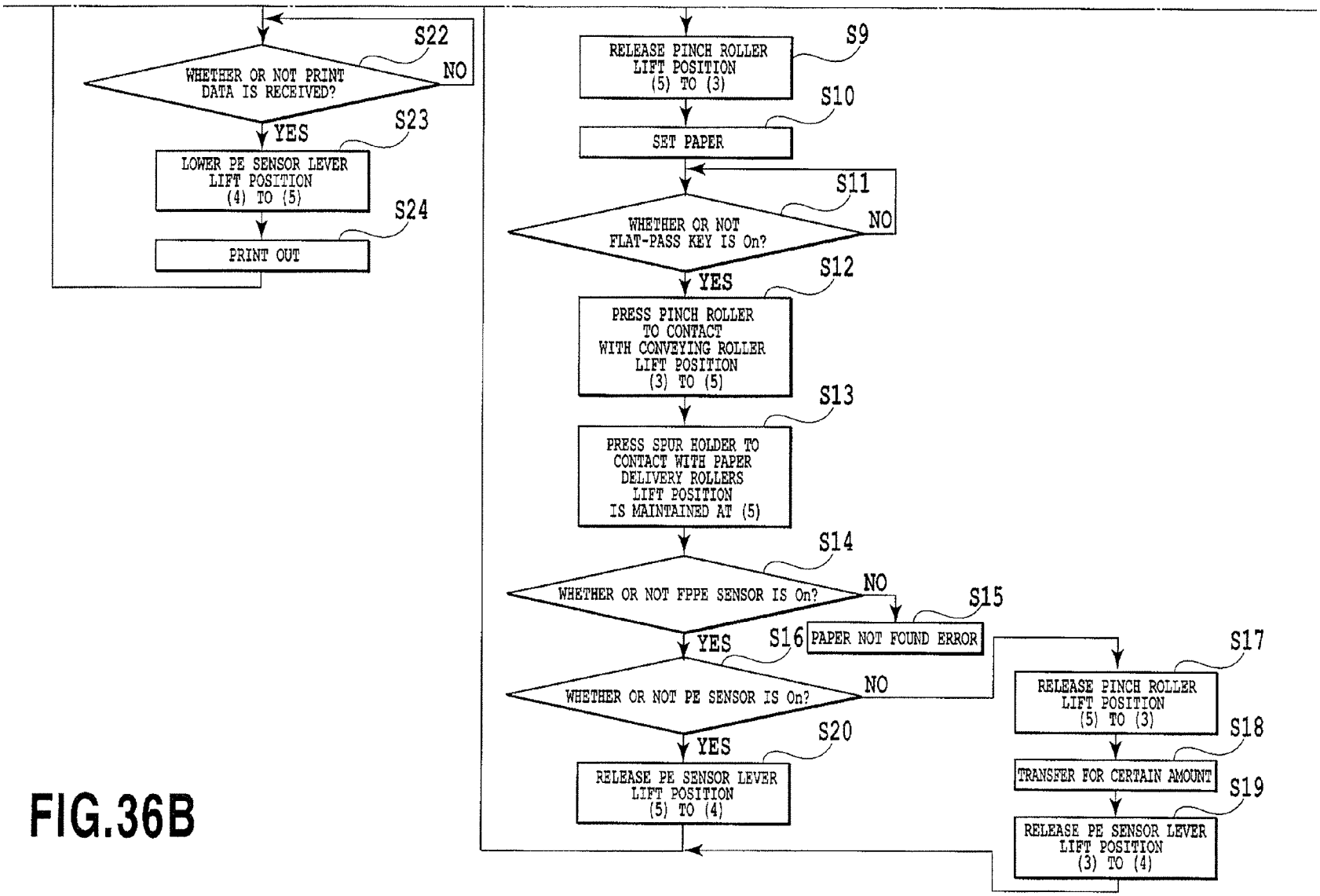
FIG. 36B is a flowchart for explaining an operation sequence at the time of the flat-pass printing.

FIG. 36 is a flowchart for explaining an operation sequence executed by the printing apparatus of this embodiment and the user at the time of flat-pass printing. Moreover, FIGS. 37A to 37G are schematic sectional side views for explaining operational states of the respective mechanisms in the respective steps. Note that the operations of the flat-pass printing section have been already described in the section 1.2 (F) flat-pass printing section. In this event, however, the flat-pass printing operations will be described more in detail including features of the present invention.

When a flat-pass printing mode is executed, first, in Step S1, a CPU detects a position of a front cover M7010 from an output value of a sensor. In execution of flat-pass printing, the user performs an operation of lifting the front cover M7010 up to a position of a paper delivery port, in order to horizontally feed the printing medium from the paper delivery port. Accordingly, the flat-pass printing mode is started by detecting the user operation.

In Step S2, it is determined whether or not the printing operation is currently performed. If it is determined that the printing operation is being performed, the processing advances to Step S3 to print only a page in a process of printing. Moreover, if there is subsequent print data, the data is canceled in Step S4. In the printing apparatus of this embodiment, the front cover M7010 used as a paper delivery tray in a normal mode is set in an approximately horizontal position as a paper feed tray in the flat-pass printing. If the paper delivery tray is rearranged to a horizontal position during the printing operation, and a plurality of printing media are ejected one after another in this state, there arises a concern that the printing media, which are to be subsequently ejected, push out the printing media already ejected. Thus, in this embodiment, in order to avoid such a situation, printing of only one printing medium, which is being printed, is completed, and the printing medium is ejected.

In a case where it is determined in Step S2 that the printing operation is not being performed, the processing advances to Step S5 to check outputs of both of a PE sensor E0007 and a FPPE sensor E9001. Even in a case where it is determined in Step S2 that the printing operation is not being performed, the printing medium in the previous printing may be left on a paper passing route. Thus, in this embodiment, final confirmation of whether or not there is a printing medium left is performed for assurance by use of the two sensors. At this time, in a case where even one of the sensors detects a state where paper is found (ON state), the processing advances to Step S6 to perform paper ejection processing. When the above steps are completed, it is ensured that there is no paper left in a paper passing route. In this event, in order to notify the user of the end of the initial operation for performing the flat-pass printing, operations, such as lighting or blinking of a LED, emission of a buzzer sound and display on a screen of an input device, may be performed. When the completion of the initial operation is confirmed, the user can operate a flat-pass key E3004.

In Step S7, the CPU determines whether or not the flat-pass key E3004 is in an ON state. If it is determined that the flat-pass key E3004 is in the ON state, the processing advances to Step S8.

In Step S8, the mechanism is first moved to the position 5 in order to release the spur holder M3130 up to a position sufficiently higher than a thickness of a printing medium.

Next, in Step S9, the position is returned to the position 3, and the pinch roller holder M3000 is released.

Figure 37A:
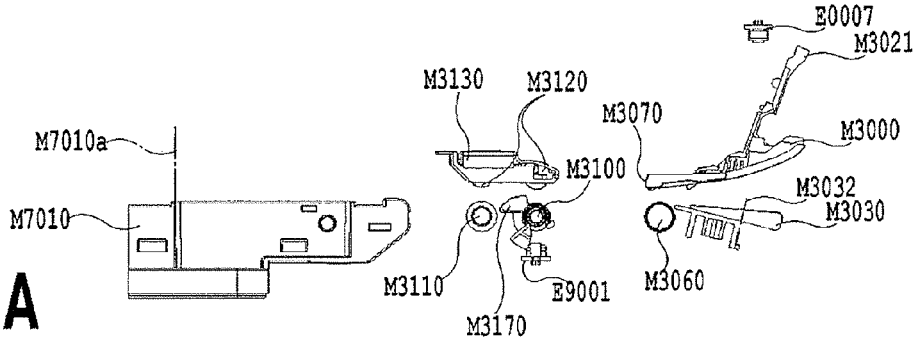
FIGS. 37A to 37G are schematic sectional side views for explaining operational states of the respective mechanisms at the time of the flat-pass printing.

FIG. 37A shows the state at the position 3, that is, a state where both of the spur holder M3130 and the pinch roller holder M3000 are sufficiently released. In this state, the paper guide flapper M3030 is in the large release state, and the antistatic brush M3032 is retreated downward. Moreover, the PE sensor lever M3021 is also in the avoidance state described in FIG. 27B. Accordingly, even if paper is inserted from the paper delivery port, the paper does not get stuck with the lever.

In subsequent Step S10, the user sets a printing medium. The user places the printing medium on the front tray M7010 in a state where a rear end portion (an end portion on a front side toward the user) of the printing medium is aligned with a marker position M7010*a* shown in FIG. 37A. Thereafter, the user presses the flat-pass key E3004. In Step S11, the CPU determines whether or not the flat-pass key E3004 is in the ON state. When the flat-pass key E3004 is in the ON state, the processing advances to Step S12. In Step S12, the mechanism is moved to the position 5, and the pinch roller holder M3000 is set in a state of being pressed to be in contact with the conveying roller M3060 to hold the printing medium.

Furthermore, in Step S13, the spur holder M3130 is set in the state of being pressed to be in contact with the eject rollers M3110 while the position 5 is maintained. In this event, the state of holding the printing medium varies depending on a length of a printing medium M9900 to be inserted.

Figure 37B:
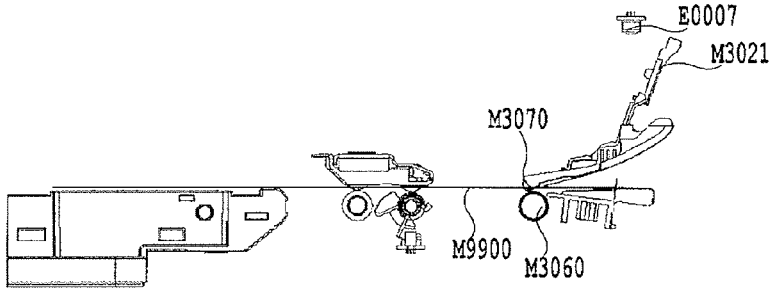
Figure 37C:
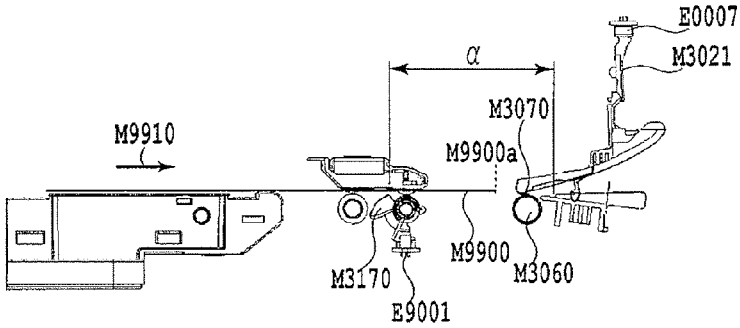
Figure 37D:
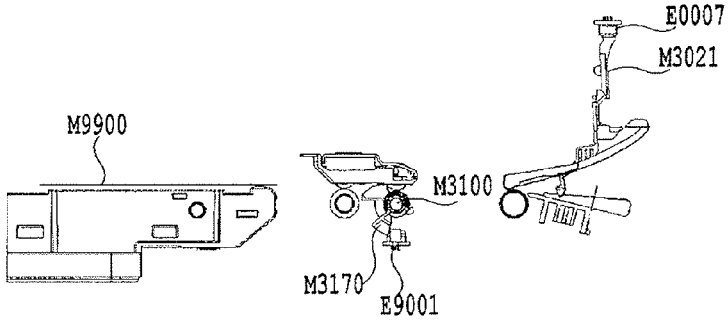

FIGS. 37B to 37D are views showing three holding states different from one another depending on the length of the printing medium M9900. FIG. 37B shows a state where the printing medium is sufficiently long, and where a tip thereof reaches the pair of the conveying roller M3060 and the pinch roller M3070. Moreover, FIG. 37C shows a state where the tip of the printing medium reaches a pair of eject rollers, but where the tip does not reach the pair of conveying rollers. Furthermore, FIG. 37D shows a state where the tip of the printing medium does not even reach the pair of eject rollers. The three kinds of states described above can be determined by checking output values of the FPPE sensor E9001 and of the PE sensor E0007 which are provided in the printing apparatus.

In Step S14, first, an output value of the FPPE sensor E9001 installed in the vicinity of a first eject roller M3100 is checked. When the detected value indicates ON, it is determined that the printing medium M9900 has reached a FPPE sensor lever M3170, and the processing advances to Step S16. On the other hand, when the detected value indicates OFF, it is determined that the printing medium M9900 has not reached the FPPE sensor lever M3170, or that the flat-pass key E3004 has been pressed down without setting the printing medium M9900. Thereafter, the processing advances to Step S15 to end the processing as a paper not found error.

In Step S16, an output value of the PE sensor E0007 on an upstream side of the conveying roller M3060 is checked. When the detected value indicates ON, it is determined that the printing medium M9900 has reached the PE sensor lever M3021, and the processing advances to Step S20. On the other hand, when the detected value indicates OFF, it is determined that the printing medium M9900 has reached the FPPE sensor E9001, but that the printing medium M9900 has not reached the PE sensor lever M3021. Hence, the processing advances to Step S17.

The state where the processing advances to Step S17 is assumed to be a situation where the length of the printing medium is short, and where a tip M9900*a* thereof does not reach the conveying roller M3060 even if the rear end portion of the printing medium M9900 is aligned with a predetermined position, as shown in FIG. 37C. Moreover, although not shown in the drawing here, also conceivable is a situation where the tip passes the conveying roller M3060, but where the tip does not reach a position to rotate the PE sensor lever M3021. The above two situations cannot be determined. However, if the printing medium M9900 is carried into a direction of an arrow M9910 in the state described above, there arises a risk that the tip M9900*a* hits against the pinch roller M3070.

Figure 37E:
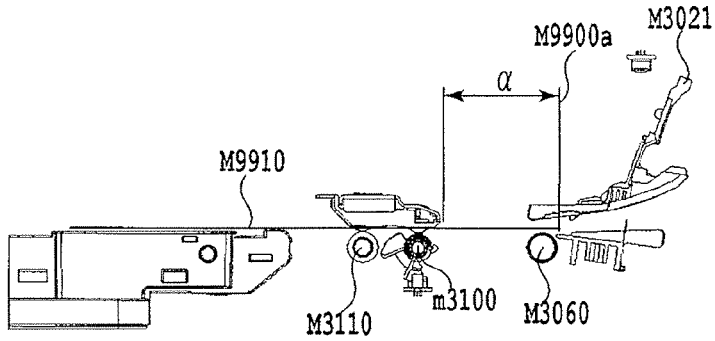

Consequently, in this embodiment, for more security, the mechanism is moved to the position 3, and the pinch roller holder M3000 is once released in Step 17. Thereafter, the printing medium is transferred for a predetermined amount a in Step S18. FIG. 37E shows this state. In this event, the predetermined transferring amount $\alpha$ is set to be a distance between the FPPE sensor lever M3170 and the conveying roller M3060. By setting the transferring amount in such a manner, even when the tip M9900*a* of the printing medium M9900 exists in a position at the time immediately after passing the FPPE sensor lever M3170, the printing medium M9900 is reliably held by the two pairs of rollers after being transferred for the predetermined amount $\alpha$.

Figure 37F:
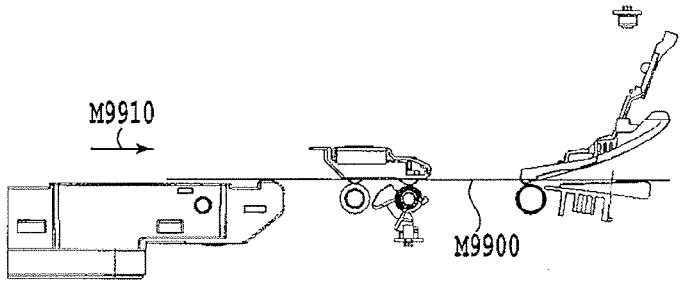

In subsequent Step S19, the position is moved to the position 4, and the PE sensor lever M3021 is released so as not to hinder the transfer. FIG. 37F shows such a state.

Meanwhile, even when it is determined in Step S16 that the PE sensor E9001 is also in the ON state, the pinch roller lift mechanism is set at the position 5. Thus, if the transfer is continued in this state, a surface of the printing medium M9900 may be damaged by the PE sensor lever M3021. Hence, in Step S20, as in the case of Step S19, the position is moved to the position 4, and the PE sensor lever M3021 is released so as not to hinder the transfer.

Thereafter, in Step S21, the printing medium M9900 is further sufficiently carried into the apparatus, and a top of the printing medium M9900 is set, in other words, a print start position is detected prior to a printing operation. Note that the printing apparatus of this embodiment performs switchback flat-pass printing. Hence, the tip M9900*a* of the printing medium at the time of transfer is set to be the rear end during printing, and the rear end thereof at the time of transfer is set to be a top end during printing.

Figure 37G:
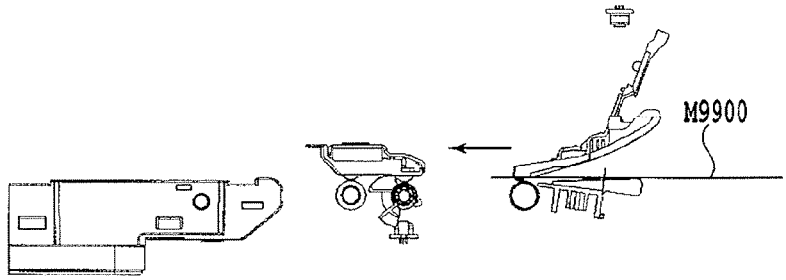

When print data is received in subsequent Step S22, the processing advances to Step S23. In Step S23, the mechanism is moved to the position 5, and the PE sensor lever M3021 is lowered. This is because it is necessary to detect the rear end portion of the printing medium (the rear end portion at the time of printing) during the printing operation. Thereafter, the processing advances to Step S24, and the printing operation is started. FIG. 37G shows a state at the time of the printing.

When printing for one page is completed, the processing returns to Step S7 again, and the flat-pass printing is continued for the next page.

As described above, according to this embodiment, the printing medium is reliably transferred and a top thereof is reliably set by effectively using information obtained by a plurality of sensors. Thus, it is made possible to automatically set the printing medium at a proper position without troubling the user even when the printing medium is one other than those having a standard size. Moreover, while effectively utilizing one driving source, a plurality of mechanisms is independently controlled. For this reason, accurately controlled flat-pass printing can be realized despite of the relatively small number of components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-262375, filed Sep. 9, 2005, which is hereby incorporated by reference herein in its entirety.

What is claimed is:

1. A printing medium transferring apparatus comprising:

a first guide member which includes a pinch roller and conveying roller;

a driving source for moving the pinch roller between one position where the pinch roller is pressed to be in contact with the conveying roller and the other position where the pinch roller is separated from the conveying roller;

the pinch roller for transferring a printing medium between the conveying roller and the pinch roller by being rotatably pressed to be in contact with the conveying roller, and which enables the pinch roller to be pressed to be in contact with, and separated from, the conveying roller while guiding a printing surface of the printing medium;

a second guide member guiding the rear surface of the printing medium in a position facing the first guide member;

detection means which is positioned in a printing medium transferring space formed between said first guide member and said second guide member and is able to detect a presence of the printing medium; and a holding member which includes a spur and an eject roller, wherein, by a power of said driving source, the spur is moved between one position where the spur is pressed to be in contact with the eject roller and the other position where the spur is separated from the eject roller, the spur for transferring the printing medium between the eject roller and the spur by being rotatably pressed to be in contact with the eject roller, and which enables the spur to be pressed to be in contact with, and separated from, the eject roller, wherein said second guide member is able to be moved, by the power of said driving source, between one position where said second guide member is close to said first guide member and the other position where said second guide member is far from said first guide member, and said detection means is able to be moved, by the power of said driving source, between one position where said detection means is within the printing medium transferring space and an other position where said detection means is separated from the printing medium transferring space.

2. The printing medium transferring apparatus according to claim 1, wherein an operation of the moving of the pinch roller in said first guide member, an operation of the moving of said second guide member, an operation of the moving of said detection means, and an operation of the moving of the spur in said holding member, are performed at different timings from that of one another.

3. The printing medium transferring apparatus according to claim 2, wherein the operation of the moving of the spur in the holding member is performed simultaneously with none of the operation of the moving of the pinch roller in the first guide member, the operation of the moving of the second guide member and the operation of the moving of the detection means.

4. The printing medium transferring apparatus according to claim 1, wherein:

a force of the driving source is transmitted by a first gear array and a second gear array, which are branched off from the middle of a path;

moving of the pinch roller in the first guide member, moving of the second guide member, and moving of the detection means, are performed by use of the force transmitted by the first gear array; and moving of the spur in the holding member are performed by use of the force transmitted by the second gear array.

5. The printing medium transferring apparatus according to claim 1, further comprising printing means for printing an image on the printing medium in the printing medium transferring space.

* * * * *